US006543886B1

(12) United States Patent
Hattori et al.

(10) Patent No.: US 6,543,886 B1
(45) Date of Patent: Apr. 8, 2003

(54) LIQUID SUPPLY METHOD, LIQUID SUPPLY CONTAINER, NEGATIVE PRESSURE GENERATING MEMBER CONTAINER, AND LIQUID CONTAINER

(75) Inventors: Shozo Hattori, Tokyo (JP); Hajime Yamamoto, Yokohama (JP); Eiichiro Shimizu, Yokohama (JP); Hiroshi Koshikawa, Kawasaki (JP); Hiroki Hayashi, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,202

(22) Filed: Jun. 21, 2000

(30) Foreign Application Priority Data

Jun. 24, 1999 (JP) ..... 11-179077

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | | |
|---|---|---|---|---|---|
| 4,719,479 | A | * | 1/1988 | Kyogoku | 347/85 |
| 5,509,140 | A | | 4/1996 | Koitabashi et al. | 347/86 |
| 5,619,238 | A | | 4/1997 | Higuma et al. | 347/86 |
| 5,623,291 | A | * | 4/1997 | Morandotti et al. | 347/7 |
| 5,886,715 | A | * | 3/1999 | Fukuoka | 347/33 |
| 5,975,330 | A | * | 11/1999 | Sasaki et al. | 220/495.01 |
| 6,019,459 | A | * | 2/2000 | Pew et al. | 347/85 |
| 6,022,102 | A | * | 2/2000 | Ikkatai | 347/85 |

FOREIGN PATENT DOCUMENTS

| | | | |
|---|---|---|---|
| EP | 493058 | 7/1992 | |
| EP | 580433 | 1/1994 | |
| EP | 581531 | 2/1994 | |
| EP | 645244 | 3/1995 | |
| EP | 719646 | 7/1996 | |
| EP | 738605 | 10/1996 | |
| EP | 872348 | 10/1998 | |
| EP | 887190 | 12/1998 | |
| JP | 7-68776 | 3/1995 | |
| JP | 7-68782 | 3/1995 | |
| JP | 10-315503 | 12/1998 | |
| JP | 11058772 | * 3/1999 | B41J/2/175 |

* cited by examiner

*Primary Examiner*—Anh T. N. Vo
(74) *Attorney, Agent, or Firm*—Fitzpatrick, Cella, Harper & Scinto

(57) ABSTRACT

There is disclosed a liquid supply method in which a bubble is prevented from being retained or accumulated in a communication part. An upper wall surface of a joint pipe for connecting a negative pressure control chamber container to an ink container is inclined upward to the ink container from the negative pressure control chamber container. Since the upper wall surface of the joint pipe is inclined, the bubble flows into the ink container without being retained or accumulated on the upper wall surface of the joint pipe during gas-liquid exchange.

12 Claims, 26 Drawing Sheets

260b
261
230
266
265
262
263
260a
264

LIQUID SUPPLY METHOD, LIQUID SUPPLY CONTAINER, NEGATIVE PRESSURE GENERATING MEMBER CONTAINER, AND LIQUID CONTAINER

BACKGROUND OF THE INVENTION

1. Field of the Invention

The present invention relates to a liquid supply method, a liquid supply container, a negative pressure generating member container and a liquid container, more specifically relates to a liquid supply method in a liquid container in which a negative pressure generating member container and a liquid supply container are attachable/detachable with respect to each other.

2. Related Background Art

Conventional recording devices which perform recording on record materials (hereinafter referred to simply as "the record sheet") such as paper, cloth, plastic sheet, and OHP sheet are proposed as forms on which recording heads by various recording systems such as a wire dot system, heat-sensitive system, heat transfer system and ink jet system can be mounted.

Among the recording devices, as a low-noise non-impact recording system, the recording device (hereinafter referred to as the "ink jet recording device") provided with the recording head of the ink jet recording system for discharging ink from a discharge port (nozzle) disposed on a recording element to perform the recording on the record sheet can realize a high-density high-speed recording operation.

The ink jet recording device is constituted to be adapted for the inherent function, use form, and the like of the system to which this device is applied. A general ink jet recording device is provided with a carriage on which an ink jet head cartridge constituted of a recording head, ink tank, and tank holder is mounted, conveyance means for conveying the record sheet, and control means for controlling these.

Moreover, the recording head for discharging ink droplets from a plurality of discharge ports is serially scanned in a direction (main scan direction) crossing at right angles to a record sheet conveyance direction (sub-scan direction), and the record sheet is intermittently conveyed (pitch-fed) by an amount equal to the record width during non-recording. By using the recording head in which a multiplicity of nozzles for discharging the ink are arranged on a straight line parallel to the sub-scan direction, when the recording head scans once on the record sheet, the recording is performed in a width corresponding to the number of nozzles.

Furthermore, for the ink jet recording device, the running cost is low, the device can be miniaturized, and color image recording can easily be performed using a plurality of color inks. Above all, in a line type recording device in which a line type recording head with a multiplicity of discharge ports arranged in the width direction of the record sheet, the recording can further be accelerated.

For the above-described reasons, the ink jet recording device is utilized and merchandised as information processing system output means such as a printer as the output terminal of a copying machine, facsimile machine, electronic typewriter, word processor, or a work station, and a handy or portable printer mounted on a personal computer, host computer, optical disk device, and video device.

On the other hand, examples of an energy generating element for generating an energy to discharge the ink from the discharge port of the recording head include a piezoelement or other elements using an electromechanical converter, an element for radiating laser or electromagnetic wave and generating heat to discharge ink droplets with the action by the heating, an electrothermal conversion element provided with a heating resistor for heating a liquid, and the like.

Above all, for the recording head of the ink jet recording system in which a heat energy is utilized to discharge the ink droplets, since the discharge ports can be arranged with a high density, high-resolution recording can be performed. Moreover, the recording head in which the electrothermal conversion element is used as the energy generating element is advantageous, because miniaturization is facilitated, the advantages of an IC technology or a micro processing technology remarkably advanced with an enhanced reliability in the recent semiconductor field can sufficiently be utilized, high-density mounting is facilitated, and manufacture cost is reduced.

Examples of the above-described recording head include a chip type recording head integrally formed with the ink tank, and a recording head in which the ink tank is attached/detached with respect to the tank holder integrally formed with the recording head.

Moreover, an ink tank is described in European Patent Publication No. EP0580433, which comprises an ink containing part substantially entirely sealed with respect to a negative pressure generating member containing chamber for containing an ink absorber and other negative pressure generating members. The ink tank is used while the negative pressure generating member containing chamber is opened to the atmosphere. Moreover, the ink tank structured described above in which the ink containing chamber is replaceable is described in European Patent Publication No. EP0581531. For the ink tank as the replaceable ink containing chamber, when the ink tank is detachably attached to the tank holder, the tank holder and ink tank are provided with engagement parts engaging with each other. Moreover, when the ink tank is mounted on the tank holder and the engagement parts engage with each other, the ink tank is fixed to the tank holder.

However, for the negative pressure generating member containing chamber detachably attached to the ink containing chamber as described above, when the ink containing chamber is separated from the negative pressure generating member containing chamber, there is a possibility that ink leaks from the communication part of the ink containing chamber, and to prevent this the communication part needs to be provided with a valve mechanism. On the other hand, in order to connect the negative pressure generating member containing chamber to the ink containing chamber, the valve needs to be opened. To achieve this, when a communicating part for communicating with the communication part of the negative pressure generating member containing chamber is constituted to open the valve, the communicating part requires a stroke length for opening the valve. Specifically, the communicating part requires a certain degree of length, and as a result, during gas-liquid exchange, an air bubble is supposed to be retained and accumulated on the upper wall surface inside the communicating part inserted into the communication part.

SUMMARY OF THE INVENTION

Wherefore, an object of the present invention is to provide a liquid supply method for stably supplying a liquid without retaining or accumulating air bubble in a communication part, a liquid supply container, a negative pressure generating member container and a liquid container.

Moreover, further object of the present invention is to provide various related inventions newly developed to solve the above-described new technical problems such as the retention and accumulation of the bubble based on inventive viewpoints, such as a constitution for securing the degree of freedom in the movement of bubble, and a structure for promoting the ink movement to a negative pressure generating member containing chamber from an ink containing chamber.

To achieve the above-described objects, according to the present invention, there is provided a liquid supply method for a liquid supply container comprising a liquid containing part for containing a liquid in a sealed space, and for a negative pressure generating member container detachably attached to the liquid supply container and provided with a negative pressure generating member which can hold the liquid, an atmosphere communication part for communicating with the atmosphere and a liquid supply part for supplying the liquid to the outside. In the liquid supply method, the flow resistance of a communication part for connecting the liquid supply container to the negative pressure generating member container is reduced toward the liquid containing part.

In the liquid supply method, since the flow resistance of the communication part is reduced toward the liquid containing part, the liquid fluidity is enhanced. This also enhances the bubble fluidity, the bubble can flow into the liquid supply container without being retained or accumulated in the communication part during gas-liquid exchange, and the liquid can stably be supplied to the negative pressure generating member container.

According to another aspect of the present invention, there is provided a liquid supply method for a liquid supply container comprising a liquid containing part for containing a liquid in a sealed space, and for a negative pressure generating member container detachably attached to the liquid supply container and provided with a negative pressure generating member which can hold the liquid, an atmosphere communication part for communicating with the atmosphere and a liquid supply part for supplying the liquid to the outside. In the liquid supply method, a gas restraint area on the top surface part side of a communication part for connecting the liquid supply container to the negative pressure generating member container is shorter than a liquid restraint area on the lower surface part side of the communication part.

In the liquid supply method, since the gas restraint area on the top surface part side of the communication part is shorter than the liquid restraint area on the lower surface part side, the bubble is easily discharged to the liquid supply container from the communication part, a smooth gas-liquid exchange operation is therefore possible, and the liquid can stably be supplied to the negative pressure generating member container.

Moreover, according to the present invention there is provided a liquid supply container which is detachably attached to a negative pressure generating member container comprising a negative pressure generating member able to hold a liquid, an atmosphere communication part for communicating with the atmosphere, and a liquid supply part for supplying the liquid to the outside, and which comprises a liquid containing part for containing the liquid in a sealed space. In the liquid supply container, the negative pressure generating member container comprises a supply tube for supplying the liquid, and the flow resistance of the supply tube is reduced toward the liquid containing part.

For the liquid supply container, since the flow resistance of the supply tube is reduced toward the liquid containing part, the liquid fluidity is enhanced. This also enhances the bubble fluidity, the bubble can flow into the liquid supply container from the negative pressure generating member container without being retained or accumulated in the supply tube during the gas-liquid exchange, and the liquid can stably be supplied to the negative pressure generating member container.

According to another aspect of the present invention there is provided a liquid supply container which is detachably attached to a negative pressure generating member container comprising a negative pressure generating member able to hold a liquid, an atmosphere communication part for communicating with the atmosphere, and a liquid supply part for supplying the liquid to the outside, and which comprises a liquid containing part for containing the liquid in a sealed space. In the liquid supply container, the negative pressure generating member container comprises a supply tube for supplying the liquid, and the horizontal length of the top surface part of the supply tube is shorter than the horizontal length of the lower surface part of the supply tube.

In the liquid supply container, since the gas restraint area on the top surface part side of the supply tube is shorter than the liquid restraint area on the lower surface part side, the bubble is easily discharged to the liquid supply container from the supply tube, the smooth gas-liquid exchange operation is therefore possible, and the liquid can stably be supplied to the negative pressure generating member container.

According to still another aspect of the present invention there is provided a liquid supply container which is detachably attached to a negative pressure generating member container comprising a negative pressure generating member able to hold a liquid, an atmosphere communication part for communicating with the atmosphere, and a liquid supply part for supplying the liquid to the outside, and which comprises a liquid containing part for containing the liquid in a sealed space. In the liquid supply container, the negative pressure generating member container comprises a supply tube for supplying the liquid, and the sectional shape of the supply tube includes an area in which the sectional area of the supply tube increases toward the liquid containing part.

The liquid supply container is shaped such that the sectional area of the supply tube increases toward the liquid containing part. Specifically, this shape minimizes the influence of the wall surface constituting the supply tube on the liquid in the bubble flow direction, the flow path resistance decreases, and the liquid fluidity is therefore enhanced. This also enhances the bubble fluidity, the bubble can be introduced without being retained or accumulated in the supply tube during the gas-liquid exchange and the liquid can stably be supplied to the negative pressure generating member container.

Moreover, according to still another aspect of the present invention there is provided a liquid supply container which is detachably attached to a negative pressure generating member container comprising a negative pressure generating member able to hold a liquid, an atmosphere communication part for communicating with the atmosphere, and a liquid supply part for supplying the liquid to the outside, and which comprises a liquid containing part for containing the liquid in a sealed space. In the liquid supply container, the negative pressure generating member container comprises a supply tube for supplying the liquid, and the top surface part of the supply tube is relatively subjected to a water repellent treatment with respect to the other areas of the supply tube. In this case, since the top surface part of the supply tube is relatively subjected to the water repellent treatment with respect to the other areas of the supply tube, the liquid in contact with the top surface part easily flows by the water repellent effect of the top surface part, the bubble can therefore flow into the liquid supply container without being retained or accumulated in the supply tube during the gas-liquid exchange, and the liquid can stably be supplied to the negative pressure generating member container.

According to the present invention there is provided a negative pressure generating member container which is detachably attached to a liquid supply container comprising a liquid containing part containing a liquid in a sealed space and being able to be deformed to generate a negative pressure, and which comprises a negative pressure generating member able to hold the liquid, an atmosphere communication part for communicating with the atmosphere, and a liquid supply part for supplying the liquid to the outside. The negative pressure generating member container comprises a supply receiving tube to which the liquid is supplied from the liquid supply container, and a gas restraint area on the top surface part side of the supply receiving tube is shorter than a liquid restraint area on the lower surface part side of the supply receiving tube.

Moreover, according to another aspect of the present invention there is provided a negative pressure generating member container which is detachably attached to a liquid supply container comprising a liquid containing part containing a liquid in a sealed space and being able to be deformed to generate a negative pressure, and which comprises a negative pressure generating member able to hold the liquid, an atmosphere communication part for communicating with the atmosphere, and a liquid supply part for supplying the liquid to the outside. The negative pressure generating member container comprises a supply receiving tube to which the liquid is supplied from the liquid supply container, and the sectional shape of the supply receiving tube includes an area in which the sectional area of the supply receiving tube increases toward the liquid containing part.

According to the present invention there is provided a liquid container comprising: a negative pressure generating member containing chamber which comprises a liquid supply part for supplying a liquid to the outside and an atmosphere communication part for communicating with the atmosphere and which holds the liquid inside; and a liquid containing chamber which forms a substantial sealed space excluding a communication part with respect to the negative pressure generating member containing chamber and which comprises a liquid containing part for containing the liquid. In the liquid container, a gas restraint area on the top surface part side of the communication part for connecting the liquid supply container to the negative pressure generating member container is shorter than a liquid restraint area on the lower surface part side of the communication part.

Moreover, according to the present invention there is further provided a liquid container comprising: a negative pressure generating member containing chamber which comprises a liquid supply part for supplying a liquid to the outside and an atmosphere communication part for communicating with the atmosphere and which holds the liquid inside; and a liquid containing chamber which forms a substantial sealed space excluding a communication part with respect to the negative pressure generating member containing chamber and which comprises a liquid containing part for containing the liquid. In the liquid container, the sectional shape of the communication part for connecting the liquid supply container to the negative pressure generating member container includes an area in which the sectional area of the communication part increases toward the liquid containing part.

DETAILED DESCRIPTION OF THE PREFERRED EMBODIMENTS

Embodiments of the present invention will be described hereinafter with reference to the drawings.

Moreover, the "hardness" of a capillary force generating member in the present invention refers to the "hardness" while the capillary force generating member is contained in a liquid supply container, and is defined by the inclination of a repulsion force (unit: kgf/mm) to the deformation amount of the capillary force generating member. For the sizes of the "hardness" of two capillary force generating members, the capillary force generating member with a larger repulsion force inclination to the deformation amount is referred to as the "hard capillary force generating member".

First Embodiment

<Entire Constitution>

Figure 1:
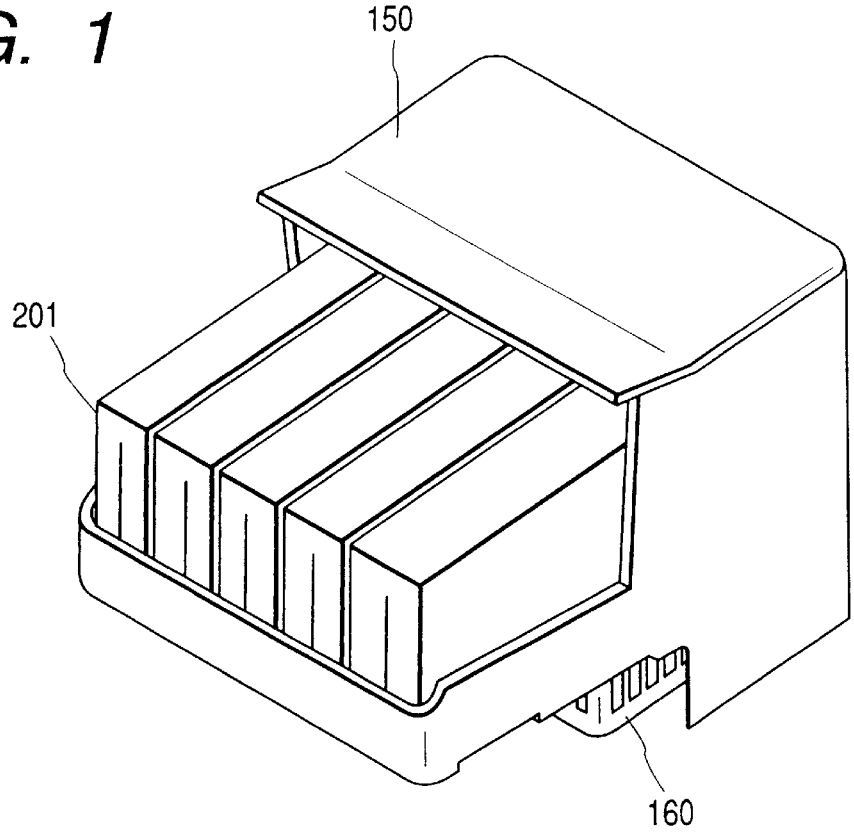
FIG. 1 is a perspective view showing an ink jet head cartridge according to a first embodiment of the present invention.
Figure 3:
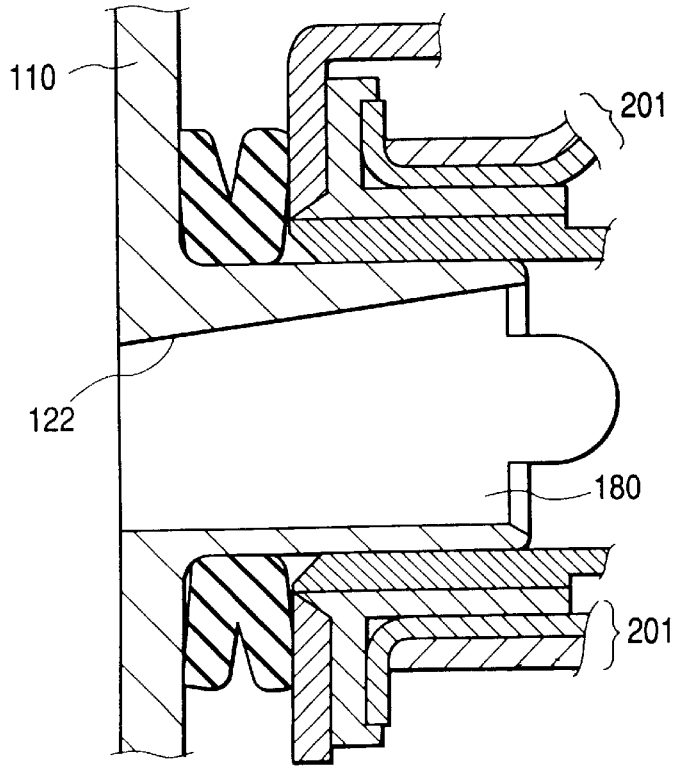
FIG. 3 is an enlarged side sectional view in the vicinity of a joint pipe of the ink jet head cartridge shown in FIG. 1.
Figure 2:
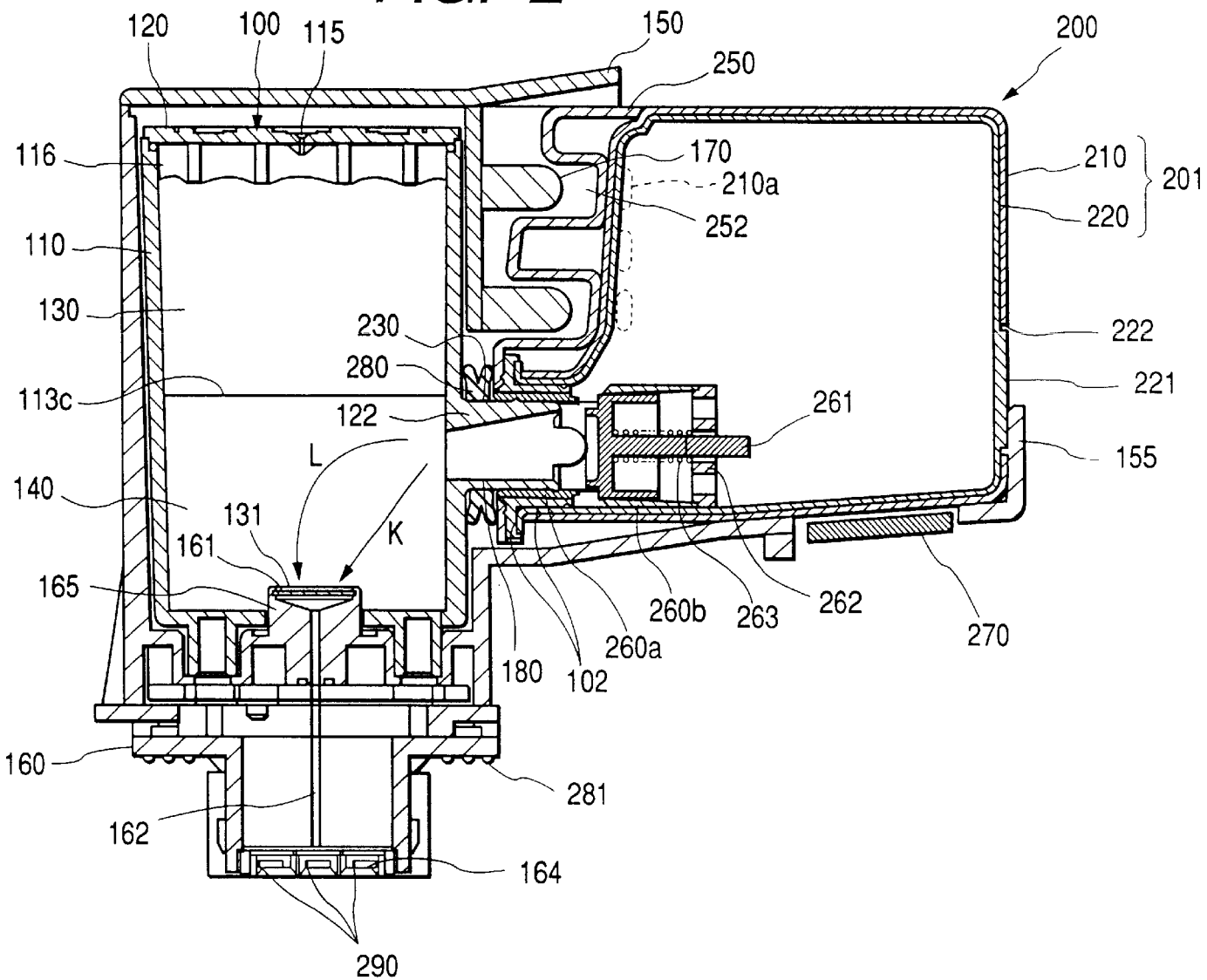
FIG. 2 is a sectional view of the cartridge of FIG. 1.

FIG. 1 is a perspective view of an ink jet head cartridge according to a first embodiment of the present invention, and FIG. 2 is a sectional view. Moreover, FIG. 3 is an enlarged side sectional view in the vicinity of a joint pipe 180.

In the present embodiment, the respective elements constituting the ink jet head cartridge to which the present invention is applied, and the relations of these elements will be described. Since various inventive techniques developed in the establishment stage of the present invention are applied to the constitution of the present embodiment, the entire embodiment will be described by describing the constitution.

As shown in FIGS. 1 and 2, the ink jet head cartridge of the first embodiment is constituted of an ink jet head unit 160, a holder 150, a negative pressure control chamber unit 100, an ink tank unit 200, and the like. The negative pressure control chamber container 110 is fixed inside the holder 150, and the ink jet head unit 160 is fixed via the holder under the negative pressure control chamber unit 100. The holder 150 is fixed to the negative pressure control chamber unit 100, and the holder 150 is fixed to the ink jet head unit 160 as described herein, for example, by screwing or joining so that they can easily be disassembled, the cartridge is effectively recycled, and the cost is effectively reduced with respect to constitution changes such as a version change. Moreover, the respective components are different from one another in life, it is therefore necessary to replace only the component requiring the replacement, and in this respect it is preferable to easily disassemble the components. However, depending upon conditions, a complete fixing may of course be performed by welding, thermal caulking, and the like. The negative pressure control chamber unit 100 is constituted of a negative pressure control chamber container 110 with an opening formed in its top surface, a negative pressure control chamber lid 120 attached to the top surface of the negative pressure control chamber container 110, and two absorbers 130, 140, mounted inside the negative pressure control chamber container 110, for absorbing and holding ink. The absorbers 130, 140 are stacked in upper and lower layers and closely abut on each other to fill the inside of the negative pressure control chamber container 110 during the use of the ink jet head cartridge. Since the capillary force generated by the lower absorber 140 is higher than the capillary force generated by the upper absorber 130, the lower absorber 140 has a higher ink retaining force. The ink inside the negative pressure control chamber unit 100 is supplied to the ink jet head unit 160 through an ink supply tube 165.

A supply port 131 on the tip end of the ink supply tube 165 on the side of the absorber 140 is provided with a filter 161, and the filter 161 presses the absorber 140. The ink tank unit 200 is detachable/attachable with respect to the holder 150.

The joint pipe 180 is connected to the surface of the negative pressure control chamber container 110 on the side of the ink tank unit 200, and is inserted into a joint port 230 of the ink tank unit 200, and an inner upper wall surface 122 is inclined upward toward an ink container 201 from the negative pressure control chamber container 110. Therefore, when gas-liquid exchange is performed via the joint pipe 180, a bubble contacting the upper wall surface 122 receives the partial force of bubble buoyancy exerted parallel to the upper wall surface 122 and toward the ink container 201 from the negative pressure control chamber container 110, the partial force in the direction of the ink container 201 propels the bubble toward the ink container 201, and no bubble is retained or accumulated on the upper wall surface 122 of the joint pipe 180. Additionally, the upper wall surface 122 is shown as a linear inclination in FIGS. 1 and 2, but this is not limited, and the upper wall surface 122 may comprise a curved inclination as long as the bubble retention or accumulation fails to occur. The negative pressure control chamber unit 100 and the ink tank unit 200 are constituted so that the ink in the ink tank unit 200 is supplied into the negative pressure control chamber unit 100 via the connection part of the joint pipe 180 with the joint port 230. The part of the surface of the negative pressure control chamber container 110 on the side of the ink tank unit 200 and above the joint pipe 180 is provided with an ID member 170, protruded from the surface, for preventing the incorrect mounting of the ink tank unit 200.

The negative pressure control chamber lid 120 is provided with an atmosphere communication port 115 for connecting the inside of the negative pressure control chamber container 110 to the outside air, specifically the absorber 130 contained in the negative pressure control chamber container 110 to the outside air, and in the vicinity of the atmosphere communication port 115 in the negative pressure control chamber container 110, a space formed by a rib protruded from the surface of the negative pressure control chamber lid 120 on the side of the absorber 130, and a buffer space 116 of an area in which no ink (liquid) is present in the absorber are disposed.

A valve mechanism is disposed in the joint port 230, and the valve mechanism is constituted of a first valve frame 260*a*, a second valve frame 260*b*, a valve body 261, a valve lid 262 and an urging member 263. The valve body 261 is slidably supported in the second valve body 260*b* and pressed toward the first valve frame 260*a* by the urging member 263. When the joint pipe 180 is not inserted into the joint port 230, the edge of the part of the valve body 261 on the side of the first valve frame 260*a* is pressed by the first valve frame 260*a* by the urging force of the urging member 263, and the hermetic property is maintained in the ink tank unit 200.

When the joint pipe 180 is inserted into the joint port 230, and the valve body 261 is pressed by the joint pipe 180 to move apart from the first valve frame 260*a*, the inside of the joint pipe 180 communicates with the inside of the ink tank unit 200 via an opening formed in the side surface of the second valve frame 260*b*. This releases the air sealed in the ink tank unit 200, and the ink in the ink tank unit 200 is supplied into the negative pressure control chamber unit 100 through the joint port 230 and joint pipe 180. Specifically, when the valve in the joint port 230 opens, the sealed ink containing part of the ink tank unit 200 communicates with the negative pressure control chamber unit 100 only via the opening.

Here, when the ink jet head unit 160 and the negative pressure control chamber unit 100 are fixed to the holder 150 as in the present embodiment, the ink jet head unit 160 and the negative pressure control chamber unit 100 are preferably fixed to the holder 150 by a method provided with the easy disassembly property, such as screws, so that the respective units can be removed and replaced in accordance with the useful life.

Specifically, in the ink jet head cartridge of the present embodiment, usually the incorrect mounting preventing member disposed on the ink tank prevents the ink tanks containing different types of inks from being incorrectly mounted on the negative pressure control chamber. However, when the ID member disposed on the negative pressure control chamber unit 100 is damaged, or when a user intentionally mounts the different types of ink tanks on the negative pressure control chamber unit 100, only the negative pressure control chamber unit 100 may be replaced immediately after the mounting. Moreover, when the holder 150 falls and is damaged, only the holder 150 can be replaced.

Additionally, in order to disassemble the ink tank unit 200, negative pressure control chamber unit 100, holder 150, and ink jet head unit 160, it is preferable to determine the position of the fixing part so that the ink leakage from the respective units can be prevented.

In the first embodiment, since the ink tank unit 200 is connected to the negative pressure control chamber unit 100 utilizing an ink tank engagement part 155 of the holder 150, the negative pressure control chamber unit 100 is prevented from being detached alone from the other fixed units. Specifically, unless at least the ink tank unit 200 is removed from the holder 150, the unit 100 is not easily separated from the holder 150. In this manner, the negative pressure control chamber unit 100 is not easily removed before the ink tank unit 200 is removed from the holder 150. Therefore, there is no possibility that the ink leakage from the connection part is caused by the inadvertent separation of the ink tank unit 200 from the negative pressure control chamber unit 100.

Moreover, the filter 161 is disposed on the end of the ink supply tube 165 of the ink jet head unit 160. Even when the negative pressure control chamber unit 100 is disassembled, there is no possibility of the ink leakage from the ink jet head unit 160. Additionally, since the negative pressure control chamber unit 100 is provided with the buffer space 116 (including the area holding no ink inside the absorbers 130, 140) to prevent the ink from leaking from the ink tank, and a boundary surface 113*c* of two absorbers 130, 140 different in the capillary force is disposed above the joint pipe 180 in the posture during the use (more preferably, as in the present embodiment, the capillary force of the vicinity layer including the boundary surface 113*c* is higher than that of the area of the absorbers 130, 140), the integral structure of the negative pressure control chamber unit 100 and ink tank unit 200 has little possibility of the ink leakage even after the change of the posture. Therefore, in the present embodiment, the ink jet head unit 160 is provided with the fixing part on the bottom surface including the connection terminal of the holder 150, and the separation can easily be performed even when the ink tank unit 200 is attached to the holder 150.

Additionally, depending upon the shape of the holder 150, the negative pressure control chamber unit 100 or the ink jet head unit 160 may indivisibly be formed integrally with the holder 150. As a method of integrally forming the structure, the structure may integrally be molded beforehand, or may indivisibly be formed by thermal caulking, or the like.

Figure 4B:
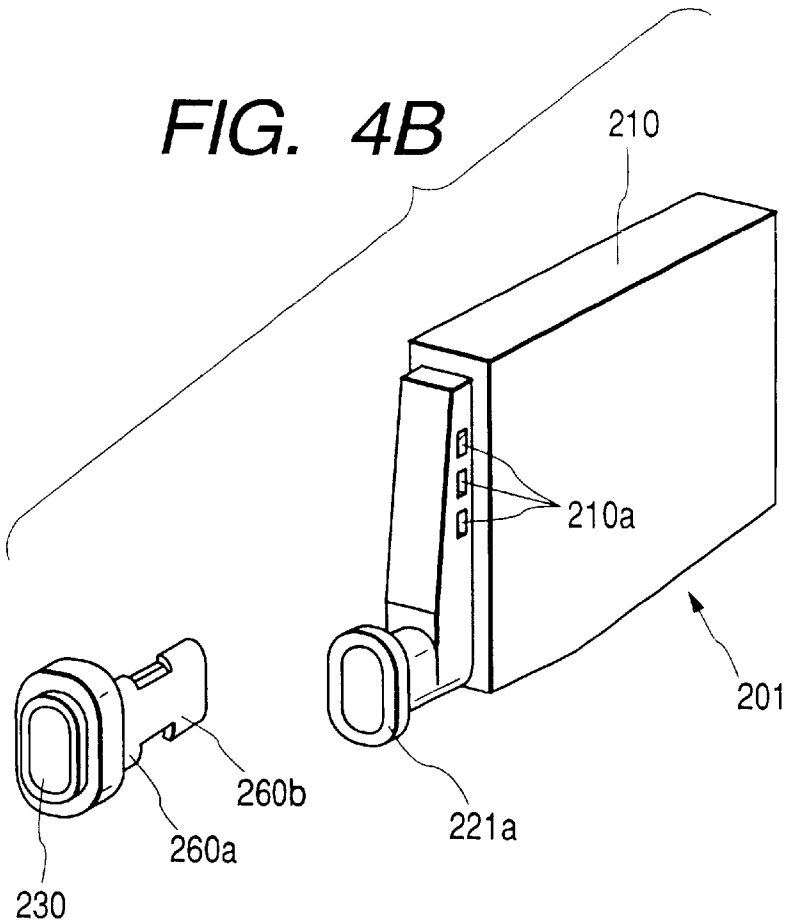
FIGS. 4A and 4B are perspective views showing an ink tank unit shown in FIG. 2.
Figure 4A:
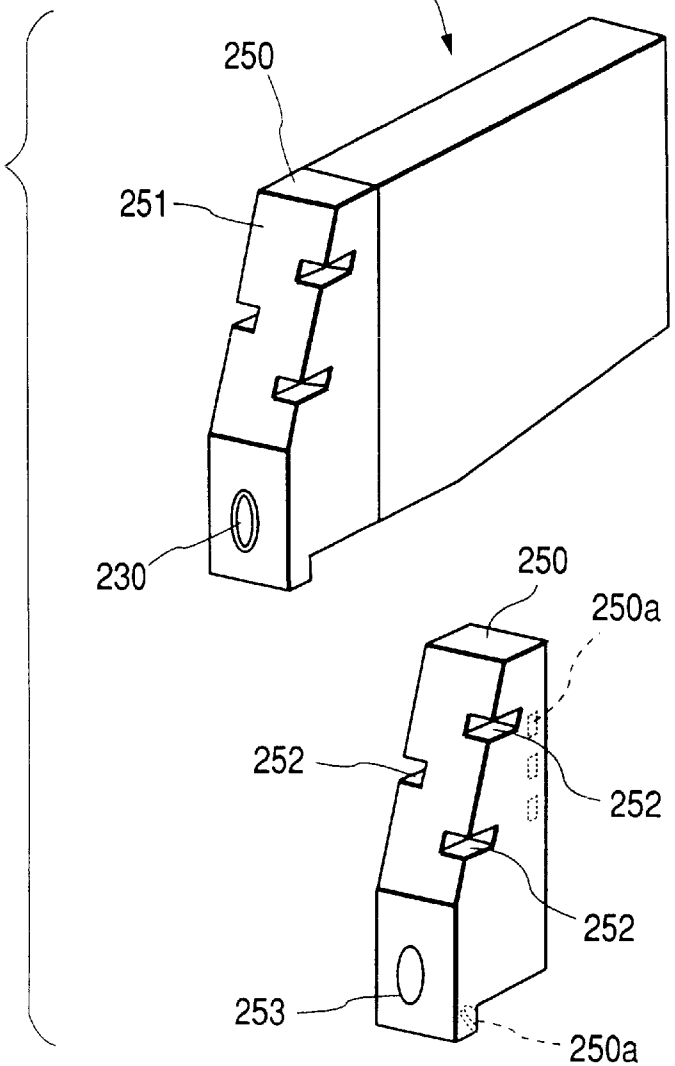

As shown in FIGS. 2, 4A and 4B, the ink tank unit 200 is constituted of the ink container 201, the valve mechanism including the first valve frame 260*a* and second valve frame 260*b*, and an ID member 250. The ID member 250 prevents the incorrect mounting during the assembling of the ink tank unit 200 and negative pressure control chamber unit 100.

The valve mechanism controls the ink flow in the joint port 230, and engages with the joint pipe 180 of the negative pressure control chamber unit 100 to perform an opening/closing operation. The twist of the opened/closed valve during attachment/detachment is prevented by the valve constitution described later, a structure in which the ID member 170 and an ID recess 252 regulate the tank operation range, and the like.

Ink Tank Unit

FIGS. 4A and 4B are perspective views of the ink tank unit 200 shown in FIG. 2. FIG. 4A is a perspective view of the ink tank unit 200, and FIG. 4B is a perspective view showing the ink tank unit 200 in an exploded state.

Moreover, in the front surface of the ID member 250 on the side of the negative pressure control chamber unit 100, the part above a supply hole 253 forms an inclined surface 251. The inclined surface 251 is inclined toward the ink container 201 from the front end surface of the ID member 250 on the side of the supply hole 253, that is, rearward. This inclined surface 251 is provided with a plurality (three in FIGS. 4A and 4B) of ID recesses 252 for preventing the incorrect insertion of the ink tank unit 200. In the present embodiment, the ID member 250 is disposed on the front surface (the surface provided with the supply port) of the ink container 201 on the side of the negative pressure control chamber unit 100.

The ink container 201 is a substantially polygonal hollow container provided with a negative pressure generating function. The ink container 201 is constituted of a housing 210 and an inner bag 220, and the housing 210 and inner bag 220 (see FIG. 2) are strippable. The inner bag 220 has a flexibility, and this inner bag 220 can be deformed while the contained ink is introduced to the outside. Moreover, the inner bag 220 is provided with a pinch off part (welded part) 221, and the inner bag 220 is supported at the pinch off part 221 to engage with the housing 210. Moreover, an outside air communication port 222 is disposed in the vicinity of the pinch off part 221, and the atmosphere can be introduced between the inner bag 220 and the housing 210 through the outside air communication port 222.

Figure 21:
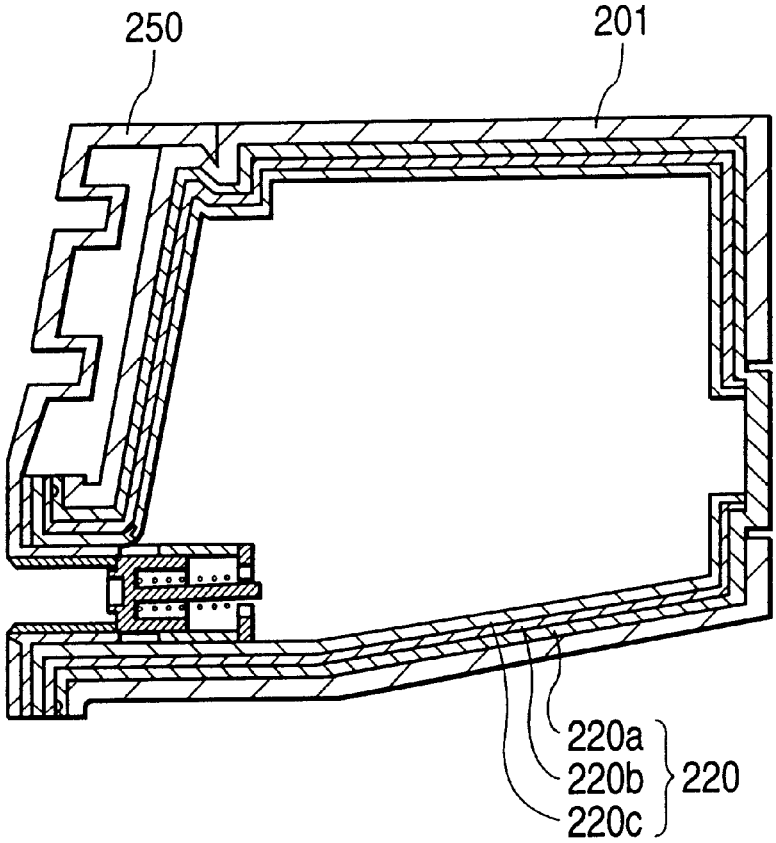
FIG. 21 is a sectional view showing the inner constitution example of an ink container shown in FIG. 2.

As shown in FIG. 21, the inner bag 220 is constituted of three layers by laminating a liquid contact layer 220*c* provided with the resistance to the ink, an elasticity modulus control layer 220*b*, and a gas barrier layer 220*a* superior in the gas barrier property in order from its inner side, and the respective layers are bonded to one another with the separated functions. For the elasticity modulus control layer 220*b*, the elasticity modulus of the elasticity modulus control layer 220*b* is kept to be substantially constant within the operation temperature range of the ink container 201. Specifically, the elasticity modulus of the inner bag 220 is kept to be substantially constant by the elasticity modulus control layer 220*b* within the operation temperature range of the ink container 201. In the inner bag 220, the middle layer may be replaced with the outer layer, the elasticity modulus control layer 220*b* may be used as the outermost layer, and the gas barrier layer 220*a* may be used as the middle layer.

Since the inner bag 220 is constituted in this manner, the inner bag 220 can sufficiently fulfill the respective layer functions with a small number of layers, that is, the ink resistant layer, elasticity modulus control layer 220*b* and gas barrier layer 220*a*, and the influence of the elasticity modulus of the inner bag 220 on the temperature change is reduced. Moreover, in the inner bag 220, since the elasticity modulus suitable for controlling the negative pressure in the ink container 201 is secured within the operation temperature range, the inner bag 220 has a buffer function as described later with respect to the ink in the ink container 201 and negative pressure control chamber unit 100 (described later in detail). Therefore, since the buffer chamber disposed in the upper part of the negative pressure control chamber container 110, that is, the part unfilled with the ink absorber and the area with no ink in the absorbers 130, 140 can be reduced, the negative pressure control chamber unit 100 can be miniaturized, and an ink jet head cartridge 70 high in use efficiency is realized.

In the present embodiment, polypropylene is used as the material of the innermost liquid contact layer 220*c* constituting the inner bag 220, annular olefin copolymer is used as the material of the middle elasticity modulus control layer 220*b*, and the saponified material (EVOH) of ethylene-vinyl acetate copolymer (EVA) is used as the material of the outermost gas barrier layer 220*a*. Here, when the elasticity modulus control layer 220*b* contains a functional adhesive resin material, no adhesive layer needs to be particularly disposed between the layers, and the thickness of the inner bag 220 can preferably be reduced.

Polypropylene is used as the material of the housing 210 in the same manner as the innermost layer of the inner bag 220. Moreover, polypropylene is also used as the material of the first valve frame 260*a*.

The ID member 250 includes a plurality of ID recesses 252 disposed opposite to a plurality of ID members 170 for preventing the incorrect mounting of the ink tank unit 200 on both sides, and is fixed to the ink container 201.

For the incorrect mounting preventing function obtained by the ID member 170 and ID recess 252, an incorrect mounting preventing mechanism is constituted by forming the ID recesses 252 in the ID member 250 opposite to a plurality of ID members 170 disposed on the side of the negative pressure control chamber unit 100, and various types of ID functions can therefore be fulfilled by changing the shapes and positions of the ID members 170 and ID recesses 252.

The joint port 230 of the ID recess 252 and first valve frame 260*a* of the ID member 250 is positioned on the front surface of the ink tank unit 200 in front of the attachment/detachment direction of the ink tank unit 200, and is formed by two members, that is, the ID member 250 and first valve frame 260*a*.

Moreover, the valve member and ID recess 252 can precisely be molded by forming the ink container 201 by blow molding, forming the ID member 250 and first valve frame 260*a* by injection molding, and constituting the ink tank unit 200 by three members.

When the ID recess 252 is directly formed in the ink container 201 as the blow tank formed by the blow molding, the stripping of the inner bag 220 as the inner layer of the ink container 201 is influenced. Specifically, since the ink tank inner shape is complicated, the negative pressure generated in the ink tank unit 200 is influenced in some cases. However, as in the constitution of the ink tank unit 200 in the present embodiment, by forming the ID part, that is, the ID member 250 as the member separate from the ink container 201, the above-described influence on the ink container 201 by the ID member 250 attached to the ink container 201 is eliminated, and the negative pressure can stably be generated and controlled in the ink container 201.

The first valve frame 260*a* is bonded both to the housing 210 and inner bag 220 of the ink container 201. The first valve frame 260*a* is bonded to the inner bag 220 by welding an inner bag exposed part 221*a* of the inner bag 220 as the ink introducing part of the ink container 201 to the opposite surface of the part of the joint port 230. Here, since the housing 210 is also polypropylene in the same manner as the innermost layer of the inner bag 220, the first valve frame 260*a* can be welded to the housing 210 even in the periphery of the joint port 230.

This enhances the position precision by the welding, the supply port part of the ink container 201 is completely sealed, and the ink leakage from the sealed part of the first valve frame 260*a* and ink container 201 is prevented during the attachment/detachment of the ink tank unit 200. As in the ink tank unit 200 of the present embodiment, during the bonding by the welding, the material of the layer as the bonding surface of the inner bag 220 is preferably the same as the material of the first valve frame 260*a* in order to enhance the sealing property.

Moreover, in the bonding of the housing 210 to the ID member 250, when the surface of the first valve frame 260*a* opposite to a sealed surface 102 bonded to the ink container 201 is joined to a click part 250*a* formed in the lower part of the ID member 250, and an engagement part 210*a* of the side surface of the housing 210 is joined to the click part 250*a* on the side of the ID member 250, the ID member is joined/fixed to the ink container 201.

In the joining/fixing herein, the structure is preferably provided with the easy disassembly property, for example, by the engagement by the recess/protrusion, nesting, and the like. Since the ID member 250 is joined/fixed to the ink container 201 in this manner, both can slightly move, so that the force by the contact of the ID member 170 with the ID recess 252 during the attachment/detachment can be absorbed, and the ink tank unit 200 and negative pressure control chamber unit 100 can be prevented from being broken.

Moreover, since the ID member 250 is partially joined/fixed to the ink container 201 in this manner, the ink tank unit 200 can easily be disassembled, which is effective from the viewpoint of recycling. Furthermore, since the side surface of the housing 210 is provided with the engagement part 210*a* as the engaging recess part, the constitution is simplified during the forming of the ink container 201 by the blow molding, a mold member is also simplified during the molding, and the film thickness can easily be managed.

Furthermore, the housing 210 is bonded to the ID member 250 while the first valve frame 260*a* is bonded to the housing 210, and in the periphery of the joint port 230, the first valve frame 260*a* is held and the click part 250*a* is joined to the engagement part 210*a*, so that the strength of the ink tank unit 200, particularly the joint part during the attachment/detachment can be enhanced.

Moreover, since the part of the ink container 201 covered with the ID member 250 has a recessed shape, and the supply port is protruded, no protruded shape is formed on the front surface of the ink tank unit 200 by fixing the ID member 250 to the ink container 201. Moreover, the relation of the recess/protrusion between the engagement part 210*a* of the housing 210 and the opposite click part 250*a* of the ID member 250 may be reversed.

Furthermore, the position of the ink container 201 and ID member 250 in the vertical/lateral direction can be regulated. The method of bonding the ink container 201 to the ID member 250 is not limited to the above-described form, and the engagement position and fixing method can be realized by other means.

Figure 24:
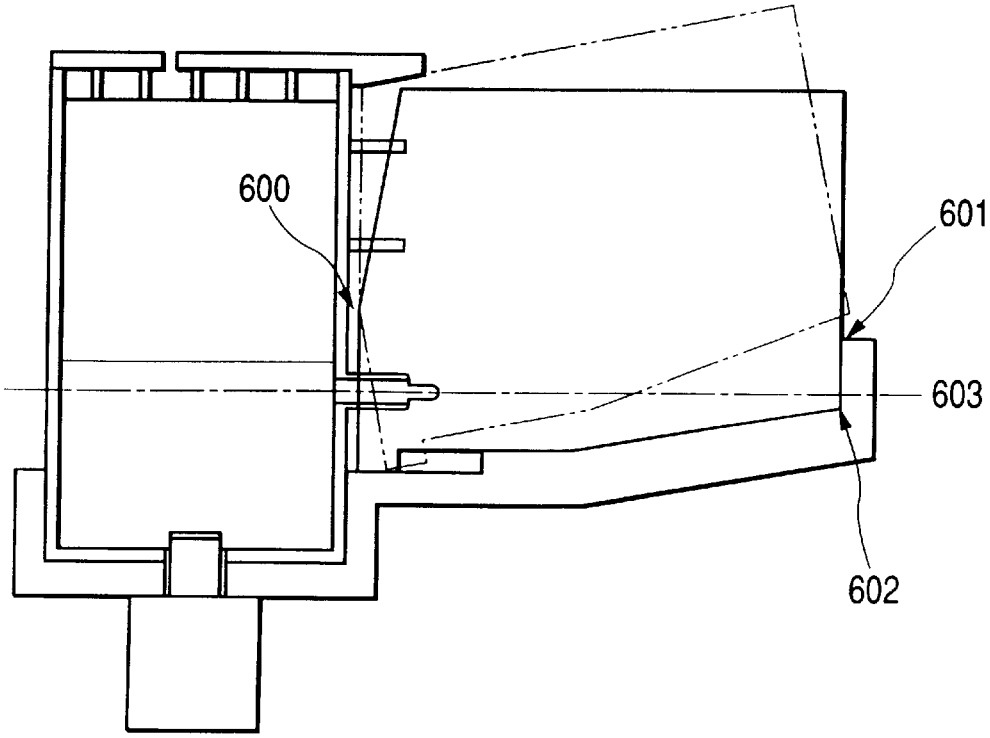
FIG. 24 is an explanatory view showing an attaching/detaching operation by the rotation of the ink tank unit shown in FIG. 2.

As shown in FIGS. 2 and 24, the bottom part of the ink container 201 is inclined in an upward lifting direction, and the lower part of the ink container 201 opposite the joint port 230 engages with the ink tank engagement part 155 of the holder 150. When the ink tank unit 200 is detached from the holder 150, the engagement part of the ink container 201 with the ink tank engagement part 155 is lifted upward, and the ink tank unit 200 substantially rotates during the attaching/detaching operation of the ink tank unit 200. In the present embodiment, this rotation center substantially corresponds to the supply port (joint port 230). Strictly speaking, the rotation center changes as described later. During the attaching/detaching operation of the ink tank unit 200 by the substantial rotation, in the relation between the distance from the rotation support point to the corner part of the ink tank unit 200 on the side of the ink tank engagement part 155 and the distance from the support point to the ink tank engagement part 155, when the former is longer than the latter, a twist is generated between the ink tank unit 200 and the ink tank engagement part 155, and an unnecessary force in the mounting operation, the deformation of the pressing parts of the ink tank unit 200 and holder 150, and other disadvantages occur in some cases.

As in the ink container 201 of present embodiment, since the bottom surface is inclined, and the lower end of the ink container 201 on the side of the ink tank engagement part 155 is lifted up, the unnecessary twist in the rotation of the ink tank unit 200 can be prevented at the engagement parts of the ink tank unit 200 and holder 150, so that the attaching/detaching operation of the ink tank unit 200 can satisfactorily be performed.

In the ink jet head cartridge of the present embodiment, the joint port 230 is formed in the lower part of one side surface of the ink container 201 on the side of the negative pressure control chamber unit 100, and the lower part of the other side surface of the ink container 201 opposite the side of the joint port 230, that is, the lower part of the rear end engages with the ink tank engagement part 155. Moreover, the upper part of the ink tank engagement part 155 is extended upward from the bottom of the holder 150 to substantially the same height as a center height 603 of the joint port 230. Therefore, the movement of the joint port 230 in the horizontal direction is securely regulated by the ink tank engagement part 155, and the connection state of the joint port 230 to the joint pipe 180 can satisfactorily be held. Here, in order to securely hold the connection of the joint port 230 to the joint pipe 180 during the mounting of the ink tank unit 200, the upper end of the ink tank engagement part 155 is disposed at substantially the same height as that of the upper part of the joint port 230. Moreover, by the rotating operation of the ink tank unit 200 centering on a part of the front surface on the side of the joint port 230, the unit is detachably attached to the holder 150. In the attaching/detaching operation of the ink tank unit 200, the part of the ink tank unit 200 abutting on the negative pressure control chamber unit 100 corresponds to the rotation center of the ink tank unit 200. In the ink jet head cartridge, since the bottom of the rear end of the ink container 201 is inclined as described above, a difference between the distance from a rotation center 600 to an ink tank engagement part upper end 601 and the distance from the rotation center 600 to an ink tank engagement lower end 602 can be reduced, so that the unnecessary twist in the rotation of the ink tank unit 200 can be prevented at the engagement parts of the ink tank unit 200 and holder 150, and the attaching/detaching operation of the ink tank unit 200 can satisfactorily be performed.

Since the ink container 201 and holder 150 are formed in the above-described shapes, even with the enlarged size of the joint port 230 for the high-speed ink supply, the twist area of the rear lower end of the ink container 201 with the ink tank engagement part 155 can be decreased during the attaching/detaching operation of the ink tank unit 200. Therefore, the fixing property is secured during the mounting of the ink tank unit 200 on the holder 150, and the unnecessary twist with the ink tank engagement part 155 can be avoided during the mounting of the ink tank unit 200.

Here, this will be described in more detail with reference to FIG. 24. When the distance from the rotation center 600 to the ink tank engagement part lower end 602 of the ink tank unit 200 is unnecessarily longer than the distance from the rotation center 600 to the ink tank engagement part upper end 601 in the attaching/detaching operation of the ink tank unit 200, the force necessary for the attaching/detaching operation becomes very strong, the ink tank engagement part upper end 601 is cut, and the ink container 201 is deformed in some cases. Therefore, the difference between the distance from the rotation center 600 of the ink tank unit 200 to the ink tank engagement part lower end 602 of the ink tank unit 200 and the distance from the rotation center 600 to the ink tank engagement part upper end 601 is preferably minimized to such an extent that an adequate fixing force is exerted and that an excellent attachment/detachment property is provided.

Moreover, when the rotation center 600 of the ink tank unit 200 is positioned below the center of the joint port 230, the distance from the rotation center 600 of the ink tank unit 200 to the ink tank engagement part upper end 601 is longer than the distance from the rotation center 600 to the ink tank engagement part lower end 602, and the ink container 201 cannot accurately or easily be depressed at the center height of the joint port 230. Therefore, in order to accurately fix the center of the joint port 230 in the height direction, the rotation center 600 of the ink tank unit 200 is preferably positioned above the center of the joint port 230 in the height direction.

Moreover, when the rotation center 600 of the ink tank unit 200 is lifted upward from the center height 603 of the joint port 230, the part of the ink tank unit 200 abutting on the ink tank engagement part 155 is thickened, the part abutting on the ink tank engagement part 155 increases, and a possibility of breakage of the ink tank unit 200 and holder 150 increases. Therefore, it is preferable from the viewpoint of the attachment/detachment property of the ink tank unit 200 that the rotation center 600 of the ink tank unit 200 be close to the center of the joint port 230 in the height direction. Moreover, the height of the ink tank engagement part 155 of the ink tank unit 200 may appropriately be determined based on the attachment/detachment property of the ink tank unit 200. However, when the part is higher than the rotation center 600, the contact distance of the engagement part of the ink tank unit 200 with the holder 150 is lengthened, and the rubbing part increases by the attaching/detaching operation. Therefore, in consideration of the deterioration of the ink tank unit 200 and holder 150, the height is preferably lower than the rotation center 600 of the ink tank unit 200.

Moreover, in the ink jet head cartridge of the present embodiment, the urging force for fixing the position of the ink container 201 in the horizontal direction is formed by the urging member 263 for urging the valve body 261 or by the resilience of a rubber joint part 280 (see FIGS. 5A to 5D), but is not limited to this form, and the engagement part may be disposed on the rear end of the ink container 201, or urging means for fixing the position of the ink container 201 in the horizontal direction may be disposed on the surface of the ink tank engagement part 155 on the side of the ink container 201, or on the negative pressure control chamber unit 100. Additionally, when the rubber joint p art 280 is connected to the ink container, the part is pressed/inserted by the wall surfaces of the negative pressure control chamber and ink tank, the hermetic property of the connection part (joint pipe peripheral part) is secured (instead of completing the hermetic property, the area exposed to the atmosphere may be reduced), and additionally the rubber joint part can play an auxiliary sealing role by a sealing protrusion described later.

The inside constitution of the negative pressure control chamber unit 100 will next be described.

The negative pressure control chamber unit 100 contains the negative pressure generating members of the two-stage constitution obtained by laminating the absorber 130 as the upper stage and the absorber 140 as the lower stage. Therefore, the absorber 130 communicates with the atmosphere communication port 115, and the absorber 140 closely abuts on the absorber 130 by its top surface, and closely abuts on the filter 161 by its lower surface. The boundary surface 113*c* of the absorbers 130 and 140 is above the upper end of the joint pipe 180 as the communication part in the posture during the use.

The absorbers 130, 140 are formed of fiber materials with a substantially aligned fiber direction, and the main fiber direction is inclined with respect to the vertical direction (more preferably in the substantially horizontal direction as in the present embodiment) while the ink jet head cartridge 70 is mounted on a printer. In this manner, the absorbers are contained in the negative pressure control chamber container 110.

The absorbers 130, 140 with the aligned fiber directions are manufactured, for example, by using a short crimped fiber of thermoplastic resin as the fiber (having a length of about 60 mm, and constituted, for example, by a mixed fiber of polypropylene, polyethylene, and the like), properly arranging the fiber direction of a short fiber lump with a worsted cotton machine, heating the lump (the heating temperature is preferably higher than the melting point of polyethylene with a relatively low melting point and lower than the melting point of polypropylene with a relatively high melting point), and cutting the lump into a desired length. Here, for the fiber member of the present embodiment, the fiber direction of the surface layer is more properly arranged than that of the middle part, the generated capillary force is also larger than that of the middle part, but the surface is not mirror-shaped and is provided with slight irregularities generated mainly during the bundling of a sliver, and fused intersection points are disposed in a three-dimensional manner even in the surface layer. Therefore, when the surfaces provided with the irregularities contact each other, in the boundary surface 113*c* of the absorbers 130, 140 with the aligned fiber direction together with the surface layer areas of the respective absorbers 130, 140 in the vicinity, the ink entirely has an appropriate fluidity with respect to the horizontal direction. Specifically, only the boundary surface 113*c* is remarkably superior to the peripheral area in the ink fluidity, and as a result, no ink path is made between the gap of the negative pressure control chamber container 110 from the absorbers 130, 140 and the boundary surface 113*c*. Therefore, by disposing the boundary surface 113*c* of the absorbers 130, 140 on the upper part of the joint pipe 180 in the posture during the use, preferably in the vicinity of the upper part of the joint pipe 180 as in the present embodiment, the interface of the ink and gas in the absorbers 130, 140 during the gas-liquid exchange operation can be used as the boundary surface 113*c*, and as a result a static negative pressure in the head part during the ink supply operation can be stabilized.

Figure 22:
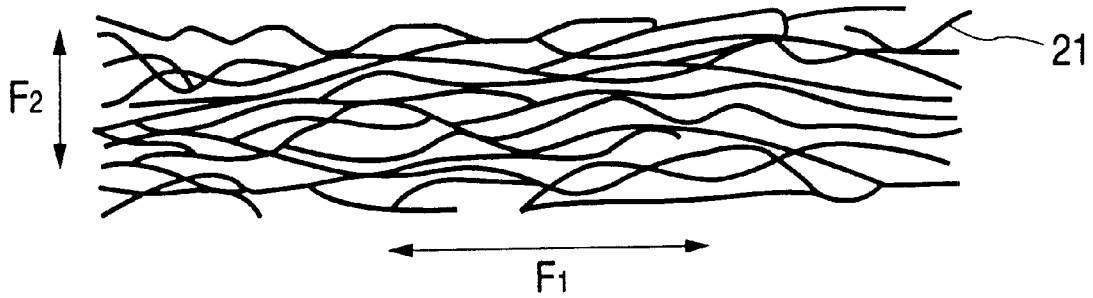
FIG. 22 is an explanatory view of an absorber in a negative pressure control chamber container shown in FIG. 2.

Moreover, when attention is given to the directional property of the fiber member, as shown in FIG. 22, the respective fibers are continuously arranged in a longitudinal direction F1 arranged mainly with the worsted cotton machine, and are interconnected in a direction F2 crossing at right angles to the longitudinal direction by fusing some of the intersection points among the fibers by the thermal molding. Therefore, the absorbers 130, 140 are not easily collapsed even when pulled in the direction F1 in FIG. 22. When the absorbers are pulled in the direction F2 in FIG. 22, the connection parts among the fibers are broken, and the separation is more easily performed than in the direction F1.

In the absorbers 130, 140 formed of the fibers, the above-described main fiber direction F1 is present, and the ink fluidity and the method of holding the stationary state differ in the main fiber direction F1 and the fiber direction F2 crossing at right angles to the direction F1.

Figure 23A:
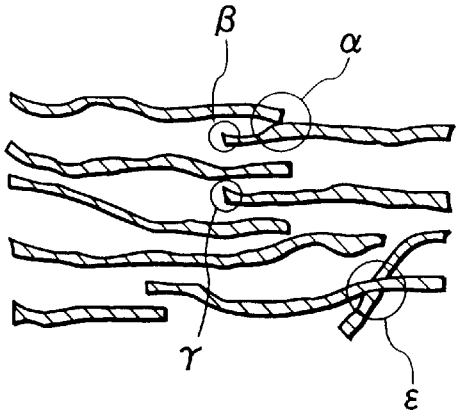
FIGS. 23A and 23B are explanatory views of the absorber in the negative pressure control chamber container shown in FIG. 2.
Figure 23B:
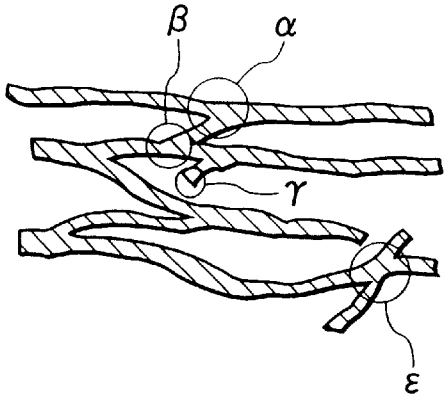

The inner structures of the absorbers 130, 140 will further be described. When the crimped short fiber shown in FIG. 23A is heated in the fiber direction aligned to a certain degree, the state shown in FIG. 23B is obtained. Here, in an area α in which a plurality of short fibers are overlapped in the fiber direction in FIG. 23A, there is a high probability that the intersection points are fused as shown in FIG. 23B, and as a result, the continuous fiber which is not easily cut with respect to the direction F1 shown in FIG. 22 is formed in the fiber direction. Moreover, when the crimped short fiber is used, in the end area (β, γ shown in FIG. 23A), the short fiber is fused with the other short fiber (β) in a three-dimensional manner as shown in FIG. 23B, or remains as the end (γ). Additionally, since all the fibers are incompletely aligned in the same direction, the short fiber (ϵ shown in FIG. 23A) originally inclined to intersect and contact the other short fiber is fused as it is after the heating (ϵ shown in FIG. 23B). In this manner, the fiber higher in strength than the conventional one-directional fiber bundle is formed even in the direction F2.

Figure 7:
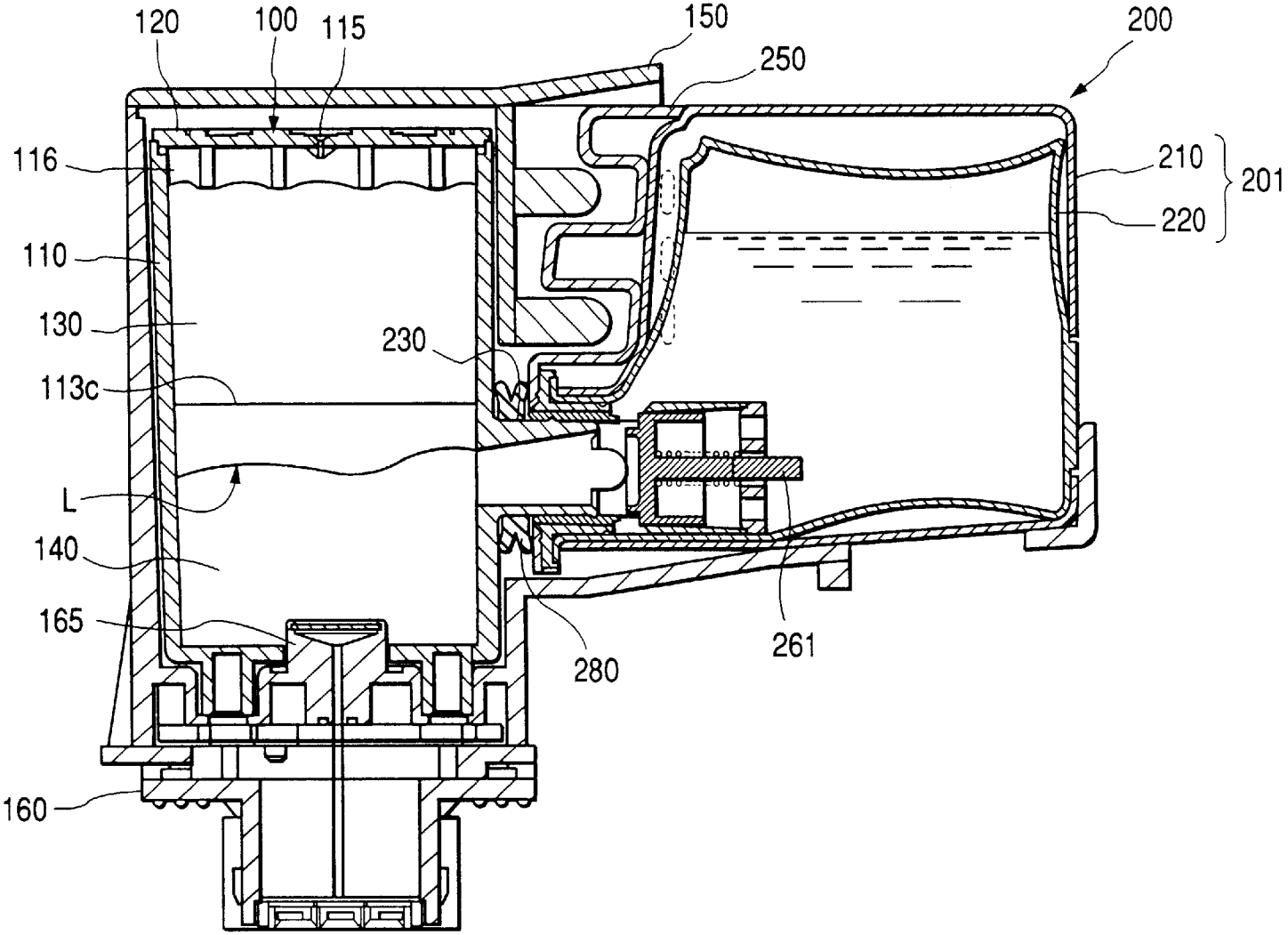
FIG. 7 is a sectional view showing an ink supply operation in the ink jet head cartridge shown in FIG. 2.

Moreover, in the present embodiment, the absorbers 130, 140 are arranged so that the main fiber direction F1 becomes substantially horizontal and becomes substantially parallel to the direction to the ink supply port from the communication part. Therefore, as shown in FIG. 7, while the ink container 201 is connected, a gas-liquid interface L (the ink-gas interface) in the absorber 140 becomes parallel to the main fiber direction F1 and substantially horizontal. Even when a fluctuation occurs by an environmental change, the gas-liquid interface maintains its substantially horizontal direction. Therefore, when the environmental fluctuation is settled, the gas-liquid interface returns to the original position of the gas-liquid interface L, and the dispersion of the gas-liquid interface with respect to a gravity direction is prevented from increasing in accordance with the cycle number of the environmental change.

As a result, when the ink in the ink container 201 is used up, and the ink tank unit 200 is replaced with the new one, the gas-liquid interface keeps its substantially horizontal direction. Therefore, even when the replacement frequency of the ink tank unit 200 increases, the buffer space 116 fails to decrease.

In order to stabilize the position of the gas-liquid interface L during the gas-liquid exchange operation regardless of the environmental change, in the upper end area of the communication part (the joint pipe 180 in the present embodiment) as the connection part, more preferably, in the area including the space above the upper end, the layer containing the main fiber arrangement components may be disposed in the substantially horizontal direction. From another viewpoint, this layer may be disposed in the area for connecting the supply port 131 to the upper end of the communication part, and from further viewpoint, this area may be positioned on the gas-liquid interface in the gas-liquid exchange operation. When the action of the latter is considered, the fiber layer provided with the directional property of the arrangement levels the gas-liquid interface in the absorber 140 in the liquid supply operation by the gas-liquid exchange, and regulates the change of the absorber 140 in the vertical direction with the liquid movement from the ink container 201.

When the absorber 140 contains this layer, the gas-liquid interface L can depress the dispersion with respect to the gravity direction in this area. In this case, when the main fiber arrangement component is substantially parallel even to the longitudinal direction in the cut surface of the absorber 140 in the horizontal direction, the longitudinal direction of the fiber can preferably effectively be utilized.

Additionally, when the fiber arrangement direction is even slightly inclined from the vertical direction, in theory the above-described effect is slightly produced, but in practice the clear effect can be confirmed within a range of about ±30° with respect to the horizontal direction. Therefore, the "substantially" horizontal direction includes the above-described inclination in the present specification.

In the present embodiment, also for the area below the upper end of the communication part, the arrangement component of the main fiber direction is constituted of the same absorber 140 in the same manner. Therefore, in the gas-liquid exchange operation as shown in FIG. 7, since the gas-liquid interface L fails to be inadvertently dispersed in the area below the upper end of the communication part, the ink supply defect by the ink shortage fails to occur.

Specifically, in the gas-liquid exchange operation, upon reaching the gas-liquid interface L, the atmosphere introduced from the atmosphere communication port 115 is dispersed along the main fiber direction. As a result, the interface during the gas-liquid exchange operation is kept in the substantially horizontal direction, and can be stabilized. This results in an effect that the ink can more securely be supplied while the stable negative pressure is maintained. Moreover, for the gas-liquid exchange operation, in the present embodiment, since the main fiber direction corresponds to the substantially horizontal direction, the ink is substantially equally consumed in the horizontal direction. As a result, also for the ink of the negative pressure control chamber container 110, the ink supply system with little residual ink can be provided. Therefore, particularly in the system in which the ink tank unit 200 for directly containing the liquid is replaceable as in the present embodiment, the area where no ink is held can effectively be produced in the absorbers 130, 140, the buffer space efficiency is enhanced, and the ink supply system strong against the environmental fluctuation can be provided.

Moreover, when the ink jet head cartridge of the present embodiment is mounted on a so-called serial type printer, the cartridge is mounted on a reciprocating scanned carriage. In this case, with the reciprocating operation of the carriage, the force of a carriage movement direction component acts on the ink in the ink jet head cartridge. In order to minimize the adverse influence of this force on the ink supply property to the ink jet head unit 160 from the ink tank unit 200, the fiber direction of the absorbers 130, 140 and the arrangement direction of the ink tank unit 200 with the negative pressure control chamber unit 100 are preferably directed toward the supply port 131 of the negative pressure control chamber container 110 from the joint port 230 of the ink tank unit 200.

<Tank Mounting Operation>

An operation of mounting the ink tank unit 200 on the integral structure of the negative pressure control chamber unit 100 and holder 150 will next be described with reference to FIGS. 5A to 5D.

FIGS. 5A to 5D are sectional views showing the operation of mounting the ink tank unit 200 on the holder 150 attached to the negative pressure control chamber unit 100. The ink tank unit 200 is substantially rotated and mounted in the direction of arrows F and G along a width-direction guide (not shown), a bottom 151 of the holder 150, a guide part 121 disposed on the negative pressure control chamber lid 120 of the negative pressure control chamber unit 100, and the ink tank engagement part 155 of the rear part of the holder 150.

Figure 5A:
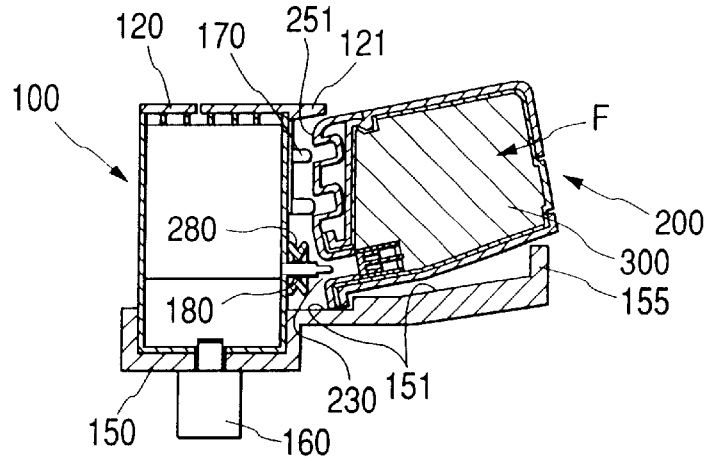
FIGS. 5A, 5B, 5C and 5D are sectional views showing an operation of mounting the ink tank unit on a holder to which a negative pressure control chamber unit of FIG. 2 is attached.

First, as the mounting operation of the ink tank unit 200, the ink tank unit 200 is moved to the position shown in FIG. 5A, that is, the position where the inclined surface 251 of the ink tank unit 200 contacts the ID member 170, disposed on the negative pressure control chamber unit 100, for preventing the incorrect insertion of the ink tank unit. At this time, the joint port 230 is constituted not to contact the joint pipe 180. At this time, if the incorrect ink tank unit 200 is mounted, the inclined surface 251 interferes with the ID member 170, and the subsequent mounting operation of the ink tank unit 200 is inhibited. Since the ink jet head cartridge 70 is constituted in this manner, and the joint port 230 is constituted not to contact the joint pipe 180 as described above, it is possible to beforehand prevent the unnecessary replacement of the head and ink tank in the ink tank replaceable type device by ink color mixture at the joint part during the incorrect mounting or the ink retention (depending on the ink component (e.g., reaction of anion and cation) the retention occurs in the absorbers 130, 140 and it becomes impossible to use the negative pressure control chamber unit 100 in some cases). Moreover, when the ID part of the ID member 250 is formed on the inclined surface as described above, by inserting a plurality of ID members 170 into the ID recesses opposite to the respective ID members 170 substantially simultaneously, the ID members 170 can be confirmed, and the secure incorrect mounting preventing function can be achieved.

Figure 5B:
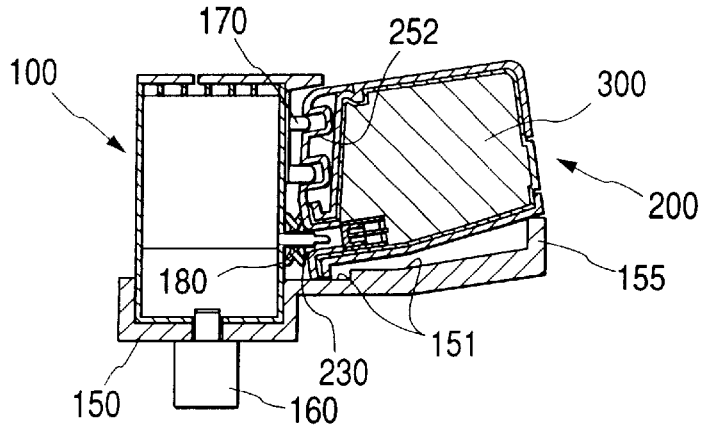
Figure 5C:
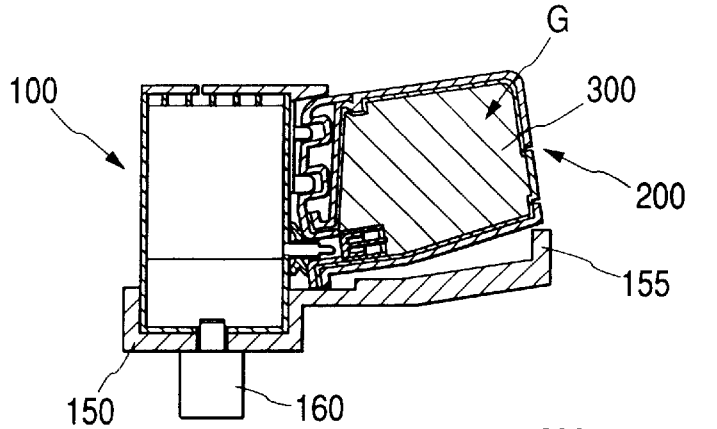

Subsequently, as shown in FIG. 5B, the ID member 170 is inserted into the ID recess 252, and the ink tank unit 200 is moved toward the negative pressure control chamber unit 100 so that the joint pipe 180 is inserted into the joint port 230. Moreover, since the ink tank unit 200 mounted on a predetermined position is disposed in the position shown in FIG. 5C, that is, the position where the ID members 170 face the ID recesses 252, the ink tank unit 200 is further moved to the depth on the side of the negative pressure control chamber unit 100. Furthermore, when the ink tank unit 200 is rotated in the direction of the arrow G, the tip end of the joint pipe 180 abuts on the valve body 261 to press the valve body 261. Therefore, the valve mechanism opens to connect the ink tank unit 200 to the negative pressure control chamber unit 100, an ink 300 in the ink tank unit 200 can be supplied into the negative pressure control chamber unit 100. The opening/closing operation of the valve mechanism will be described later in detail.

Thereafter, the ink tank unit 200 is further rotated in the direction of the arrow G, and pressed into the position shown in FIG. 2. Thereby, the rear lower part of the ink tank unit 200 engages with the ink tank engagement part 155 of the holder 150, and the ink tank unit 200 is fixed to the desired position in the holder 150. In this state, the ID member 170 is slightly moved apart from the ID recess 252. The rearward urging force (on the side of the ink tank engagement part 155) for fixing the ink tank unit 200 is given by the urging member 263 in the ink tank unit 200 and the seal member disposed in the periphery of the rubber joint part 280.

In the ink tank unit 200 attached/detached with the above-described rotating operation, since the ID recess 252 is formed in the inclined surface 251, and the lower surface of the ink tank unit 200 is inclined, the secure attachment/detachment of the ink tank unit 200 without any incorrect mounting or any ink mixed color is possible in a minimum space.

Figure 5D:
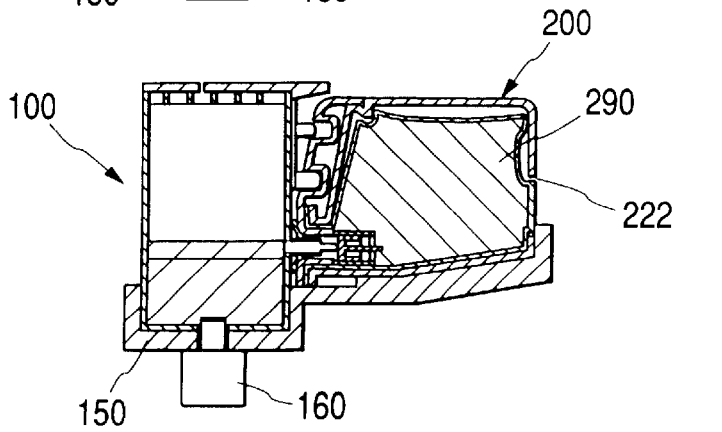

When the ink tank unit 200 is connected to the negative pressure control chamber unit 100 in this manner, the ink moves, until the pressure in the negative pressure control chamber unit 100 equals the pressure in the ink container 201. As shown in FIG. 5D, the pressure in the joint pipe 180 and joint port 230 becomes negative and is equilibrated (this state is referred to as the use start state). The ink movement for obtaining this equilibrated state will next be described in detail.

When the ink tank unit 200 is mounted and the valve mechanism disposed in the joint port 230 of the ink container 201 opens, the ink containing part is placed in the substantially closed state excluding the joint port 230. Then, the ink in the ink container 201 flows into the joint port 230 and an ink path is formed with the absorber 140 of the negative pressure control chamber unit 100. When the ink path is formed, the ink movement to the absorber 140 from the ink container 201 starts by the capillary force of the absorber 140, and as a result, the ink interface in the absorber 140 rises. Moreover, the inner bag 220 starts to be deformed from the middle part of the surface with the maximum area in a direction in which the volume of the inner bag 220 decreases.

Here, since the housing 210 functions to inhibit the displacement of the corner of the inner bag 220, the action force of deformation by the ink consumption and the action force to return to the shape of the state before the mounting (the initial state shown in FIGS. 5A to 5C of the present embodiment) are exerted to the inner bag 220, and the negative pressure is generated in accordance with the degree of the deformation without any rapid change. Since the space between the housing 210 and the inner bag 220 communicates with the outside air via the outside air communication port 222, the air is introduced between the housing 210 and the inner bag 220 in accordance with the above-described deformation.

Additionally, even when the air is present in the joint port 230 and joint pipe 180, the ink in the ink container 201 contacts the absorber 140, the ink path is formed, with the introduction of the ink the inner bag 220 is deformed, and the air can easily move into the inner bag 220.

The ink movement is performed until the static negative pressure in the joint port 230 of the ink container 201 equals the static negative pressure in the joint pipe 180 of the negative pressure control chamber unit 100.

As described above, in the connection of the ink container 201 to the negative pressure control chamber unit 100 the ink movement to the negative pressure control chamber unit 100 from the ink container 201 is performed without introducing any gas into the ink container 201 via the absorbers 130, 140. In the equilibrium state the static negative pressures of the respective chambers may be set to appropriate values in accordance with the type of liquid discharge recording means to be connected so that no ink leaks from the liquid discharge recording means such as the ink jet head unit 160 connected to the ink supply port of the negative pressure control chamber unit 100.

Moreover, since there is a dispersion in the amount of the ink held by the absorber 130 before the connection, even in the equilibrium state, the area unfilled with the ink remains in the absorber 140. This area can be utilized as a buffer area.

Conversely, when there is a probability that the pressure in the joint pipe 180 and joint port 230 having reached the equilibrium state becomes positive by the influence of the dispersion amount, the suction recovery may be performed by the suction recovery means disposed on a liquid discharge recording device main body as described later to discharge a slight amount of ink.

As described above, the ink tank unit 200 of the present embodiment is mounted on the holder 150 with the substantial rotating operation of laying the outer bottom surface on the ink tank engagement part 155 of the holder 150, obliquely inserting the unit until the ink tank engagement part 155 is ridden over, and pushing the unit to the bottom surface of the holder. Moreover, by the reverse operation, the ink tank unit 200 is detached from the holder 150. Furthermore, with the attaching/detaching operation of the ink tank unit 200, the opening/closing operation of the valve mechanism disposed on the ink tank unit 200 is performed.

<Opening/Closing Operation of Valve Mechanism>

Figure 6A:
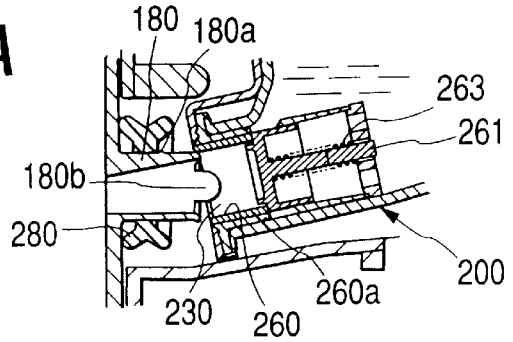
FIGS. 6A, 6B, 6C, 6D and 6E are sectional views showing the opening/closing operation of a valve mechanism which can be applied to the present invention.

The opening/closing operation of the valve mechanism will be described hereinafter with reference to FIGS. 6A to 6E. FIG. 6A shows that the ink tank unit 200 is obliquely inserted into the holder 150 with the joint port 230 facing obliquely downward immediately before the joint pipe 180 is inserted into the joint port 230.

Here, a sealing protrusion 180*a* is integrally disposed on the entire outer peripheral surface of the joint pipe 180, and a valve opening/closing protrusion 180*b* is disposed on the tip end. The sealing protrusion 180*a* abuts on a joint seal surface 260 of the joint port 230 when the joint pipe 180 is inserted into the joint port 230, and is obliquely disposed so that the distance from the tip end of the joint pipe 180 on the upper end is larger than that on the lower end.

Since the sealing protrusion 180*a* slides against the joint seal surface 260 as described later during the attaching/detaching operation of the ink tank unit 200, a material excellent in the sliding and adhering properties with the joint seal surface 260 is preferably used. Moreover, the form of the urging member 263 for urging the valve body 261 toward the first valve frame 260*a* is not particularly limited, and spring members such as a coil spring and a leaf spring, materials provided with contraction and expansion properties such as rubber, and the like can be used. Moreover, in consideration of the recycling property, an elastic member formed of a resin is preferable.

In the state shown in FIG. 6A, the valve opening/closing protrusion 180*b* fails to abut on the valve body 261, and the seal part formed on the outer periphery of the end of the valve body 261 on the side of the joint pipe 180 is pressed by the seal part of the first valve frame 260*a* by the urging force of the urging member 263. This maintains the hermetic property of the inside of the ink tank unit 200.

When the ink tank unit 200 is further inserted into the holder 150, the joint seal surface 260 of the joint port 230 is sealed by the sealing protrusion 180*a*. In this case, since the sealing protrusion 180*a* is obliquely disposed as described above, first as shown in FIG. 6B, the lower end of the sealing protrusion 180*a* abuts on the joint seal surface 260, and slides against the joint seal surface 260 with the inserting operation of the ink tank unit 200, the abutment range is gradually widened toward the upper part of the sealing protrusion 180*a*, and the upper end of the sealing protrusion 180*a* finally abuts on the joint seal surface 260 as shown in FIG. 6C. Thereby, the entire periphery of the sealing protrusion 180a abuts on the joint seal surface 260, and the joint port 230 is sealed by the sealing protrusion 180*a*.

Moreover, in the state shown in FIG. 6C, the valve opening/closing protrusion 180*b* fails to abut on the valve body 260, and the valve mechanism fails to open. Therefore, since the joint port 230 is sealed before the opening of the valve mechanism, the ink leakage from the joint port 230 during the attaching/detaching operation of the ink tank unit 200 is prevented.

Furthermore, as described above, the joint port 230 is gradually sealed from the lower side of the joint seal surface 260. Therefore, the air in the joint port 230 is discharged from a gap between the sealing protrusion 180*a* and the joint seal surface 260 until the joint port 230 is sealed by the sealing protrusion 180*a*. By discharging the air from the joint port 230 in this manner, the amount of residual air in the joint port 230 is minimized in the sealed state of the joint port 230, and the excess compression of the air in the joint port 230, that is, the excess rise of the pressure in the joint port 230 is prevented from occurring by the insertion of the joint pipe 180 into the joint port 230. As a result, the inadvertent opening of the valve with the rise of the pressure in the joint port 230 and the flowing of the ink into the joint port 230 can be prevented before the ink tank unit 200 is completely mounted on the holder 150.

Figure 6B:
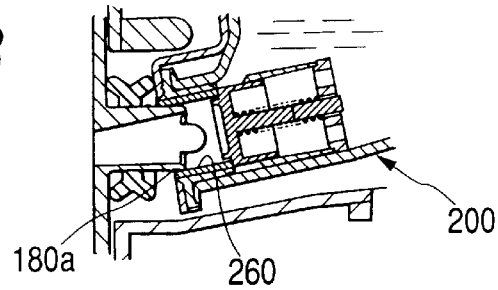
Figure 6C:
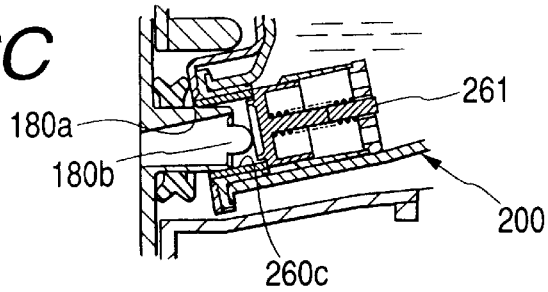
Figure 6D:
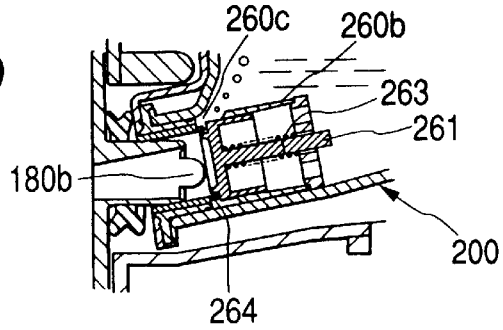

When the ink tank unit 200 is further inserted, as shown in FIG. 6D, the joint port 230 is still sealed by the sealing protrusion 180*a*, and the valve opening/closing protrusion 180*b* pushes the valve body 261 against the urging force of the urging member 263. Therefore, an opening 260*c* of the second valve frame 260*b* communicates with the joint port 230, the air in the joint port 230 is introduced into the ink tank unit 200 through the opening 260*c*, and the ink in the ink tank unit 200 is supplied to the negative pressure control chamber container 110 (see FIG. 2) through the opening 260*c* and joint pipe 180.

The air in the joint port 230 is introduced into the ink tank unit 200 in this manner. Therefore, for example, when the ink tank unit 200 in process of use is again mounted, the negative pressure in the inner bag 220 (see FIG. 2) is moderated. Therefore, the balance of the negative pressures of the negative pressure control chamber container 110 and inner bag 220 is improved, and the re-supply property of the ink to the negative pressure control chamber container 110 can be prevented from being deteriorated.

Figure 6E:
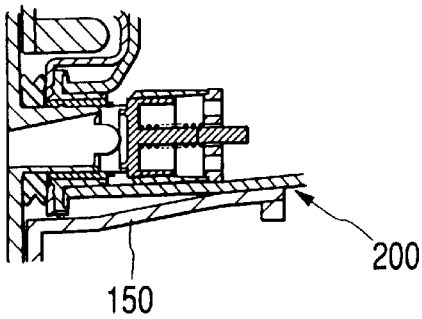

After the above-described operation, the ink tank unit 200 is pushed into the bottom surface of the holder 150. As shown in FIG. 6E, by mounting the ink tank unit 200 on the holder 150, the joint port 230 is completely connected to the joint pipe 180, and the above-described gas-liquid exchange is securely performed.

In the present embodiment, the second valve frame 260*b* is provided with the opening 260*c* on the bottom of the ink tank and in the vicinity of a valve frame seal part 264. According to the constitution of the opening 260*c*, during the opening of the valve mechanism, that is, when the valve body 261 is pressed by the valve opening/closing protrusion 180*b*, immediately after the movement of the valve body toward the valve lid 262 the ink in the ink tank unit 200 starts to be supplied to the negative pressure control chamber unit 100, and the ink is used up, the ink residual amount in the ink tank can be minimized.

Moreover, in the present embodiment, elastomer is used as the joint seal surface 260 of the first valve frame 260*a*, that is, the material constituting the seal part of the first valve frame. By using elastomer as the constituting material, the elastic force of elastomer can secure the certain seal property of the joint pipe 180 with the sealing protrusion 180*a* on the joint seal surface 260, and the secure seal property with the seal part of the valve body 261 in the seal part of the first valve frame 260*a*. Additionally, by providing elastomer with the minimum necessary elastic force to secure the seal property between the first valve frame 260*a* and the joint pipe 180 (e.g., increasing the film thickness of elastomer), during the serial scanning of the ink jet head cartridge the axis deviation and twist of the joint pipe connection place is depressed by the deflection of elastomer, and more reliable seal can be performed. Furthermore, elastomer used as the constituting material can integrally be molded with the first valve frame 260*a*, and the above-described effect can be obtained without increasing the number of components. Moreover, the part in which elastomer is used as the constituting material is not limited to the above-described constitution, and elastomer may be used as the constituting material of the sealing protrusion 180*a* formed on the joint pipe 180, and as the constituting material of the seal part of the valve body 261.

On the other hand, after the ink tank unit 200 is removed from the holder 150, the removing of the seal of the joint port 230 and the operation of the valve mechanism are performed in order reverse to the above-described operation.

Specifically, when the ink tank unit 200 is rotated in a direction opposite to the mounting direction to extract the unit from the holder 150, the valve body 261 first advances by the urging force of the urging member 263, the seal part of the valve body 261 is pressed by the seal part of the first valve frame 260*a*, and the joint port 230 is closed by the valve body 261.

Subsequently, by further extracting the ink tank unit 200, the seal of the joint port 230 by the sealing protrusion 180*a* is removed. Since the seal of the joint port 230 is removed after the closing of the valve mechanism in this manner, the wasteful ink supply to the joint port 230 is prevented.

Furthermore, since the sealing protrusion 180*a* is obliquely disposed as described above, the removal of the seal of the joint port 230 is performed from the upper end of the sealing protrusion 180*a*. The ink remains inside the joint port 230 and joint pipe 180 before the seal of the joint port 230 is removed, but the upper end of the sealing protrusion 180*a* is first opened, and the lower end is still sealed, so that no ink leaks from the joint port 230. Additionally, the inside of the joint port 230 and joint pipe 180 is in a negative pressure state. When the upper end of the sealing protrusion 180*a* is opened, the atmosphere enters the joint port 230, and the ink remaining in the joint port 230 and joint pipe 180 is drawn into the negative pressure control chamber container 110.

When the seal of the joint port 230 is removed in this manner, the upper end of the sealing protrusion 180*a* is first opened, the ink remaining in the joint port 230 is moved to the negative pressure control chamber container 110. In this case, the ink leakage from the joint port 230 is prevented when the ink tank unit 200 is removed from the holder 150.

As described above, according to the connection structure of the ink tank unit 200 and negative pressure control chamber container 110 in the present embodiment, the joint port 230 is sealed before the valve mechanism of the ink tank unit 200 operates, so that the inadvertent ink leakage from the joint port 230 can be prevented. Additionally, during the connection and disconnection of the ink tank unit 200, by making a time difference between the sealing timing and the unsealing timing in the upper and lower parts, the inadvertent operation of the valve body 261 during the connection and the leakage of the ink remaining in the joint port 230 during the disconnection can be prevented.

Moreover, in the present embodiment, since the valve body 261 is disposed inside the opening end of the joint port 230, and the valve body 261 is operated by the valve opening/closing protrusion 180*b* on the tip end of the joint pipe 180, the contamination by the ink adhering to the valve body 261 can be prevented without directly contacting the valve body 261.

<Relation Between Attaching/Detaching Operation of Joint Part and ID>

A relation between the attaching/detaching operation of the joint part and ID will next be described with reference to FIGS. 5A to 5D, and 6A to 6E. FIGS. 5A to 5D and 6A to 6E are diagrams showing the processes of mounting the ink tank unit 200 on the holder 150, FIGS. 5A to 5C and 6A to 6C show the same time, FIGS. 5A to 5D show the ID state, and FIGS. 6A to 6E show the details of the joint part.

First, to obtain the position shown in FIGS. 5A and 6A, that is, the position in which a plurality of ID members 170 for preventing the incorrect insertion of the ink tank unit 200 disposed in the negative pressure control chamber unit 100 contacts the ink tank inclined surface 251, the mounting operation is performed. At this time the joint port 230 is constituted not to contact the joint pipe 180. At this time, if the incorrect ink tank unit is mounted, the inclined surface 251 interferes with the ID member 170, and further mounting operation of the ink tank unit is inhibited. According to the present constitution, since the joint port 230 fails to contact the joint pipe 180 as described above, during the incorrect mounting, the ink mixed color at the joint part, ink retention, non-discharge, image defects, device malfunction and unnecessary head replacement in the ink tank replaceable type device can be prevented beforehand.

Moreover, since the ink tank unit 200 mounted in the correct position is disposed in the position shown in FIGS. 5B, 6B, that is, the position wherein the ID member 170 is opposite to the ID recess 252, the unit is mounted further inside (on the side of the negative pressure control chamber unit 100). For the ink tank unit 200 mounted up to this position, the lower end of the sealing protrusion 180*a* of the joint port 230 and joint pipe 180 abuts on the joint seal surface 260 of the joint port 230.

Subsequently, the joint part is connected as described above, and the ink tank unit 200 communicates with the negative pressure control chamber unit 100.

In the above-described embodiment, the sealing protrusion 180*a* is integrally disposed with the joint pipe 180, but the sealing protrusion 180*a* may be constituted separately from the joint pipe 180. In the constitution, by substantially joining the sealing protrusion 180*a* to the protrusion or the recess disposed in the periphery of the joint pipe 180, the sealing protrusion 180*a* can move around the joint pipe 180. Additionally, the movable range of the sealing protrusion 180*a* is designed so that during the mounting of the ink tank unit 200 on the holder 150, the sealing protrusion 180*a* in the movable range completely abuts on the joint seal surface 260 before the valve opening/closing protrusion 180*b* abuts on the valve body 261.

In the process of mounting the ink tank unit 200 on the holder 150, in the above-described embodiment, the lower end of the sealing protrusion 180*a* abuts on the joint seal surface 260, and slides against the joint seal surface 260 with the inserting operation of the ink tank unit 200 so that the abutment range gradually extends toward the upper part of the sealing protrusion 180*a*, and finally the upper end of the sealing protrusion 180*a* abuts on the joint seal surface 260. However, in another constitution, the upper end of the sealing protrusion 180*a* abuts on the joint seal surface 260, and slides against the joint seal surface 260 with the inserting operation of the ink tank unit 200 so that the abutment range gradually extends toward the lower part of the sealing protrusion 180*a*, and finally the lower end of the sealing protrusion 180*a* may abut on the joint seal surface 260. Moreover, the lower end and upper end may simultaneously abut on the surface. In this case, even when the air between the joint pipe 180 and the valve body 261 pushes the valve body 261 to open the valve body 261, the joint port 230 is completely sealed by the sealing protrusion 180*a* and joint seal surface 260, and the ink 300 in the ink container 201 fails to leak to the outside. Specifically, the point of the present invention lies in that the joint pipe 180 and joint port 230 are completely sealed before the valve mechanism is opened. According to the present constitution, the ink 300 in the ink tank fails to leak to the outside during the mounting of the ink tank unit 200. The further pushed air enters the ink tank unit 200, the ink 300 in the ink container 201 is pushed out to the joint port 230, and the ink supply to the absorber 140 from the ink container 201 is therefore quickly performed.

<Ink Supply Operation>

An ink supply operation in the ink jet head cartridge shown in FIG. 2 will next be described with reference to FIG. 7. FIG. 7 is a sectional view showing the ink supply operation in the ink jet head cartridge shown in FIG. 2.

As described above, the absorber in the negative pressure control chamber unit 100 is divided into a plurality of members, and the boundary surface of the divided members is disposed above the upper end of the joint pipe 180 in the posture during the use. Therefore, when the ink is present both in the absorbers 130, 140 in the ink jet head cartridge shown in FIG. 2, after consuming the ink in the upper absorber 130, the ink in the lower absorber 140 can be consumed. Moreover, when the gas-liquid interface L fluctuates by the environmental change, first the absorber 140, and the vicinity of the boundary surface 113*c* between the absorbers 130 and 140 are filled, and the ink then advances into the absorber 130. Therefore, the fiber direction of the absorber 140, and the buffer area other than the buffer space 116 in the negative pressure control chamber unit 100 can stably be secured. Furthermore, as in the present embodiment, by setting the strength of the capillary force of the absorber 140 to be relatively higher than that of the capillary force of the absorber 130, the ink in the upper absorber 130 can securely be consumed during the use.

Additionally, in the present embodiment, when the absorber 130 is pushed toward the absorber 140 by the rib of the negative pressure control chamber lid 120, the absorber 130 presses/contacts the absorber 140 on the boundary surface 113*c*, and the parts of the absorbers 130, 140 in the vicinity of the boundary surface 113*c* are higher in compression ratio and stronger in capillary force than the other sites. Specifically, when the capillary force of the absorber 140 is P1, the capillary force of the absorber 130 is P2, and the capillary force of the boundary surface 113*c* of the absorbers 130, 140 and the area (boundary layer) of the absorbers 130, 140 in the vicinity of the boundary surface 113*c* is PS, a relation of P2<P1<PS is obtained. With the boundary layer strong in the capillary force, even when the capillary force ranges of P1 and P2 set by considering a density dispersion overlap each other by the density dispersion in the absorbers 130, 140, the capillary force satisfying the above-described condition is present in the interface, and the above-described effect can securely be produced. Moreover, by disposing the joint pipe 180 in the vicinity of the lower part of the boundary surface 113*c* of the absorbers 130, 140 as described above, the liquid surface during the gas-liquid exchange can preferably be kept stably in this position.

A method for constituting the boundary surface 113*c* in the present embodiment will next be described. In the present embodiment, an olefin-based resin fiber (2 deniers) with a capillary force P1=−110 mmAq. is used as the material constituting the absorber 140 as the capillary force generating member, and its hardness is 0.69 kgf/mm. Here, by measuring the resilience in the contained state in the negative pressure control chamber container 110 when a $\phi$15 mm pushing rod is pushed into the absorber, the hardness of the absorbers 130, 140 is obtained by the inclination of the resilience to the pushing amount. On the other hand, the same olefin-based resin fiber as the material of the absorber 140 is used as the constituting material of the absorber 130, but P2 of the absorber 130 becomes weaker than that of the absorber 140, the capillary force is P2=−80 mmAq., the fiber diameter of the fiber material is thick (6 deniers), and the rigidity of the absorber 130 is as high as 1.88 kgf/mm.

By setting the absorber 130 with a lower capillary force to be harder than the absorber 140 with a higher capillary force, and pressing and combining the absorbers 130, 140, the absorber 140 is collapsed in the vicinity of the boundary surface 113*c* of the absorbers 130, 140, and the capillary force strength relation can be set to P2<P1<PS. Furthermore, a difference between P2 and PS can be more than a difference between P2 and P1.

<Ink Consuming Operation>

Figure 8A:
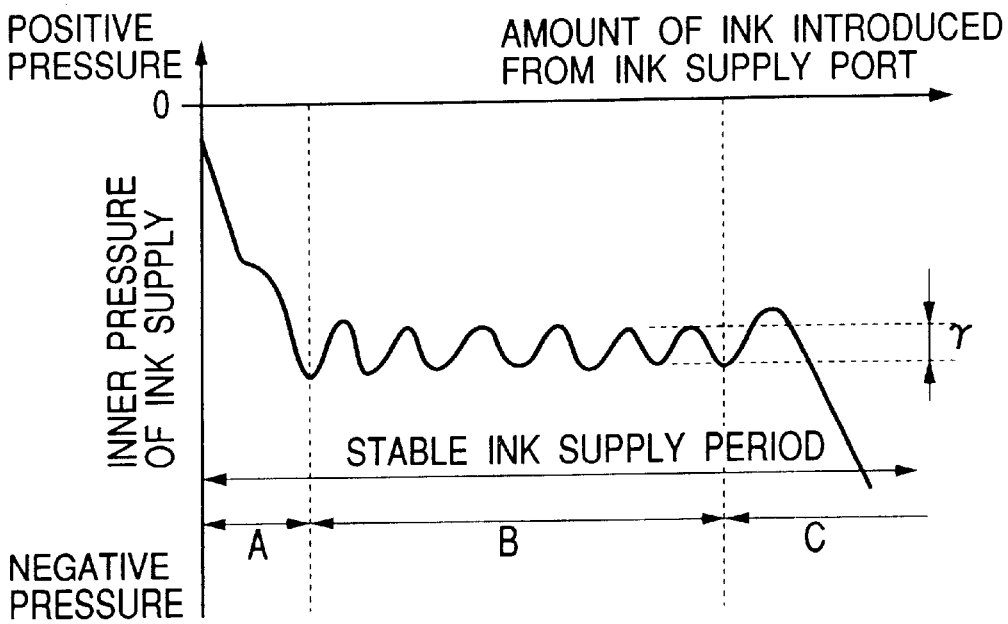
FIGS. 8A and 8B are diagrams showing the ink state in an ink consuming operation described with reference to FIG. 7.
Figure 8B:
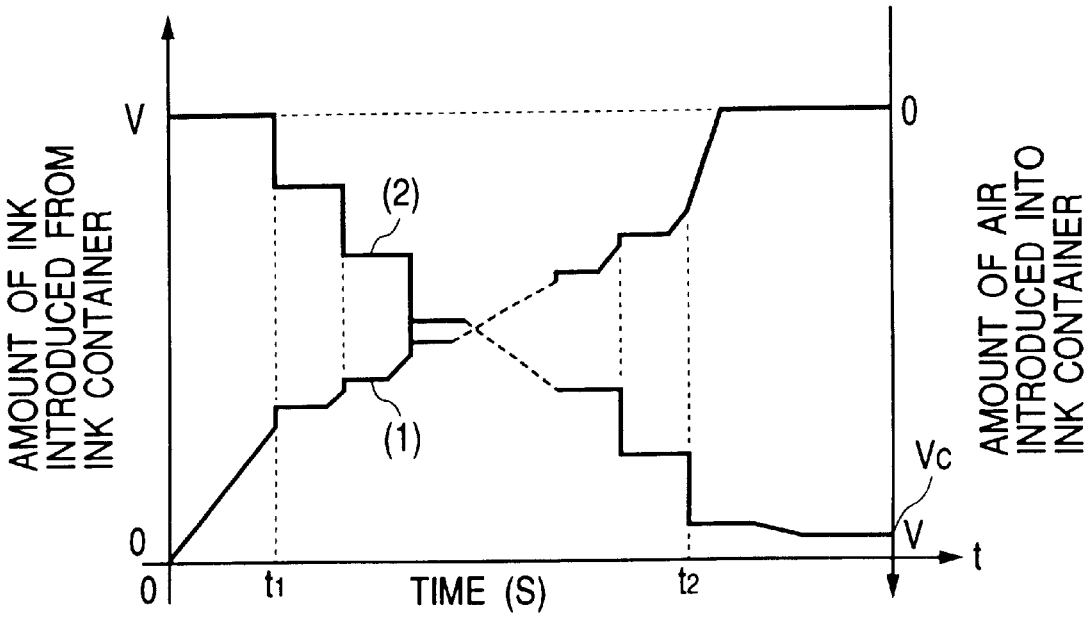
Figure 9A:
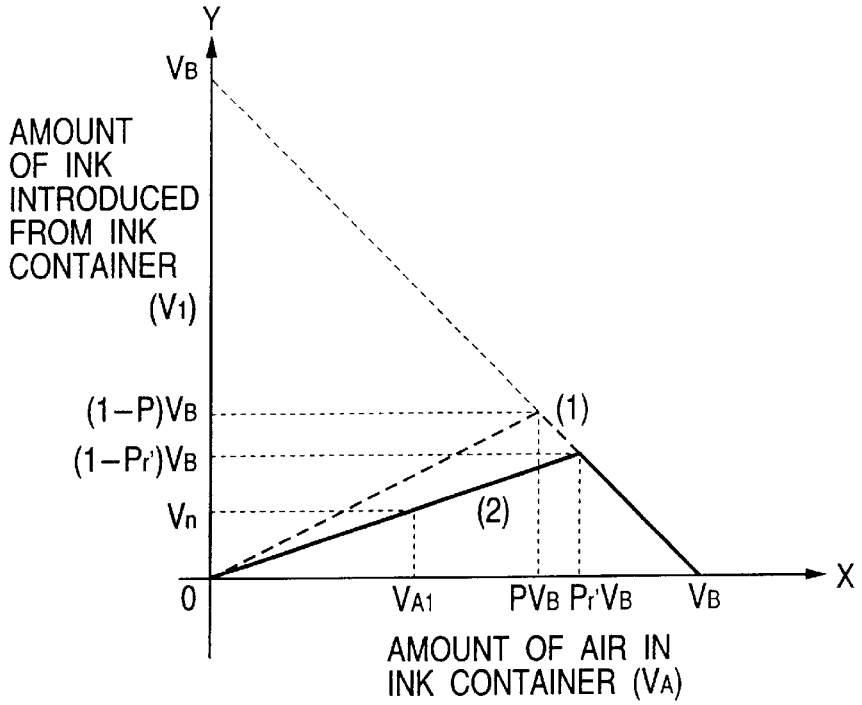
FIGS. 9A and 9B are diagrams showing an effect of inhibiting an inner pressure fluctuation by the deformation of an inner bag in the ink consuming operation described with reference to FIG. 7.
Figure 9B:
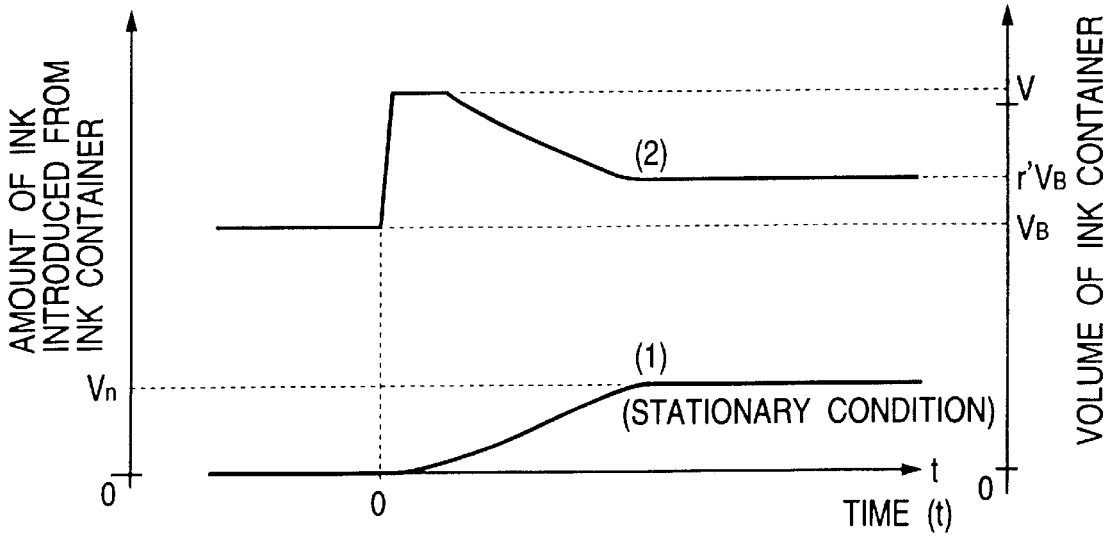

Next, an ink consuming operation will briefly be described with reference to FIGS. 7 to 9A and 9B from when the ink tank unit 200 is mounted on the negative pressure control chamber unit 100 and holder 150 until the ink in the ink container 201 is consumed. FIGS. 8A and 8B are explanatory views showing the ink state in the ink consuming operation described with reference to FIG. 7, and FIGS. 9A and 9B are explanatory views showing the inhibiting effect of an inner pressure fluctuation by the deformation of the inner bag 220 in the ink consuming operation.

First, by connecting the ink container 201 to the negative pressure control chamber unit 100 as described above, the ink in the ink container 201 moves into the negative pressure control chamber unit 100 until the pressure in the negative pressure control chamber unit 100 equals that in the ink container 201, so that the user start state is obtained. Subsequently, when the ink starts to be consumed by the ink jet head unit 160, the value of a static negative pressure generated both by the inner bag 220 and the absorber 140 is balanced in an increasing direction, and the ink held both in the inner bag 220 and the absorber 140 is consumed (first ink supply state: area A of FIG. 8A). Here, when the absorber 130 contains the ink, the ink of the absorber 130 is also consumed. Additionally, FIG. 8A is an explanatory view showing one example of a negative pressure change proportion in the ink supply tube 165 in the above-described case, and in FIG. 8A the abscissa indicates the amount of the ink introduced to the outside of the negative pressure control chamber container 110 from the ink supply tube 165, and the ordinate indicates the value of the negative pressure (static negative pressure) in the ink supply tube 165.

Subsequently, by introducing gas into the inner bag 220, a gas-liquid exchange state (second ink supply state: area B of FIG. 8A) is obtained in which the absorbers 130, 140 keep the gas-liquid interface L and hold a substantially constant negative pressure with the ink introduction, and the ink remaining in a capillary force generating member containing chamber 10 is then consumed (area C of FIG. 8A).

In this manner, since the ink jet head cartridge of the present embodiment includes a process of using the ink in the inner bag 220 without introducing the outside air into the inner bag 220, in the ink supply process (first ink supply state) the inner volume of the ink container 201 is limited only by considering the air introduced into the inner bag 220 during the connection. As a result, even when the limitation of the inner volume of the ink container 201 is moderated, there is an advantage that environmental changes such as a temperature change can be handled.

Moreover, even when the ink container 201 is replaced in any state of the above-described areas A, B, C in FIG. 8A, the negative pressure can stably be generated, and the secure ink supply operation can be performed. Specifically, according to the ink jet head cartridge of the present embodiment, the ink in the ink container 201 can substantially completely be consumed. Additionally, during the replacing of the ink tank unit 200 the joint pipe 180 or the joint port 230 may contain the air, and the ink container 201 can be replaced irrespective of the ink holding amount. Therefore, even when a residual amount detecting mechanism is not necessarily disposed, the ink jet head cartridge in which the ink container 201 is replaceable can be obtained.

Here, an operation in the above-described series of ink consumption process will be described with reference to FIG. 8B from another viewpoint.

FIG. 8B is an explanatory diagram showing one example of the operation in the series of ink consumption process, and in FIG. 8B, the abscissa indicates time, and the ordinate indicates the amount of the ink introduced from the ink container, and the amount of the air introduced into the inner bag 220. Moreover, with an elapse of time the ink supply amount to the ink jet head unit 160 is set to be constant.

The operation in the series of ink consumption process will be described from the viewpoint of the ink introduced amount and air introduced amount shown in FIG. 8B. In FIG. 8B, the amount of the ink introduced from the inner bag 220 is shown by a solid line 1, and the amount of the air introduced into the ink container is shown by a solid line 2. An area from time t=0 to time t=t1 corresponds to the area A before the gas-liquid exchange shown in FIG. 8A. In the area A, the ink is introduced from the head while the ink from the absorber 140 and inner bag 220 is balanced as described above.

Moreover, an area from time t=t1 to time t=t2 corresponds to the gas-liquid exchange area B of FIG. 8A. In this area B, the gas-liquid exchange is performed based on the above-described negative pressure balance. As shown by the solid line 1 of FIG. 8B, the ink is introduced from the inner bag 220 by introducing the air into the inner bag 220 (shown by the stepped part of the solid line 2). In this case, the ink is not introduced from the inner bag 220 by the amount equal to the amount of the introduced air immediately after the air introduction, and the ink is finally introduced from the inner bag 220 by the amount equal to the amount of the introduced air, for example, in a predetermined time after the air introduction. In the operation, as clearly shown in FIG. 8B, the timing deviates, different from the operation of the ink tank in which the inner bag 220 is not disposed and the ink container is not deformed. This operation is repeated in the gas-liquid exchange area as described above. When the introduction of the ink from the inner bag 220 proceeds, at a certain time, the amount of the air and the amount of the ink are reversed in the inner bag 220.

When time t=t2 elapses, the area after the gas-liquid exchange (area C) shown in FIG. 8A is obtained. In this area C, the inside of the inner bag 220 substantially reaches the atmospheric pressure. Accordingly, the operation returns to the initial state (the state before the use start) by the elastic force of the inner bag 220. However, the inner bag 220 incompletely returns to its initial state by so-called buckling. Therefore, the final air introduction amount Vc into the inner bag 220 has a relation of V>Vc. Also in the area C all the ink from the inner bag 220 is used up.

As described above, the phenomenon of the gas-liquid exchange operation in the constitution of the ink jet head cartridge of the present embodiment is characterized in that the pressure fluctuation during the gas-liquid exchange (amplitude y in FIG. 8A) is relatively large as compared with the ink tank system in which the conventional gas-liquid exchange is performed.

The reason is that the inner bag 220 is deformed inward in the tank by the ink introduction from the inner bag 220 before the gas-liquid exchange. Therefore, a constant outward force is exerted on the wall of the inner bag 220 by the elastic force of the inner bag 220. In order to moderate the pressure difference between the inside of the absorber 140 and the inside of the inner bag 220 during the gas-liquid exchange, a predetermined amount of air or more air is introduced into the inner bag 220 as described above in many cases. Therefore, the amount of the ink introduced to the negative pressure control chamber unit 100 from the inner bag 220 also tends to increase. On the other hand, in the constitution of the ink tank unit 200 provided with the ink container whose wall fails to be deformed different from the inner bag 220, when the predetermined amount of air is introduced into the ink container, the ink is immediately introduced into the negative pressure control chamber unit 100.

For example, when a 100% duty (solid mode) printing is performed, a large amount of ink is discharged once from the ink jet head unit 160. Thereby, the ink is rapidly introduced from the negative pressure control chamber unit 100 and ink container 201, but in the ink jet head cartridge of the present embodiment, the introduction of the ink by the gas-liquid exchange is performed in relatively many cases, so that there is no fear of ink shortage and the reliability is enhanced.

Moreover, according to the constitution of the ink jet head cartridge of the present embodiment, since the ink is introduced in the inward deformed state of the inner bag 220, there is further advantage that the buffer effect is high against external factors such as a carriage vibration, environmental change and the like.

As described above, in the ink jet head cartridge of the present embodiment, a slight negative pressure fluctuation can be moderated by the inner bag 220. Furthermore, according to the constitution, even when the inner bag 220 contains the air as in the second ink supply state, the environmental changes such as a temperature change can be handled by a solution method different from the conventional method.

Moreover, since the upper wall surface 122 of the joint pipe 180 is inclined upward toward the ink container 201 from the negative pressure control chamber container 110 as shown in FIG. 3, the gas-liquid exchange operation is performed without retaining or accumulating the bubble on the upper wall surface 122 of the joint pipe 180.

A mechanism of stably holding the liquid in the unit will next be described with reference to FIGS. 9A, 9B in which the environmental condition of the ink jet head cartridge shown in FIG. 2 is changed. In the description, the absorbers 130, 140 will also be referred to as the capillary force generating members.

When the air in the inner bag 220 expands by a decrease of atmospheric pressure or a rise of temperature, the wall constituting the inner bag 220 and the liquid surface in the inner bag 220 are pressed. Therefore, when the inner volume of the inner bag 220 increases, a part of the ink in the inner bag 220 flows into the negative pressure control chamber container 110 from the inner bag 220 through the joint port 230 and joint pipe 180. Here, since the inner volume of the inner bag 220 increases, the amount of the ink flowing to the absorber 140 is remarkably reduced as compared with the constitution in which the ink containing part cannot be deformed.

Here, when the atmospheric change is rapid, the amount of the ink flowing into the negative pressure control chamber container 110 through the joint port 230 and joint pipe 180 moderates the negative pressure in the inner bag 220, and increases the inner volume of the inner bag 220. Therefore, the influences of a wall surface resisting force generated by moderating the inward deformation of the wall of the inner bag 220 and a resisting force for moving the ink to be absorbed by the capillary force generating member are initially dominant.

Particularly, in the present constitution, since the flow resistance of the capillary force generating member (absorbers 130, 140) is larger than the resistance against the bag restoration, the inner volume of the inner bag 220 first increases with the air expansion. Moreover, when the volume increase by the air expansion is larger than the upper limit of the increase, the flow flows toward the negative pressure control chamber container 110 from the inner bag 220 through the joint port 230 and joint pipe 180. Specifically, since the wall surface in the inner bag 220 plays a function as the buffer against the environmental change, the ink movement in the capillary force generating member is moderated, and the negative pressure property in the vicinity of the ink supply tube 165 is stabilized.

Additionally, in the present embodiment, the ink flowing out to the negative pressure control chamber container 110 is held by the capillary force generating member. In this case, since the amount of the ink of the negative pressure control chamber container 110 temporarily increases to raise the gas-liquid interface, a slightly positive inner pressure is obtained similarly as the use initial period, as compared with the stable period of the ink inner pressure, but the influence on the discharge characteristics of the liquid discharge recording means such as the ink jet head unit 160 is minimized, and there is no problem in the actual use. Moreover, when the atmospheric pressure is recovered to the level before the pressure reduction (returns to one atmospheric pressure or returns to the original temperature), the ink which leaks to the negative pressure control chamber container 110 and which is held in the capillary force generating member returns into the inner bag 220 and the inner volume of the inner bag 220 returns to its original state.

A principle operation will next be described in which after the atmospheric pressure change and the initial operation a stationary condition is obtained under the changed atmospheric pressure.

This state is characterized in that in order to maintain a balance against not only the ink amount introduced from the inner bag 220 but also the negative pressure fluctuation by the inner volume change of the inner bag 220 itself, the ink interface held in the capillary force generating member changes. Here, in the present invention, for a relation between the ink absorption amount of the capillary force generating member and the ink container 201, from the viewpoint of the prevention of the ink leakage from the atmosphere communication port during the above-described pressure reduction or temperature change, the maximum ink absorption amount of the negative pressure control chamber container 110 is determined in consideration of the ink flow amount from the ink container 201 under the worst condition and the ink amount held by the negative pressure control chamber container 110 during the ink supply from the ink container 201, and the negative pressure control chamber container 110 may be provided with the volume for containing at least the corresponding capillary force generating member.

In FIG. 9A, when the inside of the inner bag 220 fails to be deformed against the air expansion, the initial space volume (air volume) in the inner bag 220 before the pressure reduction is shown along the abscissa (X), the ink flow amount with the atmospheric pressure reduced to P atmospheric pressure ($0<P<1$) is shown along the ordinate (Y), and a relation is shown by a dotted line 1.

Therefore, for the estimated ink flow amount from the inner bag 220 on the worst condition, for example, supposing that the atmospheric pressure by the maximum pressure reduction condition is 0.7 atmospheric pressure, the ink flow amount from the ink container 201 is maximized when the ink is residual in the inner bag 220 by 30% of the volume VB of the inner bag 220. Supposing that the lower ink is also absorbed by the capillary force generating member of the negative pressure control chamber container 110 from the inner wall lower end of the inner bag 220, it may be considered that all the residual ink (30% of VB) in the inner bag 220 leaks out.

On the other hand, in the present embodiment, since the inside of the inner bag 220 is deformed with the air expansion, the inner volume of the expanded inner bag 220 increases with respect to the inner volume of the inner bag 220 before the expansion, and further the ink holding level in the negative pressure control chamber container 110 changes in order to maintain a balance against the negative pressure fluctuation by the deformation inside the inner bag 220. Moreover, in the stationary condition, the ink from the inner bag 220 maintains the balance of the negative pressure with the capillary force generating member whose negative pressure decreases as compared with before the atmospheric pressure fluctuation. Specifically, the ink introduced amount decreases by the expansion amount in the inner bag 220. One example of the result is shown by a solid line 2. As clearly seen from the dotted line 1 and solid line 2, the estimate on the worst condition of the ink flow amount from the inner bag 220 can be set to be smaller than that in a case in which the inside of the inner bag 220 is not deformed at all against the air expansion. The similar phenomenon also occurs when the temperature of the ink tank changes, but even with the temperature rise of about 50 deg the flow amount is less than that during the pressure reduction.

As described above, according to the ink tank of the present invention, the expansion of the air in the ink container 201 by the environmental change is allowable not only in the negative pressure control chamber container 110 but also in the ink container 201 by the buffer effect of increasing the volume of the ink container 201 itself to the maximum until the outer shape of the inner bag 220 substantially equals the shape of the inner surface of the housing 210. Therefore, there can be provided an ink supply system in which even when the ink amount contained in the ink container 201 largely increases, the environmental change can be handled.

Moreover, when the initial air volume is VA1, and the tank environment is changed at t=0 under the pressure reduction environment from the atmospheric pressure to P atmospheric pressure ($0<P<1$), the amount of the ink introduced from the inner bag 220 and the inner volume of the inner bag 220 with an elapse of time are schematically shown in FIG. 9B. In FIG. 9B, the abscissa indicates time t, the ordinate indicates the amount of the ink introduced from the inner bag 220 and the inner volume of the inner bag 220, the change of the amount of the ink introduced from the inner bag 220 with time is shown by a solid line 1, and the change of the volume in the inner bag 220 with time is shown by a solid line 2.

As shown in FIG. 9B, against the rapid environmental change, the air expansion can be allowed mainly in the ink container 201 before the stationary condition is finally obtained to maintain the negative pressure balance between the negative pressure control chamber container 110 and the ink container 201. Therefore, against the rapid atmospheric pressure, the timing for introducing the ink to the negative pressure control chamber container 110 from the ink container 201 can be retarded.

Therefore, even under various use environments, there can be provided an ink supply system in which the tolerance for the expansion of the outside air introduced by the gas-liquid exchange is enhanced, and the ink supply can be performed during the use of the ink container 201 under the stable negative pressure condition.

According to the ink jet head cartridge of the present embodiment, the volume proportion of the negative pressure control chamber container 110 and inner bag 220 can arbitrarily determined by appropriately selecting the materials of the capillary force generating member (absorbers 130, 140) for use and the inside of the inner bag 220, and the practical use is possible even with a proportion larger than 1:2. Particularly, when importance is attached to the buffer effect in the inner bag 220, the deformation amount of the inner bag 220 in the gas-liquid exchange state with respect to the use start state may be increased within an elastically deformable range.

As described above, according to the ink jet head cartridge of the present embodiment, even when the capillary force generating member occupies a slight volume together with the constitution of the negative pressure control chamber container 110, the effect can synergistically be fulfilled against the external environmental change.

In the ink jet head cartridge of the present embodiment, as shown in FIG. 2, the joint pipe 180 is disposed above the lower end of the negative pressure control chamber container 110. Thereby, the effect of reducing the dispersion of the ink component in the absorbers 130, 140 in the negative pressure control chamber container 110 is obtained. This effect will be described hereinafter in more detail.

The ink from the ink tank unit 200 is supplied to the ink jet head unit 160 via the joint port 230, and absorbers 130, 140, but various paths are extended to the ink supply tube 165 from the joint port 230. When the ink is directly supplied in the shortest distance, and for example, when the ink once goes to the upper part of the absorber 140 by the rise of the liquid surface in the absorber 140 by the above-described environmental changes and is then introduced to the ink supply tube 165, the paths considerably differ. Therefore, the dispersion of the ink component influences the recording in some cases. As in the constitution of the ink jet head cartridge of the present embodiment, by positioning the joint pipe 180 in the upper part of the absorber 140, the dispersion of the ink path, that is, the difference of the path length is depressed, and the ink component dispersion can therefore be depressed. This can depress the dispersion component to the recording. Therefore, it is preferable to dispose the joint pipe 180 and joint port 230 as high as possible, but in order to secure the buffer function, a certain position is preferably restricted as in the present embodiment. This position is appropriately determined by the absorbers 130, 140, ink, ink supply amount, ink amount, and other conditions.

Additionally, in the negative pressure control chamber container 110 of the ink jet head cartridge of the present embodiment, as described above, by pressing and containing the absorber 140 with a capillary force of P1 and the absorber 130 with a capillary force of P2, the boundary surface 113*c* with a capillary force of PS is formed. The respective capillary force strengths have a relation of P2<P1<PS, that is, the capillary force of the boundary surface 113*c* is strongest, the capillary force of the lower disposed absorber 140 is next strong, and the capillary force of the upper disposed absorber 130 is weakest. Since the capillary force of the boundary surface 113*c* is strongest and the capillary force of the upper disposed absorber 130 is weakest, even the ink supplied from the communication port 230 and flowing beyond the boundary surface 113*c* into the upper absorber 130 is strongly pulled toward the boundary surface 113*c*, and returns toward the boundary surface 113*c*. With the presence of the boundary surface 113*c*, a path J draws no line passed through both the absorber 130 and the absorber 130, additionally the communication port 230 is formed above the supply port 131, and a difference in the length between paths K and J can therefore be reduced. Consequently, the influence of the absorber 140 on the ink caused when the path of the ink flowing through the absorber 140 differs can also be reduced.

Moreover, in the present embodiment, the ink absorber as the negative pressure generating member contained in the negative pressure control chamber container 110 is constituted of two members. In the present embodiment, the absorbers 130, 140 different in the capillary force are used, and the lower absorber has a stronger capillary force. Furthermore, by positioning the joint pipe 180 in the lower part of the vicinity of the interface of the boundary surface 113*c* between the absorbers 130, 140, the ink path dispersion is depressed, and the certain buffer part can also be secured.

Moreover, the supply port 131 is formed in the vicinity of the middle of the lower wall of the negative pressure control chamber container 110 in the example, but is not limited to this, and may be formed in a direction apart from the communication port 230, that is, on the left end of the lower wall or in the left side wall in FIG. 2 if necessary. Therefore, the position of the ink jet head unit 160 disposed on the holder 150, and the position of the ink supply tube 165 may also be disposed opposite to the supply port formed in the left end of the lower wall or in the left side wall.

<Valve Mechanism>

The valve mechanism disposed inside the joint port 230 of the ink tank unit 200 will next be described with reference to FIGS. 10A to 10D.

Figures 10A, 10B, 10C, 10D:
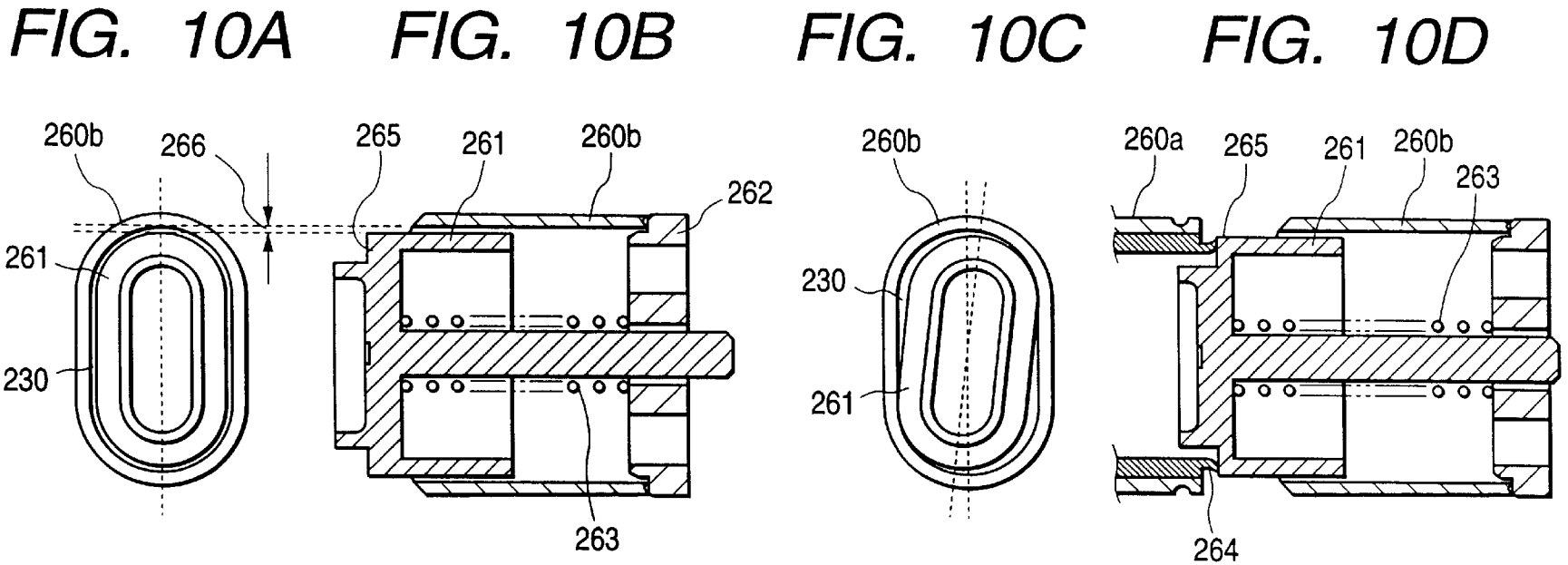
FIGS. 10A, 10B, 10C and 10D are diagrams showing a relation between a valve frame and a valve body in the valve mechanism which can be applied to the present invention.

FIG. 10A is a front view showing a relation between the second valve frame 260*b* and the valve body 261, FIG. 10B is a side sectional view of FIG. 10A, FIG. 10C is a front view showing a relation between the second valve frame 260*b* and the rotated valve body 261, and FIG. 10D is a side sectional view of FIG. 10C.

As shown in FIGS. 4A, 4B, 10A, 10B, the opening shape of the joint port 230 is elongated and extended in one direction in order to enhance the ink supply performance of the ink container 201, and the opening area of the joint port 230 is enlarged. However, when the opening width of the joint port 230 is enlarged in the lateral direction vertical to the longitudinal direction of the joint port 230, the space occupied by the ink container 201 increases, and this results in the enlargement of the device. With the recent coloring and photographing, this tendency is effective particularly when the ink tanks are arranged in parallel in the lateral direction (carriage scan direction). Therefore, in the present embodiment, the shape of the joint port 230 as the ink supply port of the ink container 201 is shaped as the elongated hole.

Furthermore, in the ink jet head cartridge of the present embodiment, the joint port 230 plays a role of supplying the ink to the negative pressure control chamber unit 100, and a role of introducing the atmosphere into the ink container 201. Therefore, since the joint port 230 has the elongated hole shape having the longitudinal direction vertical to the gravity direction, the functions can easily be separated by using the lower part of the joint port 230 mainly as the ink supply path and the upper part of the joint port 230 mainly as the atmosphere introduction path, and the secure ink supply and gas-liquid exchange can be achieved.

As described above, the joint pipe 180 of the negative pressure control chamber unit 100 is inserted into the joint port 230 with the mounting of the ink tank unit 200. Therefore, when the valve opening/closing protrusion 180*b* on the tip end of the joint pipe 180 pushes the valve body 261 to open the valve mechanism of the joint port 230, the ink in the ink container 201 is supplied into the negative pressure control chamber unit 100. Even when one side of the valve opening/closing protrusion 180*b* contacts the valve member by the posture of the ink tank unit 200 mounted on the joint pipe 180, owing to the semicircular sectional shape of the tip end of the sealing protrusion 180*a* disposed on the side surface of the joint pipe 180, the twist of the valve body 261 can be avoided. IN this case, in order to realize the stable sliding of the valve body 261, a clearance 266 is disposed between the joint seal surface 260 inside the joint port 230 and the outer peripheral part of the valve body 261 on the side of the first valve frame 260*a* as shown in FIGS. 10A and 10B.

Furthermore, since at least the upper part is opened in the tip end of the joint pipe 180, the joint pipe 180 is inserted into the joint port 230 without obstructing the formation of the main atmosphere introduction path in the upper part in the joint pipe 180 and joint port 230, and a quick gas-liquid exchange operation is possible. Conversely, during the removing operation of the ink tank unit 200, since the joint pipe 180 is detached from the joint port 230, the valve body 261 slides forward on the side of the first valve frame 260*a* by the elastic force exerted from the urging member 263, and as shown in FIG. 10D, the valve frame seal part 264 of the first valve frame 260*a* engages with a valve body seal part 265 of the valve body 261 to cut off the ink supply path.

Figure 11:
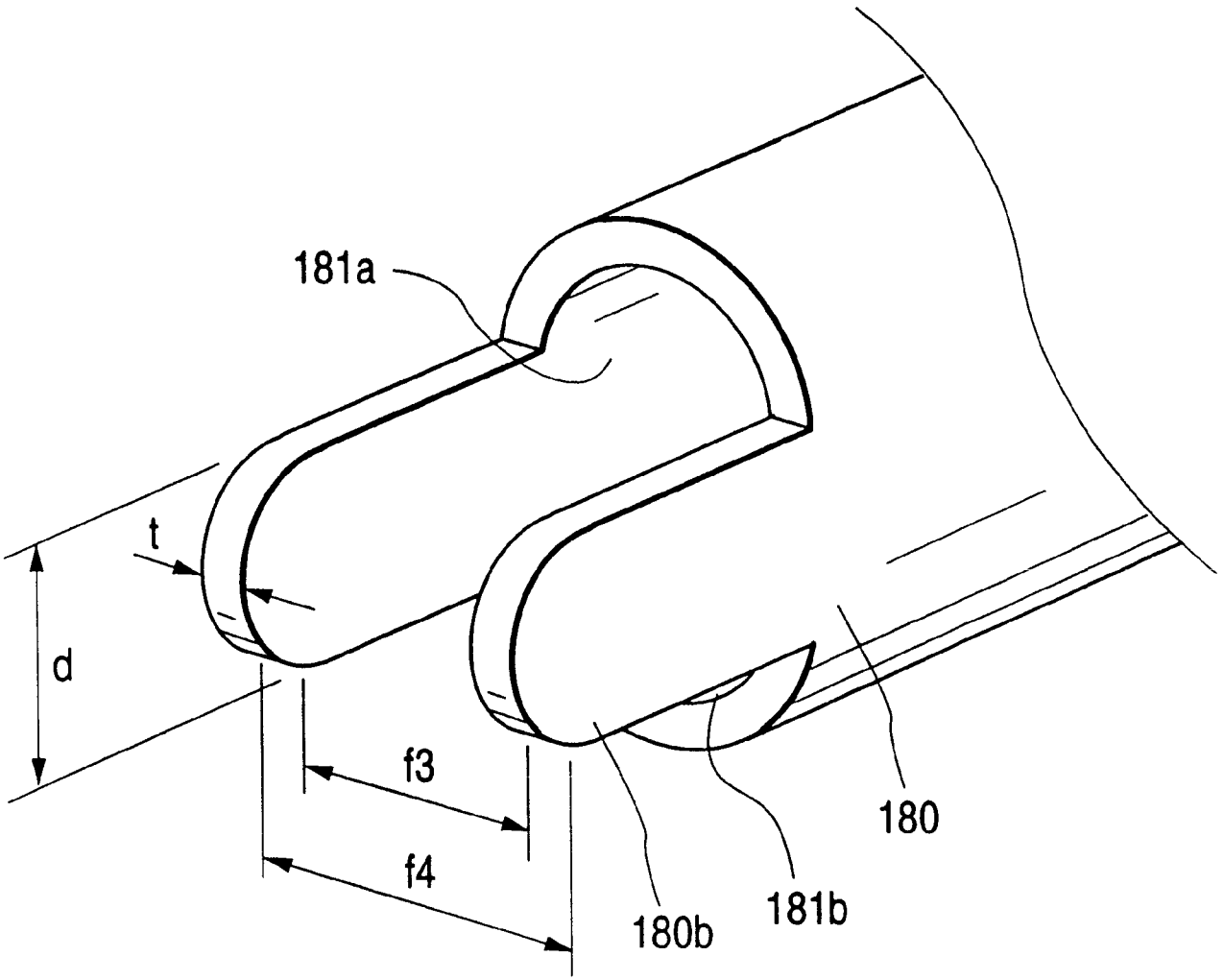
FIG. 11 is a perspective view showing one example of the shape of the tip end of the joint pipe for engagement during the opening/closing operation of the valve mechanism which can be applied to the present invention.

FIG. 11 is a perspective view showing one example of the shape of the tip end of the joint pipe 180. As shown in FIG. 11, an upper opening 181*a* is formed in the upper part of the tip end of the joint pipe 180 having the elongated hole shape, and a lower opening 181*b* is formed in the lower part of the tip end. The lower opening 181*b* forms an ink path, and the upper opening 181*a* forms an air path, but the upper opening 181*a* sometimes passes the ink.

Moreover, the value of the urging force of the valve body 261 to the first valve frame 260*a* is set so that the urging force of the valve body 261 is maintained to be substantially constant even if a difference between inner and outer pressures is generated in the ink container 201 in the use environmental change. When the ink tank unit 200 is used in a high place with 0.7 atmospheric pressure, the valve body 261 is thereafter closed, and the ink tank unit 200 is transported to the environment with 1.0 atmospheric pressure, the pressure of the ink container 201 becomes lower than the atmospheric pressure, and a force acts on the valve body 261 in a direction for opening the valve body 261. In the present embodiment, a force FA by which the atmosphere pushes the valve body 261 is as follows:

$$EA=1.01\times10^5\ [N/m^2]\ \text{(1.0 atmospheric pressure)}$$

Moreover, a force FB by which the gas in the ink tank pushes the valve body 261 is as follows:

$$FB=0.709\times10^5\ [N/m^2]\ \text{(0.7 atmospheric pressure)}$$

In order to constantly generate the urging force in the valve body 261 against the environmental change, an urging force FV of the valve body 261 needs to satisfy a condition of FV-(FA-FB)>0. Specifically, in the present invention, the following is obtained:

$$FV>1.01\times10^5-0.709\times10^5=0.304\times10^5\ [N/m^2]$$

This value is obtained when the valve body 261 engages with the first valve frame 260*a*. When the valve body 261 is detached from the first valve frame 260*a*, the displacement amount of the urging member 263 for generating the urging force to the valve body 261 increases, and it is therefore clear that the value of the urging force for urging the valve body 261 toward the first valve frame 260*a* further increases.

In the valve mechanism constituted as described above, for the sliding surface of the valve opening/closing protrusion 180*b* with the valve body 261, friction coefficient sometimes increases by the ink retention or the like, in this case the valve body 261 fails to slide on the valve opening/closing protrusion sliding surface, and there is a fear of occurrence of so-called twist phenomenon in which the valve body 261 is pushed upward in the drawing by the valve opening/closing protrusion 180*b* to make a stroke.

A valve form in which the influence on the seal performance by the occurrence of the twist phenomenon can be considered will be describe hereinafter together with a comparative example.

Figure 12:
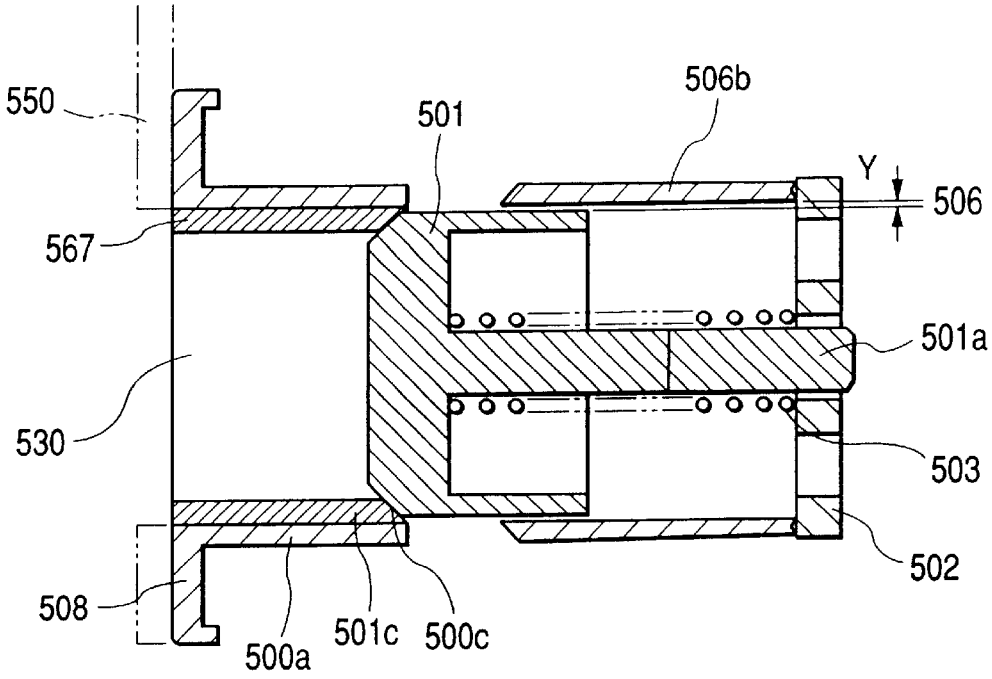
FIG. 12 is a diagram showing a comparative example with respect to the valve mechanism applicable to the present invention.
Figure 13:
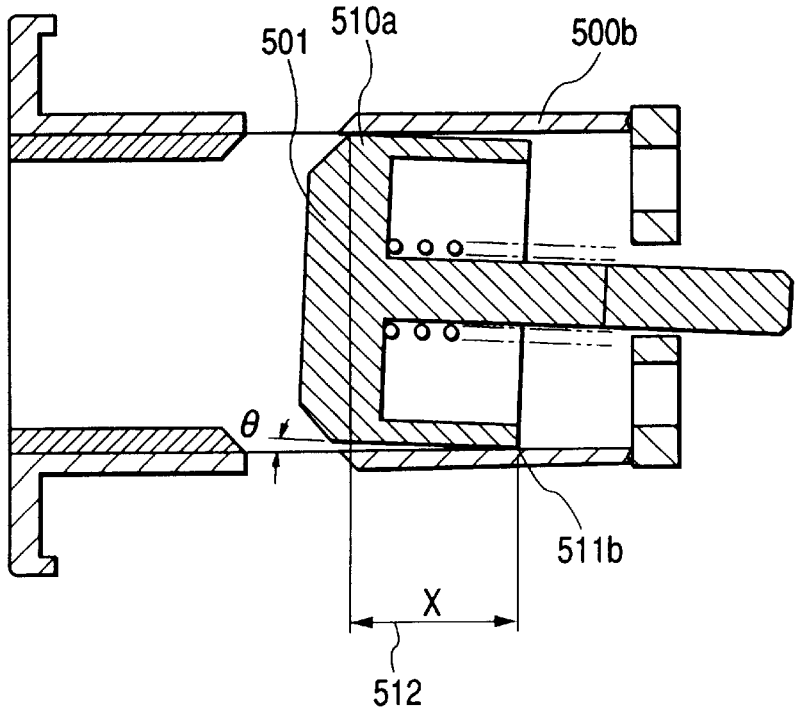
FIG. 13 is a diagram showing a twisted state in the valve mechanism of FIG. 12.
Figure 14:
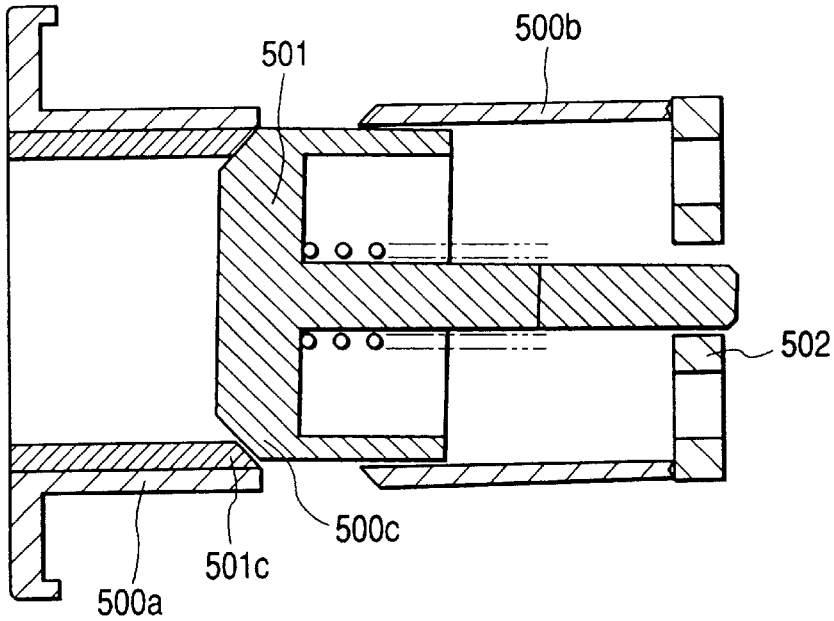
FIG. 14 is a diagram showing a seal state in the valve mechanism of FIG. 12.

FIG. 12 shows an example for comparison with the valve mechanism of the present invention, and FIGS. 13 and 14 show the twist and seal state in the valve mechanism of FIG. 12. In the comparative example of FIG. 12, a clearance 506 for sliding between a valve body 501 having an elongated hole shape and a second valve frame 500*b* is of a constant amount. The valve body 501 is pressed against a first valve frame 500*a* by an urging member 503, and a tapered valve body seal part 501*c* on the side of the second valve frame 500*b* of the valve body 501 closely abuts on a tapered seal part 500*c* of the first valve frame 500*a* to seal a joint port 530. When the above-described twist phenomenon occurs in this comparative example structure, as shown in FIG. 13, the valve body 501 is in contact with the second valve frame 500*b* at two places of contact surfaces 510*a*, 511*b*. When a distance between two contact surfaces is X, and a clearance amount is Y, a twist angle θ is $\theta=\tan^{-1}(2Y/X)$. When the clearance amount is the same, with the larger contact surface distance X, the twist angle can further be reduced.

In the comparative example, however, since the contact surface distance X is relatively short (e.g., as compared with a valve body diameter), the twist angle θ is relatively large. In other words, since the rotating operation with a relatively large angle is necessary to correct the twist, it is seen that a probability of correcting the generated twist is low.

When no twist is corrected and the valve body abuts on the first valve frame 500*a* again as shown in FIG. 14, particularly R parts in the elongated hole shapes of the tapered valve body seal part 501*c* and first valve frame seal part 500*c* are different from each other in abutment radius, abutment parts incompletely abut on each other, and ink leakage occurs.

Moreover, the second valve frame 500*b* and valve lid 502 are welded by an ultrasonic wave, but the valve lid of the comparative example has a simple flat surface, a position deviation by ultrasonic vibration is generated, and dispersion is possibly generated in the precision of the center position of the hole into which a slide shaft 501*a* of the valve body 501 is inserted. Therefore, the hole of the valve lid 502 needs to be enlarged so that the hole of the valve lid 502 is prevented from contacting the slide shaft 501*a* of the valve body 501. Since the minimum diameter of the urging member 503 is determined by the hole diameter of the valve lid 502, it becomes difficult to miniaturize the urging member 503 and to miniaturize the entire valve mechanism.

Figure 15:
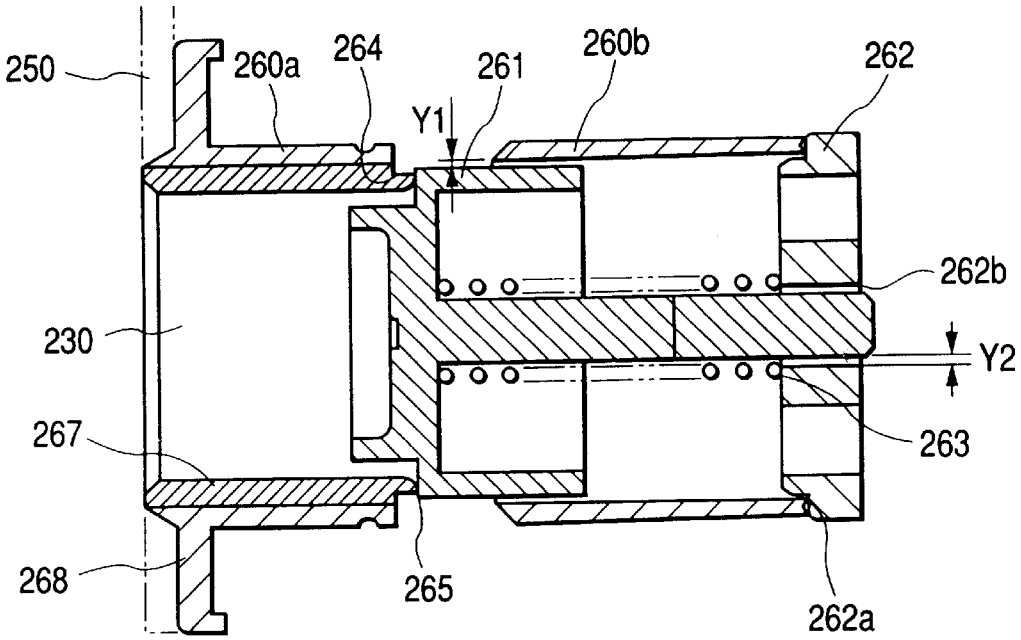
FIG. 15 is a diagram showing the valve mechanism applicable to the present invention.
Figure 16:
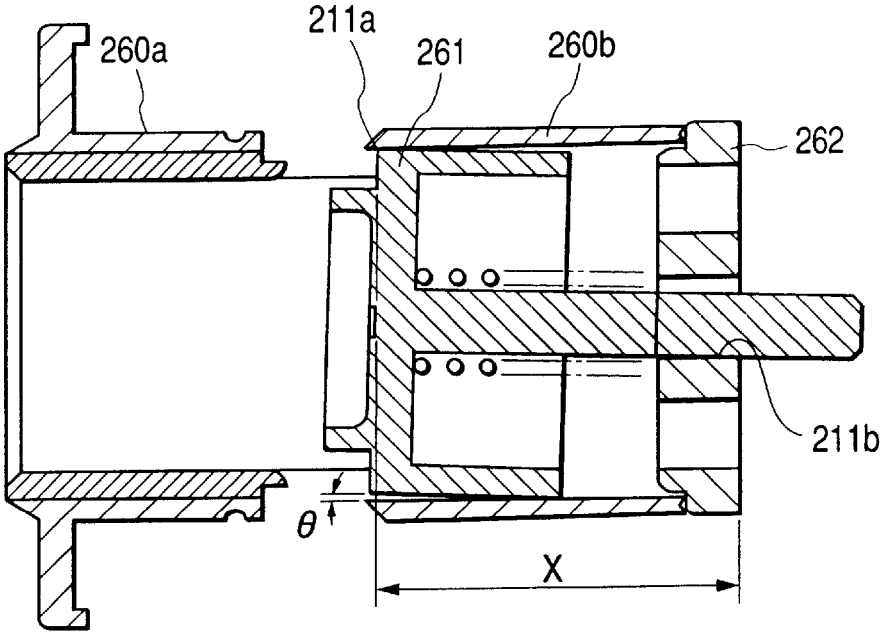
FIG. 16 is a diagram showing the twisted state in the valve mechanism of FIG. 15.
Figure 17:
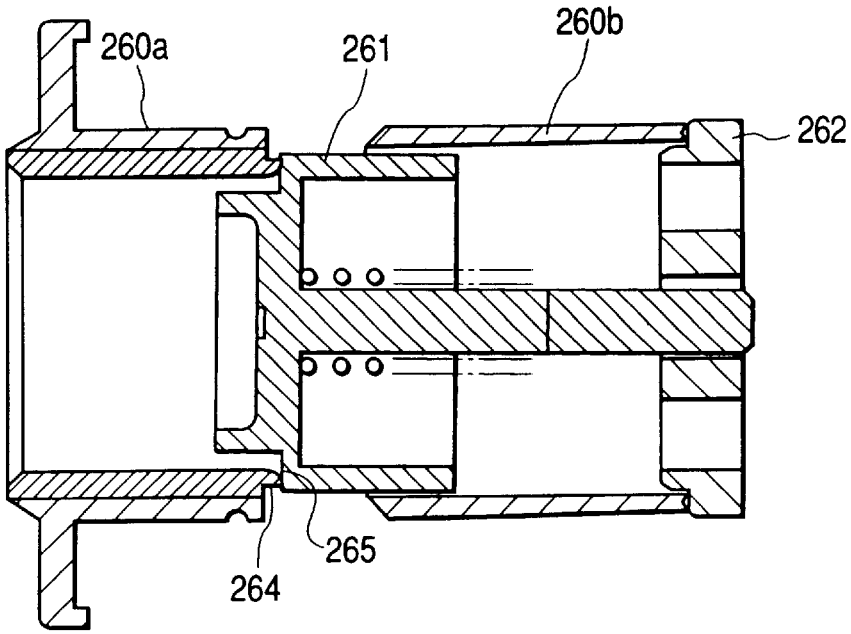
FIG. 17 is a diagram showing the seal state in the valve mechanism of FIG. 15.

Contrary to the comparative example, the valve mechanism of the present embodiment is constituted as follows. FIG. 15 shows the valve mechanism according to the embodiment of the present invention, and FIGS. 16 and 17 show the twist and seal state in the valve mechanism of FIG. 15. As shown in FIG. 15, in the present embodiment, the valve body 261 is tapered in a direction in which the diameter (at least a long diameter) decreases in a stroke direction (to the right in FIG. 15). The inner peripheral part of the second valve frame 260*b* is similarly tapered in a direction in which the inner diameter increases in the stroke direction. When the valve body 261 is twisted in this constitution, a remarkable large angle is necessary for the valve body 261 and second valve frame 260*b* to contact each other in the position of the contact surface 511*b* in the comparative example of FIG. 13, and the slide axis of the valve body 261 contacts the hole of the valve lid 262 before the angle is obtained (see FIG. 16). Therefore, the contact surface distance X can be set to be long, and as a result, the twist angle θ can be reduced. Consequently, even when no twist is corrected and the valve body 261 abuts on the first valve frame 500*a*, because of a very small twist angle θ as compared with the comparative example, the adhesion of the valve body seal part 265 to the first valve frame seal part 264 is satisfactory.

In this case, when the contact surface distance is X, a clearance between the valve body 261 and the second valve frame 260*b* is Y1, and a clearance between the slide axis of the valve body 261 and the hole of the valve lid 262 is Y2, the twist angle is $\theta=\tan^{-1}(Y1+Y2/X)$.

Moreover, the valve lid 262 is provided with a valve lid weld guide 262*a* as a stepped part (valve lid advancement amount of 0.8 mm) which can abut on the end of the second valve frame 260*b* with the advancement of the valve lid 252 into the second valve frame 260*b*. For this, the diameter of the hole into which the slide axis of the valve body 261 is inserted in the valve lid 262 is set to be smaller than that in the comparative example. Specifically, the positional deviation of the valve lid 262 by the vibration during the ultrasonic welding of the second valve frame 260*b* to the valve lid 262 is reduced by the valve lid weld guide 262*a*, the precision of the center position of the hole in the valve lid 262 can be enhanced. Therefore, the hole diameter of the valve lid 262 can be reduced, the minimum diameter of the urging member 263 can further be reduced, and the valve mechanism can therefore be miniaturized. Moreover, even when the force is applied to the valve lid 262 via the slide shaft of the valve body 261 by the twist of the valve body 261, the rigidity of the valve lid 262 can be secured by the valve lid weld guide 262*a*.

Furthermore, an R part 262*b* is disposed on the ridge of the hole of the valve lid 262. This R part 262*b* is disposed only on the non-welded surface side (right side in FIG. 15) of the hole ridge. According to this constitution, the contact resistance of the slide axis of the valve body 261 with the valve lid 262 can be reduced in the operation of the twisted valve body 261, particularly during valve closing.

Moreover, the end of the valve body 261 abutting on the first valve frame 260*a* forms the valve body seal part 265 of a flat surface. On the other hand, the part abutting on the valve body seal part 265 of the first valve frame 260*a* forms the first valve frame seal part 264 of elastomer 267 disposed inside the first valve frame 260*a*. The seal parts of the valve body 261 and first valve frame 260*a* are flatted in this manner. Therefore, even when the valve body is twisted and abuts, the abutment radius of the R part of the elongated circular valve body 261 agrees with that of the first valve frame 260*a*, and the complete abutment is performed. Furthermore, since the first valve frame seal part 264 is protruded in a tongue shape, the seal during the abutment is secured.

Moreover, when the clearance for sliding is disposed between the valve body 261 and the second valve frame 260*b* in the valve mechanism, in the attaching/detaching operation of the ink tank unit 200, the valve body 261 sometimes rotates centering on its axis in the second valve frame 260*b* as shown in FIG. 10C. In the present embodiment, however, even when the valve body 261 rotates centering on its axis and is urged by the first valve frame 260*a* with a maximum rotation angle, the first valve frame seal part 264 contacts the valve body seal part 265 by the surface, and the closing property of the valve mechanism can be secured.

Furthermore, the elongated hole shapes of the joint port 230 and valve mechanism can minimize the rotation angle of the valve body 261 against the sliding of the valve body 261, the response property of the valve can be enhanced, and the valve mechanism seal property of the joint port 230 can be secured. Moreover, since the joint port 230 and valve mechanism have the elongated hole shapes, in the attaching/detaching operation of the ink tank unit 200, the sealing protrusion 180*a* disposed on the side surface of the joint pipe 180 and valve body 261 quickly slide in the joint port 230, and the stable in connecting operation is performed.

Figure 18A:
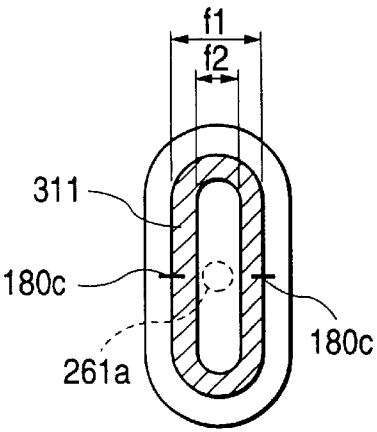
FIGS. 18A, 18B 18C and 18D are explanatory views showing the engagement shape of the valve body with a joint pipe tip end in the valve mechanism of FIG. 15.
Figure 18B:
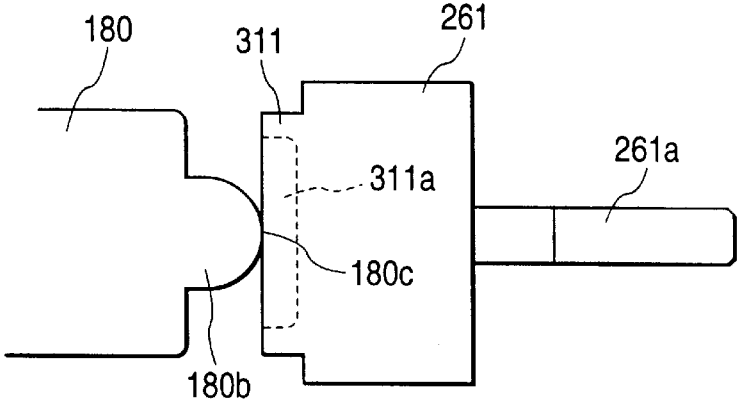
Figure 18C:
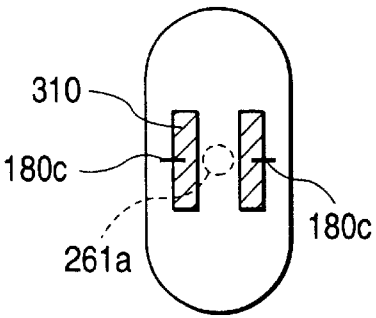
Figure 18D:
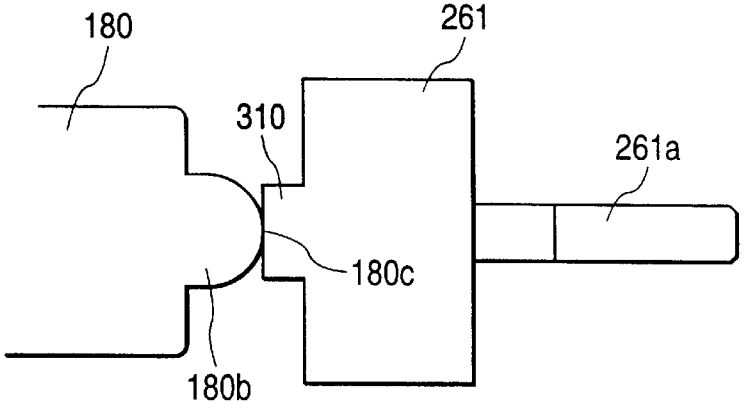

Furthermore, as shown in FIG. 11, the abutment end of the joint pipe 180 with the valve body 261 is provided with two opposite valve opening/closing protrusions 180*b* which form the upper opening 181*a* and lower opening 181*b* for gas-liquid exchange and liquid supply. Therefore, as shown in FIGS. 18C and 18D, it is proposed that two abutment ribs 310 be disposed opposite to the protrusions 180*b* in the place of the valve body 261 abutting on the protrusion 180*b* except the valve body seal part 265 closely abutting on the first valve frame seal part 264. However, since the valve body 261 is pushed back against the pressing force of the urging member 263 during valve opening, the rib part requires rigidity to such an extent that the part fails to be deformed. Moreover, for the arrangement and shape of the abutment rib part, even when the position of the abutment rib part of the valve body 261 deviates around the axis of the slide shaft 261*a* of the valve body 261 with respect to two valve opening/closing protrusions 180*b* of the joint pipe 180, moments applied to two abutment positions centering on the slide shaft 261*a* need to be offset from the viewpoint of reliability. To solve the problem, in the present embodiment, as shown in FIGS. 18A and 18B, the valve body 261 is provided with an annular rib 311 with a shape (e.g., width of 0.6 mm, height of 1.3 mm) analogous to the elongated hole shape of the joint pipe 180. In other words, an elongated hole shaped recess 311*a* is disposed in the middle part of the valve body 261 except the valve body seal part 265 closely abutting on the first valve frame seal part 264. According to he constitution, the valve body 261 is provided with the strength and reliability during abutment on the valve opening/closing protrusion 180*b*. Additionally, the annular shape of the rib and the recess in the middle part enhance the molding property of the valve body. Moreover, in this respect, the area of the annular rib on the side on which the recess of the rib base end is formed is preferably provided with a micro curved surface.

Moreover, as shown in FIGS. 2, 4A, 4B, for the ink tank unit 200, after the valve mechanism including the first valve frame 260*a* and second valve frame 260*b* is inserted into the supply port of the ink container 201, the ID member 250 is assembled by welding and joining. Particularly, the inner bag 220 is exposed in the opening edge surface of the supply port of the ink container 201, a flange part 268 of the first valve frame 260*a* of the valve mechanism is welded to the inner bag exposed part 221*a*, and further the ID member 250 is welded to the place of the flange part 268 and engages with the engagement part 210*a* of the tank housing 210.

In the assembly form, for example, when a first valve frame flange part 508 bonded to an ID member 550 is flat as in the comparative example of FIG. 12, no elastomer 567 exists inside the supply port disposed in the ID member 550, and there is a fear of seal leakage during the connecting operation of the joint pipe 180 shown in FIG. 6. Therefore, in the present embodiment, the welded surface of the first valve frame flange part 508 on the ID member 550 present on the same plane as that of the opening surface of the joint port 530 is disposed behind opposite the tank mounting side. Specifically, when the ID member 250 is bonded to the first valve frame flange part 268 as shown in FIGS. 2 and 15, the first valve frame flange part 268 is disposed so that the outer surface of the ID member 250 is aligned with the opening surface of the joint port 230. According to this constitution, since the elastomer 267 surely exists inside the supply port disposed in the ID member 250, the valve mechanism is high in reliability without any fear of the seal leakage. Moreover, since the first valve frame flange part 268 deviates from the opening surface of the joint port 230, the opening part of the joint port 230 is protruded from the flange surface of the first valve frame flange part 268. Therefore, during the assembling of the ID member 250, the position of the ID member 250 is guided by the opening part of the joint port 230 and the positioning is facilitated.

Furthermore, the respective ink containers 201 of the ink tank unit 200 according to the present embodiment are mounted in the holder 150, and the liquid supply is performed for the respective negative pressure control chambers 110 through the joint pipe 180 and the valve mechanism of the joint port 230 of the container 201. The holder 150 with the ink containers 201 attached thereto in this manner is mounted on the carriage and reciprocated/moved parallel to the record sheet in a serial scan type recording device described later (see FIGS. 29A, 29B). In this case, it is preferable from the viewpoint of product reliability to take a preventive measure so that the seal state of the inner side surface of the joint port 230 of the ink container 201 with the outer side surface of the joint pipe 180 of the negative pressure control chamber container 110 is prevented from being deteriorated by the twist of the connection part because of the axis deflection of the joint pipe 180 during carriage reciprocating movement and the positional deviation of the ink container 201.

For this purpose, in the present embodiment, by setting the thickness of the elastomer 267 inside the first valve frame 260*a* of the valve mechanism shown in FIGS. 2 and 15 to be larger than the minimum thickness necessary for simply sealing a gap between the first valve frame 260*a* and the joint pipe 180, the shaft deflection and twist of the joint pipe connection part during the carriage reciprocating movement are inhibited by the elastomer deflection, and a more reliable seal is secured. Moreover, another measure comprises raising the rigidity of the valve frame into which the joint pipe 180 is inserted to be higher than the rigidity of the joint pipe 180, and inhibiting the valve frame deformation by the axis deflection and twist of the connection part of the joint pipe during the carriage reciprocating movement to secure the more reliable seal.

The respective component dimensions to realize the above-described valve mechanism will next be described with reference to FIGS. 11, 18A to 18D, 19.

Figure 19:
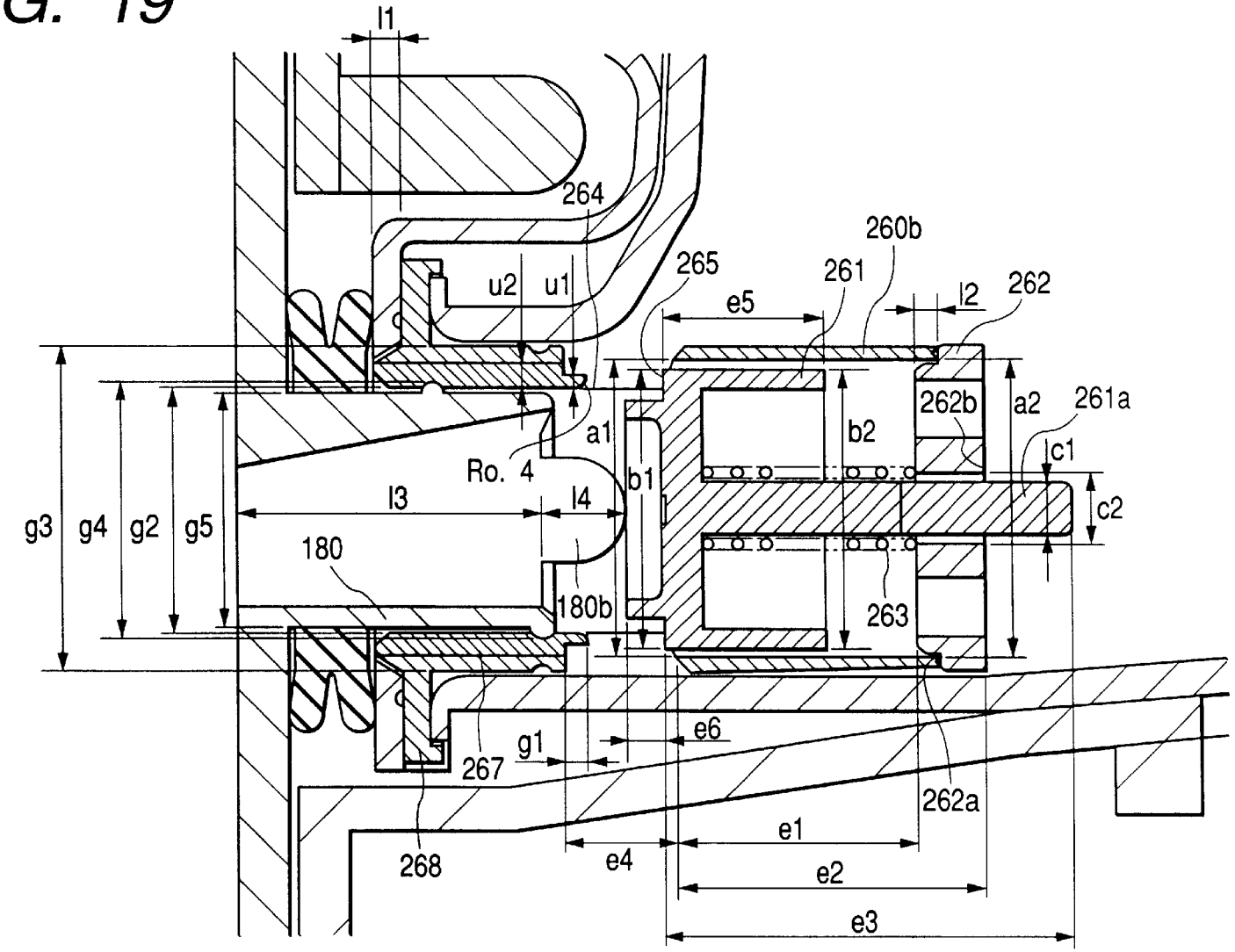
FIG. 19 is an explanatory view showing the dimensions of constituting components in the connection place of the ink tank unit applicable to the present invention.

In FIG. 19, length e5 of the valve body 261 in the longitudinal direction is 5.7 mm, length e3 from the valve body seal part 265 to the valve body slide shaft 261*a* is 14.4 mm, length e1 from the second valve frame 260*b* to the inner side surface of the valve lid 262 is 8.7 mm, length e2 from the second valve frame 260*b* to the outer side surface of the valve lid 262 is 11.0 mm, length e4 of the opening between the first valve frame 260*a* and the second valve frame 260*b* is 3.0 mm, protrusion amount e6 of the rib part from the seal part 265 of the valve body 261 is 1.3 mm, length 12 of the valve lid weld guide 262*a* is 0.8 mm, length b1 of the seal part 265 of the valve body 261 in the longitudinal direction is 9.7 mm, length b2 of the valve body 261 on the side of the valve lid 262 in the longitudinal direction is 9.6 mm, length a1 of the second valve frame 260*b* on the side of the first valve frame 260*a* in the longitudinal direction is 10.2 mm, length a2 of the second valve frame 260*b* on the side of the valve lid 262 in the longitudinal direction is 10.4 mm, shaft diameter c1 of the valve body slide shaft 261*a* is 1.8 mm, hole diameter c2 of the valve lid 262 into which the valve body slide shaft 261*a* is inserted is 2.4 mm, the length of a spring as the urging member 263 is 11.8 mm (spring constant: 1.016 N/mm), the R part 262*b* of the valve lid 262 has R 0.2 mm (entire periphery), length g1 of the first valve frame seal part 264 as a part of the elastomer 267 is 0.8 mm, the R part of the first valve frame seal part 264 has R 0.4 mm, thickness u1 of the first valve frame seal part 264 is 0.4 mm, thickness u2 of the elastomer 267 is 0.8 mm, inner diameter g2 of the elastomer 267 in the longitudinal direction is 8.4 mm, outer diameter g3 of the first valve frame 260*a* in the longitudinal direction is 10.1 mm, outer diameter g5 of the joint pipe 180 in the longitudinal direction is 8.0 mm, outer diameter g4 of the joint pipe 180 including the sealing protrusion 180*a* in the longitudinal direction is 8.7 mm, retreat amount 11 of the first valve frame flange part 268 is 1.0 mm, length 13 of the joint pipe 180 is 9.4 mm, and length 14 of the valve opening/closing protrusion 180*b* is 2.5 mm.

The length g1 of the first valve frame seal part 264 is set to 0.8 mm, but an amount by which the first valve frame seal part 264 abutting on the valve body seal part 265 is bent and protruded from the valve frame, and by which the seal can be completed is preferable. Therefore, the length g1 of the first valve frame seal part 264 is preferably in a range $(g3-g2)/2>g1>(b1-g2)/2$.

For the dimensions of the valve opening/closing protrusion 180*b* of the joint pipe 180 and the rib 311 of the valve body 261 in the abutment relation shown in FIGS. 11 and 18A to 18D, thickness t of the joint pipe 180 and rib 311 is 0.75 mm, inner interval f3 between the opposite valve opening/closing protrusions 180*b* is 1.7 mm, outer interval f4 between the valve opening/closing protrusions 180*b* is 3.2 mm, outer interval f1 between the elongated hole shaped ribs 311 of the valve body 261 in a short direction is 2.6 mm, inner interval f2 between the ribs 311 in the short direction is 1.4 mm, and length d of the rib 311 is 3.6 mm.

Moreover, for the inner elastomer 267 of the elongated hole shaped first valve frame 260*a*, from a viewpoint of molding precision, the thickness u2 of the circumferential part of the elongated hole shape is preferably the same as that of a linear part. Moreover, in the vertical direction of the joint port 230, a bite amount for sealing a gap between the elastomer 267 and the maximum diameter part of the joint pipe 180 (the place including the sealing protrusion 180*a*) is g4−g2=0.3 mm, and this amount is absorbed by the elastomer 267. In this case, the substantial thickness for absorption is 0.8 mm×2=1.6 mm, but the bite amount is 0.3 mm, and therefore much force is not necessary for the deformation of elastomer 267. On the other hand, also in the lateral direction of the joint port 230, the sealing bite amount is set to 0.3 mm, and absorbed by the elastomer 267 with the substantial thickness of 0.8 mm×2=1.6 mm. Here, in the vertical direction the outer diameter g5 of the joint pipe<the inner diameter g2 of the elastomer in the longitudinal direction, similarly in the lateral direction g5<g2. Therefore, in the state shown in FIG. 19, since the elastomer abuts only on the sealing protrusion 180*a* of the joint pipe, smooth insertion and secure seal with the connection part can be performed. The looseness of the ink container 201 in the holder 150 in the lateral direction may preferably be in a range absorbed by the thickness of the elastomer (±0.8 mm in the present embodiment), and the tolerance range of the looseness in the present embodiment is ±0.4 mm at maximum. Here, in the present embodiment, when the looseness amount in the lateral direction (the deviation amount from the center position) is larger than the half of the absolute value of a difference between the outer diameter g5 of the joint pipe and the inner diameter g2 of the elastomer in the longitudinal direction (i.e., when the looseness in the lateral direction in the present embodiment is ±0.2 mm or more), the outer wall of the joint pipe other than the sealing protrusion 180*a* extensively abuts on and presses the elastomer, so that a force for returning to the center position is exerted by the elastomer elastic force.

The above-described dimensions can realize the valve mechanism which produces the above-described effects.

<Effect by Arrangement Place of Valve Mechanism>

Moreover, in the ink jet head cartridge of the present embodiment, the valve lid 262 and second valve frame 260*b* in the valve mechanism attached to the joint port 230 of the ink tank unit 200 deeply advance into the inner bag 220. Therefore, for the deformation of the inner bag 220 with the consumption of the ink in the inner bag 220, even when the part in the vicinity of the joint port 230 in the inner bag 220 is stripped from the housing 210, the deformation of the part in the vicinity of the joint port 230 in the inner bag 220 is regulated by the part of the valve mechanism inserted deeply into the inner bag 220, that is, the valve lid 262 and second valve frame 260*b*. Even when the inner bag 220 is deformed with the ink consumption, the deformation of the part of the inner bag 220 in the vicinity of the valve mechanism, and the periphery is regulated by the valve mechanism, and the ink flow path in the periphery of the valve mechanism in the inner bag 220, and the bubble path for raising the bubble during the gas-liquid exchange operation are therefore secured. Consequently, the ink supply to the negative pressure control chamber unit 100 from the inner bag 220 during the deformation of the inner bag 220, and the bubble rising in the inner bag 220 fail to be obstructed.

In the ink tank unit 200 provided with the above-described deformable inner bag 220, and the ink jet head cartridge provided with the negative pressure control chamber unit 100, in order to deform the inner bag 220 as much as possible and perform the gas-liquid exchange operation between the ink tank unit 200 and the negative pressure control chamber unit 100, it is preferable to balance the negative pressure in the inner bag 220 with the negative pressure in the negative pressure control chamber container 110 so that the buffer space in the housing 210 is increased. Moreover, for the high-speed ink supply, the joint port 230 of the ink tank unit 200 may be enlarged. Of course, it is preferable to make a large space in the area in the vicinity of the joint port 230 in the inner bag 220 and sufficiently secure the ink supply path in the area.

When the deformation of the inner bag 220 is enlarged to secure the buffer space in the housing 210 for containing the inner bag 220, the space in the vicinity of the joint port 230 in the inner bag 220 is usually narrowed with the deformation of the inner bag 220. When the space in the vicinity of the joint port 230 in the inner bag 220 is narrowed, the rising of the bubble in the inner bag 220 is obstructed, the ink supply path in the vicinity of the joint port 230 is reduced, and the high-speed ink supply is possibly impossible. Therefore, as in the ink jet head cartridge of the present embodiment, when the valve mechanism does not deeply enter the inner bag 220, and the deformation of the part of the inner bag 220 in the periphery of the joint port 230 is not regulated, in order to perform the high-speed ink supply, the deformation amount of the inner bag 220 is depressed to such an extent that no large influence is exerted on the ink supply, and the negative pressure in the inner bag 220 has to be balanced with the negative pressure in the negative pressure control chamber container 110.

On the other hand, in the present embodiment, the valve mechanism deeply enters the inner bag 220 as described above, and the valve mechanism regulates the deformation of the part of the inner bag 220 in the vicinity of the joint port 230. Even when the deformation of the inner bag 220 is enlarged, the area in the vicinity of the joint port 230 in the inner bag 220, that is, the ink supply path communicating with the joint port 230 can sufficiently be secured. Therefore, both the establishment of a large buffer space in the housing 210 and the ink supply with a high flow rate can be realized.

Moreover, an electrode 270 for use as ink residual amount detection means for detecting the ink residual amount in the inner bag 220 as described later is disposed below the bottom of the ink tank unit 200 in the above-described ink jet head cartridge. The electrode 270 is fixed to the printer carriage to which the holder 150 is attached. Here, the joint port 230 attached to the valve mechanism is disposed below the front end of the ink tank unit 200 on the side of the negative pressure control chamber unit 100, and the valve mechanism is inserted deeply into the inner bag 220 substantially parallel to the bottom surface of the ink tank unit 200. Therefore, during the deformation of the inner bag 220, the deformation of the bottom part of the inner bag 220 is regulated by the deeply inserted part of the valve mechanism. Furthermore, since a part of the bottom of the ink container 201 comprising the housing 210 and inner bag 220 is inclined, the deformation of the bottom part of the inner bag 220 is also regulated during the deformation of the inner bag 220. In addition to the effect that the deformation of the bottom of the inner bag 220 is regulated by the inclined bottom of the ink container 201, when the deformation of the bottom of the inner bag 220 is further regulated by the valve mechanism, the movement of the bottom of the inner bag 220 with respect to the electrode 270 is regulated, and more precise ink residual amount detection is possible. Therefore, by regulating the deformation of the part of the inner bag 220 in the vicinity of the joint port 230 by the valve mechanism as described above, both the obtaining of the large buffer space in the housing 210 by the enlarged deformation of the inner bag 220 and the ink supply with the high flow rate are established, and further the precise ink residual amount detection is possible in the liquid supply method.

In the present embodiment, the valve mechanism deeply enters the inner bag 220 so that the part of the inner bag 220 in the vicinity of the joint port 230 is regulated as described above, but the deformation of the part of the inner bag 220 may be regulated by advancing a separate member other than the valve mechanism into the inner bag 220. Moreover, the deformation of the part in the vicinity of the electrode 270 in the bottom of the inner bag 220 may be prevented by advancing a plate member or the like into the inner bag 220 from the joint port 230, and extending the plate member along the bottom surface in the inner bag 220. Thereby, during the detection of the ink residual amount in the inner bag 220 using the electrode 270, more precise ink residual amount detection can be performed.

Furthermore, in the present embodiment, in the valve mechanism attached to the joint port 230, the constituting component of the valve mechanism advances into the inner bag 220 deeper than the opening 260*c* which communicates with the joint port 230 and forms the ink flow path. Thereby, the ink tank unit 200 is constituted so that the ink flow path in the vicinity of the joint port 230 can certainly be secured in the inner bag 220.

<Manufacture Method of Ink Tank>

Figure 20C:
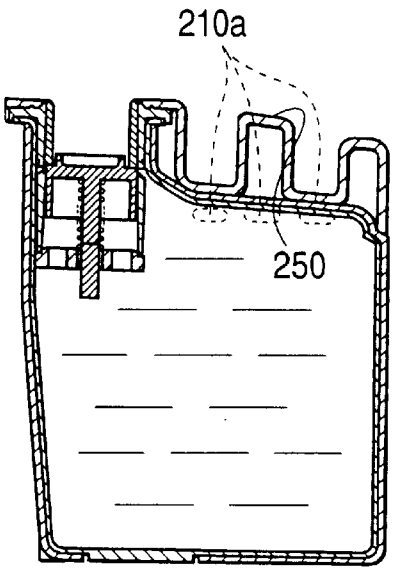
FIGS. 20A, 20B and 20C are explanatory views showing a method of manufacturing an ink tank applicable to the present invention.

A method of manufacturing the ink tank of the present embodiment will next be described with reference to FIGS. 20A to 20C. As shown in FIG. 20A, the method first comprises directing the inner bag exposed part 221*a* of the ink container 201 upward in the gravity direction, and injecting an ink 401 into the ink container 201 from an ink supply opening by an ink injection nozzle 402. In the constitution of the present invention the ink injection is possible under the atmospheric pressure.

Figure 20B:
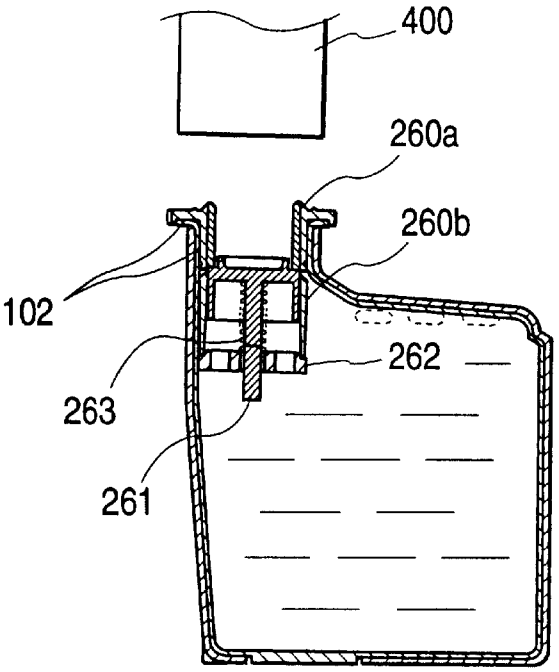
Figure 20A:
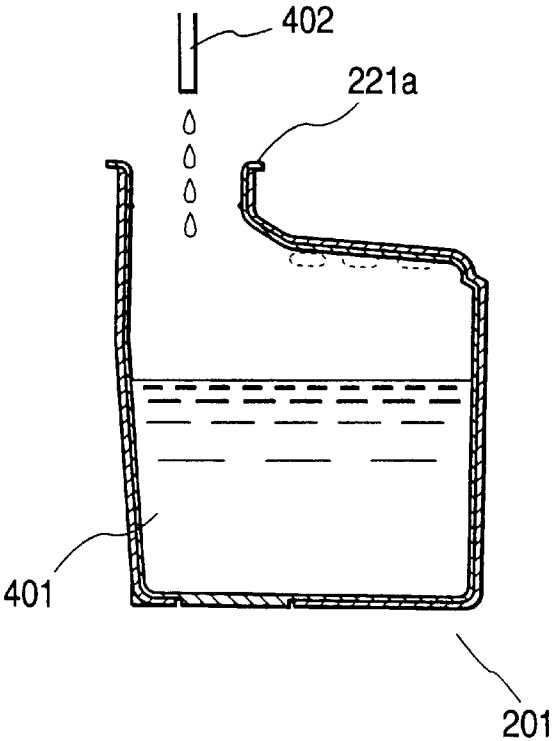

Subsequently, as shown in FIG. 20B, after assembling the valve body 261, valve lid 262, urging member 263, first valve frame 260*a*, and second valve frame 260*b* beforehand, this valve unit is dropped into the supply port part of the ink container 201.

In this case, the outer peripheral part of the sealed surface 102 of the ink container 201 is surrounded with the stepped shape outside the welded surface of the first valve frame 260*a*, the positions of the ink container 201 and first valve frame 260*a* are determined, and the position precision can be achieved. Subsequently, by applying a welding hone to the outer peripheral part of the joint port 230 of the first valve frame 260*a* from above, and welding the first valve frame 260*a* to the inner bag 220 of the ink container 201 with the sealed surface 102, the welded secure seal is simultaneously achieved between the first valve frame 260*a* and the housing 210 of the ink container 201 in the outer peripheral part of the sealed surface 102. Additionally, the present invention can also be applied in ultrasonic welding and vibration welding. Moreover, the present invention can also be applied to thermal welding, adhesive, and the like.

Subsequently, as shown in FIG. 20C, the ink container 201 welded to the first valve frame 260*a* is capped with the ID member 250. In this case, at the same time when the engagement parts 210*a* formed on the housing side surface of the ink container 201 engage with the click part 250*a* of the ID member 250, the first valve frame 260*a* is held by the housing 210 positioned opposite to the sealed surface 102 of the ink container 201, and the click part 250*a* on the lower surface of the ID member 250 also engages (see FIGS. 4A, 4B).

<Detection of Ink Residual Amount in Tank>

The detection of the ink residual amount in the ink tank unit will next be described.

As shown in FIG. 2, below the area of the holder 150 to which the ink tank unit 200 is attached, the plate-like electrode 270 having a width narrower than the width (in the depth direction of FIG. 2) of the ink container 201 is disposed. The electrode 270 is fixed to the printer carriage (not shown) attached to the holder 150, and connected to a printer electric control system via a wiring 271.

On the other hand, the ink jet head unit 160 is provided with an ink flow path 162 communicating with the ink supply tube 165, a plurality of nozzles (not shown) provided with energy generating elements for generating an ink discharge energy, and a common liquid chamber 164 for temporarily holding the ink supplied from the ink flow path 162 and supplying the ink to the respective nozzles. The energy generating element is connected to a connection terminal 281 disposed on the holder 150. When the holder 150 is attached to the carriage, the connection terminal 281 is connected to the printer electric control system. A recording signal from a printer is transmitted to the energy generating element via the connection terminal 281, and the ink is discharged from a discharge port as a nozzle opening end by driving the energy generating element to apply the discharge energy to the ink in the nozzle.

Moreover, in the common liquid chamber 164, an electrode 290 is similarly connected to the printer electric control system via the connection terminal 281. These two electrodes 270, 290 constitute the ink residual amount detection means in the ink container 201.

Additionally, in the present embodiment, in order to perform the detection of the ink residual amount by the ink residual amount detection means, the joint port 230 of the ink tank unit 200 is disposed in the lower end of the surface of the ink container 201 held by the maximum area surface in the use state shown in FIG. 2. Moreover, a part of the bottom surface of the ink container 201 is inclined with respect to the horizontal surface in the use state. Concretely, the end of the side on which the joint port 230 of the ink tank unit 200 is disposed is used as a front end, the opposite end is used as a rear end, then the surface in the vicinity of the front end part provided with the valve mechanism is parallel to the horizontal surface, and the area to the rear end comprises an inclined surface ascending toward the rear end from the front end. In consideration of the deformation of the inner bag 220 described later, the inclination angle of the bottom surface of the ink container 201 is preferably an obtuse angle formed with the rear end surface of the ink tank unit 200, and set to 95 degrees or more in the present embodiment.

Moreover, in accordance with the shape of the bottom surface of the ink container 201, the electrode 270 is disposed opposite to the inclined area of the bottom surface of the ink container 201 and parallel to the inclined area.

The ink residual amount detection in the ink container 201 by the ink residual amount detection means will be described hereinafter.

The ink residual amount detection is performed by applying a pulse voltage between the electrode 270 on the side of the holder 150 and the electrode 290 in the common liquid chamber 164, and detecting capacitance (electrostatic capacity) which changes in accordance with the opposite area of the electrode 270 and ink. For example, by applying a rectangular wave pulse voltage with a peak value of 5V between the electrodes 270 and 290 at a pulse frequency of 1 kHz, and calculating/processing a time constant and gain of the circuit, the presence/absence of the ink in the ink container 201 can be detected.

When the ink residual amount in the ink container 201 decreases by the ink consumption, the ink surface descends toward the bottom surface of the ink container 201. Furthermore, when the ink residual amount decreases and the ink surface reaches the inclined area of the bottom surface of the ink container 201, with the ink consumption, the opposite area of the electrode 270 and ink gradually decreases (the distance between the electrode 270 and the ink is substantially constant) and the capacitance starts to decrease.

Finally, no ink exists in the site opposite to the electrode 270, the gain drop and the rise of electric resistance by the ink can be detected by changing the pulse width of the applied pulse or changing the pulse frequency to calculate the time constant, and it is then judged that the ink in the ink container 201 is very little.

The detection of the ink residual amount has been briefly described above, in practice the ink container 201 of the present embodiment is constituted of the inner bag 220 and housing 210, with the ink consumption, the gas-liquid exchange is performed between both and air is introduced between the housing 210 and inner bag 220 via the outside air communication port 222 in order to balance the negative pressure in the negative pressure control chamber container 110 with the negative pressure in the ink container 201, and the inner bag 220 is deformed inward in an inner volume decrease direction.

During the deformation, as shown in FIG. 7, the inner bag 220 is regulated by the corner of the ink container 201 and deformed. The deformation of the inner bag 220, that is, the stripping or detaching from the housing 210 is performed most between two surfaces as the maximum area surface (the surface substantially parallel to the section shown in FIG. 7.) and least on the bottom surface as the surface adjacent to the maximum area surface. However, with the deformation of the inner bag 220, the distance between the ink and the electrode 270 increases, and the capacitance decreases to be inversely proportional to the distance. However, in the present embodiment, the main area of the electrode 270 is present on the surface substantially crossing at right angles to the deformation direction of the inner bag 220. Even when the inner bag 220 is deformed, the electrode 270 is maintained substantially parallel to the vicinity area of the bottom of the inner bag 220. As a result, the area for forming the electrostatic capacity is secured and the secure detection is possible. Moreover, as described above, in the present embodiment since the corner angle formed by the bottom surface of the ink container 201 and the rear end surface constitutes the obtuse angle of 95 degrees or more, the inner bag 220 is more easily detached from the housing 210 as compared with other corner parts. As a result, even when the inner bag 220 is deformed toward the joint port 230, the ink is easily discharged toward the joint port 230.

The constitutions of the present invention have been individually described above, but these constitutions can appropriately be combined, and further effect can be obtained by the combination.

For example, by combining the elongated circle constitution and the valve constitution to form the joint part, the sliding during attachment/detachment is stabilized, and securer valve opening/closing is also possible. Moreover, with the elongated circular shape, the ink supply amount can securely be enhanced. In this case, the support point for rotation mounting shifts upward, but the ink tank bottom surface is inclined upward, and stable attaching/detaching operation is therefore possible with little twist.

As described above, the constitution of the present embodiment is other than the conventional constitution, the constitution is effective alone, and the respective constituting elements bring about an organic constitution in a composite manner. Specifically, the above-described constitutions are superior inventions alone or in the composite manner, and disclose the preferred constitutional examples for the present invention.

<Ink Jet Head Cartridge>

Figure 25:
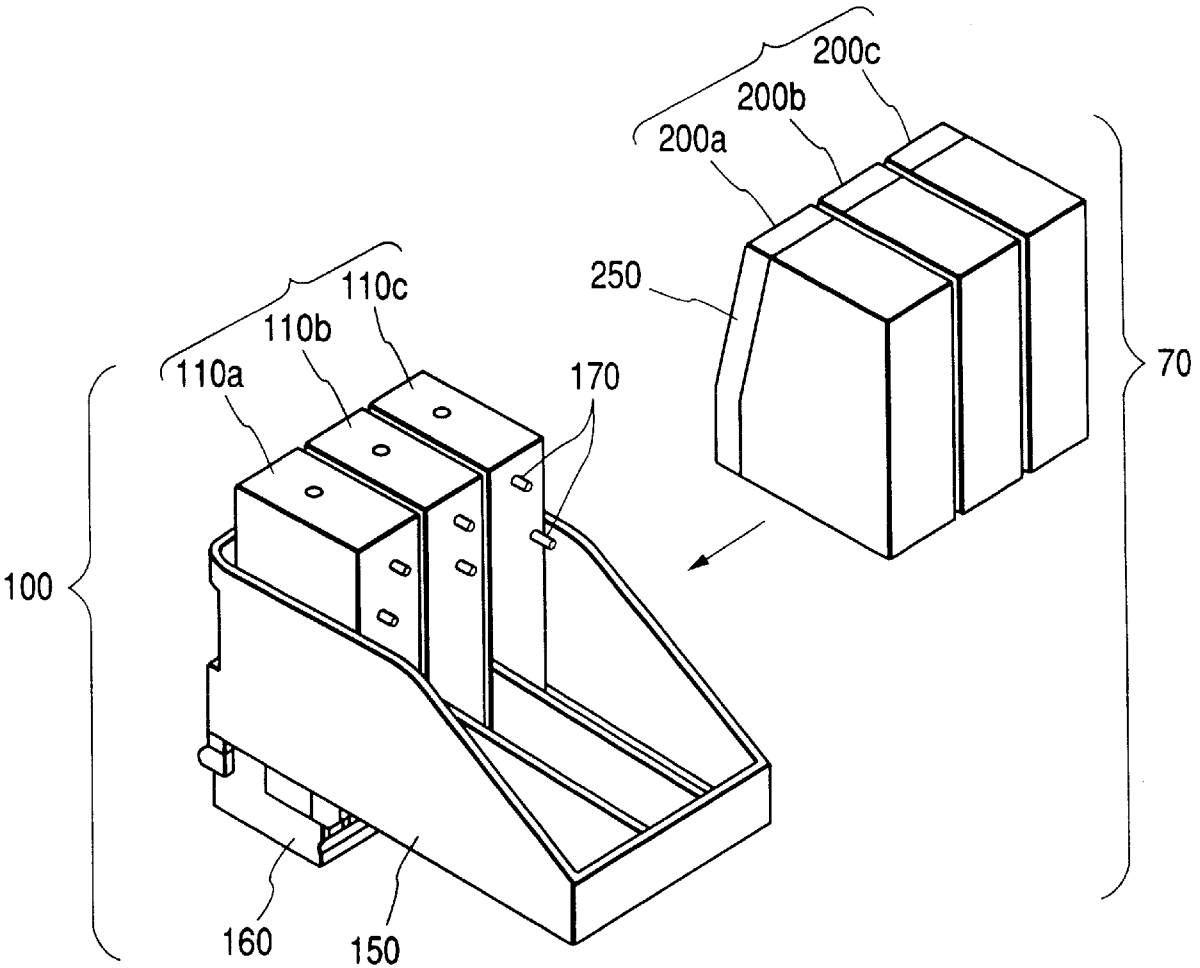
FIG. 25 is a schematic explanatory view of the ink jet head cartridge using the ink tank unit applicable to the present invention.

FIG. 25 is a schematic explanatory view of the ink jet head cartridge using the ink tank unit applicable to the present invention.

The ink jet head cartridge 70 shown in FIG. 25 is provided with the negative pressure control chamber unit 100 in which the ink jet head unit 160 able to discharge a plurality of types of liquids (three colors of yellow (Y), magenta (M), and cyan (C) in the present embodiment) is integrally formed with negative pressure control chamber containers 110*a*, 110*b*, 110*c* for containing the respective liquids, and ink tank unit 200*a*, 200*b*, 200*c* for containing the respective liquids are detachably attached to the negative pressure control chamber unit 100.

In the present embodiment, in order to correctly attach the respective ink tank units 200*a*, 200*b*, 200*c* to the corresponding negative pressure control chamber containers 110*a*, 110*b*, 110*c*, the holder 150 is disposed to cover a part of the outer surface of the ink tank unit 200, the ID member 250 having the recess is disposed on the mounting direction front surface of the ink tank unit 200, and the negative pressure control chamber container 110 is provided with the protruded ID member 170 to be disposed opposite to the recess of the ID member 250, so that the incorrect mounting is securely prevented.

In the present invention, needless to say the types of the contained liquids may be of other colors except Y, M, C, and needless to say the number and combination of liquid containers are also arbitrary (e.g., only the black (Bk) is contained in a single tank, and other Y, M, C are contained in an integral tank).

As described above, for the joint pipe 180 of the negative pressure control chamber container 110 of the present embodiment, since the introduction of gas into the ink container 201 from the negative pressure control chamber container 110 is promoted, the retention and accumulation of the bubble in the joint pipe 180 can be prevented, and the ink can stably be supplied to the negative pressure control chamber container 110 from the ink container 201.

Second Embodiment

Figure 26:
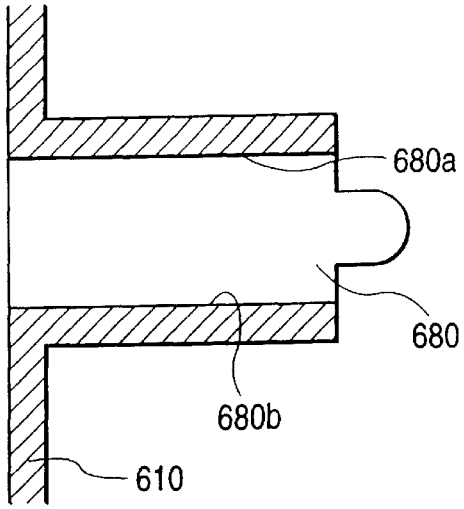
FIG. 26 is an enlarged side sectional view of the joint pipe of the negative pressure control chamber container according to a second embodiment of the present invention.

Next, FIG. 26 is an enlarged side sectional view in the vicinity of a joint pipe 680 of a negative pressure control chamber container 610 of a second embodiment.

The second embodiment is basically similar to the first embodiment except that the upper surface in the joint pipe 680 is a water repellent surface 680*a* subjected to water repellent treatment by applying a water repellent, the surface is horizontal (disposed on the right side of the negative pressure control chamber container 610 in FIG. 26) instead of inclining upward to the ink container (not shown) from the negative pressure control chamber container 610, and a lower surface is a hydrophilic surface 680*b* subjected to hydrophilic treatment by applying a hydrophilic agent, and the detailed description is therefore omitted.

In this manner, since the upper part of the joint pipe 680 functions mainly as the atmosphere introduction path, and the lower part functions mainly as the ink supply path, the functions are separated in the joint pipe 680. Since the fluidity of the bubble during the gas-liquid exchange is enhanced by the water repellent effect of the water repellent surface 680*a* in contact with the bubble, the bubble can be prevented from being retained or accumulated in the joint pipe 680.

Additionally, the water repellent surface 680*a* of the present embodiment may have a higher water repellent effect than that of the surface other than the water repellent surface 680*a* of the joint pipe 680, and for example, the lower surface may not be subjected to the hydrophilic treatment.

A Moreover, the upper wall surface of the joint pipe 680 shown in FIG. 26 is a horizontal wall surface without any inclination, but is not limited to this, and may incline upward to the ink container from the negative pressure control chamber container 610 similarly as the first embodiment. As described above, since the joint pipe 680 of the negative pressure control chamber container 610 of the present embodiment promotes the introduction of gas to the ink container from the negative pressure control chamber container 610, the bubble is prevented from being retained or accumulated in the joint pipe 680 similarly as the first embodiment. Since the liquid flow can be promoted, the ink can stably be supplied to the negative pressure control chamber container 610 from the ink container.

Third Embodiment

Figure 27A:
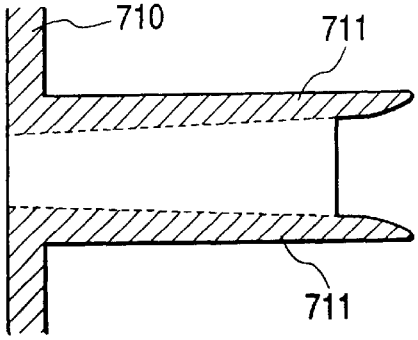
FIGS. 27A and 27B are an enlarged plan sectional view, an enlarged side sectional view and a front view of the joint pipe in the negative pressure control chamber container according to a third embodiment of the present invention.
Figure 27B:
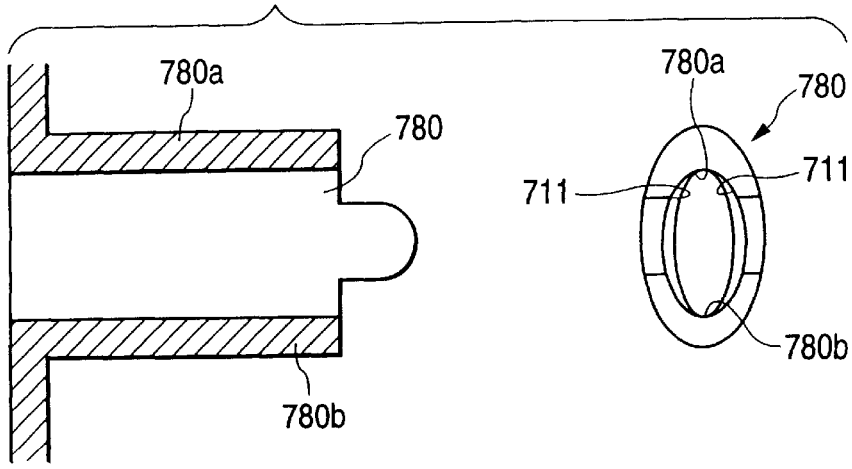

Next, FIG. 27A is an enlarged sectional plan view in the vicinity of a joint pipe 780 of a negative pressure control chamber container 710 of a third embodiment, and FIG. 27B shows an enlarged side sectional view and front view in the vicinity of the joint pipe 780.

The third embodiment is basically similar to the first embodiment except that a side wall surface 711 is tapered and expanded toward the ink container (not shown) front the negative pressure control chamber container 710 (disposed on the right side of the negative pressure-control chamber container 710 in FIGS. 27A, 27B) and an upper wall surface 780*a* is a horizontal wall surface without any inclination, and the detailed description is therefore omitted.

As described above, a side wall surface 711 of the joint pipe 780 is of the tapered shape so that the flow path sectional area is gradually enlarged in the lateral direction toward the ink container from the negative pressure control chamber container 710, the influence of the side wall surface 711 on the ink decreases toward the ink container, and the ink fluidity is therefore enhanced. Thereby, the bubble fluidity is also enhanced, no bubble is retained or accumulated in the joint pipe 780 during gas-liquid exchange, and the bubble in the joint pipe 780 flows to the ink container from the negative pressure control chamber container 710.

Additionally, in FIGS. 27A, 27B, the tapered shape of the joint pipe 780 is formed only by the side wall surface 711, but is not limited to this, and additionally both the upper wall surface 780*a* and lower wall surface 780*b* may be expanded to the ink container from the negative pressure control chamber container 710 and tapered, or the upper wall surface 680*a* may have the tapered shape formed by inclining upward to the ink container from the negative pressure control chamber container 710, or as in the second embodiment the upper wall surface 780*a* may be subjected to water repellent treatment in order to relatively enhance the water repellent effect as compared with the other surfaces of the joint pipe 780.

As described above, the joint pipe 780 of the negative pressure control chamber container 710 of the present embodiment promotes the gas introduction into the ink container from the negative pressure control chamber container 710, the bubble can be prevented from being retained or accumulated in the joint pipe 780 similarly as the first and second embodiments, and the ink can therefore stably be supplied to the negative pressure control chamber container 710 from the ink container.

Fourth Embodiment

Figure 28A:
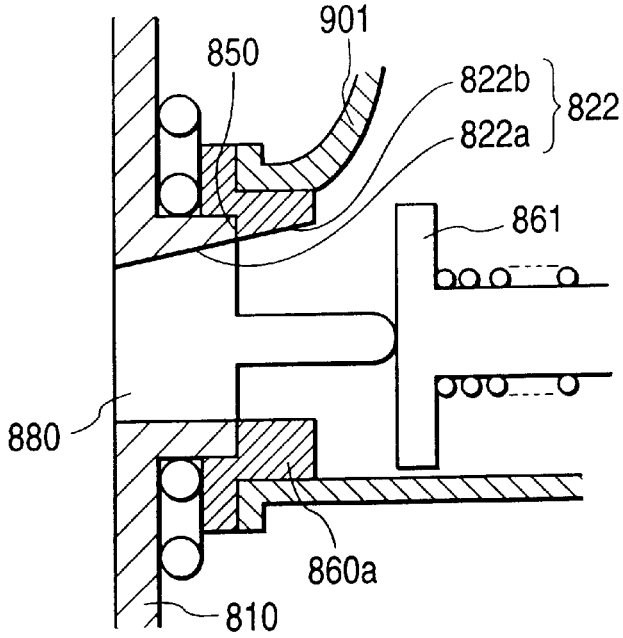
FIGS. 28A and 28B are enlarged side sectional views of the joint pipe of the negative pressure control chamber container according to a fourth embodiment of the present invention.
Figure 28B:
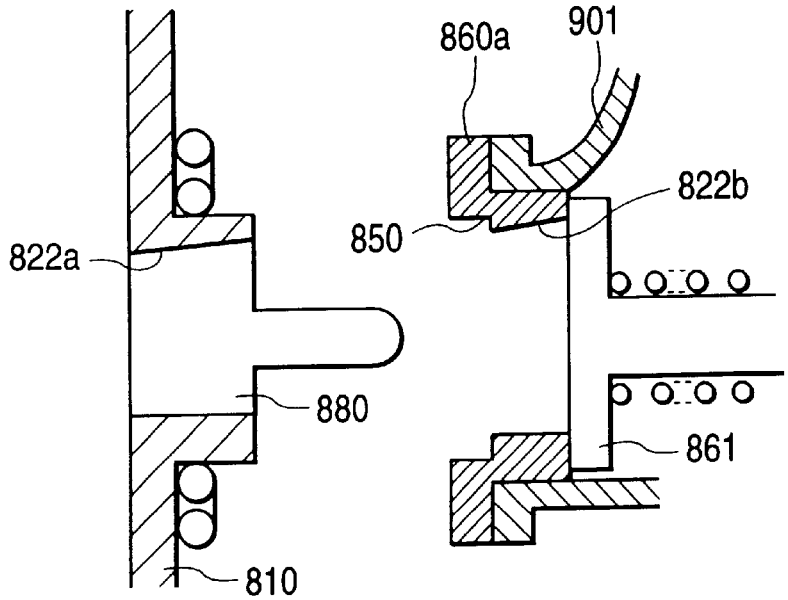

Next, FIG. 28A is an enlarged side sectional view in the vicinity of a joint pipe 880 and a first valve frame 860*a* when a negative pressure control chamber container 810 is bonded to an ink container 901 according to a fourth embodiment, and FIG. 28B is an enlarged side sectional view in the vicinity of the joint pipe 880 and first valve frame 860*a* when the negative pressure control chamber container 810 shown in FIG. 28A is separated from the ink container 901. Additionally, in FIGS. 28A and 28B, the second valve frame for guiding the slide of a valve body 861 is omitted.

The joint pipe 880 and first valve frame 860*a* are shaped to engage with each other. Specifically, the length of the joint pipe 880 is shorter than those of the joint pipes of the first to third embodiments, and the first valve frame 860*a* is provided with a recess 850 so that the tip end of the joint pipe 880 can engage. Moreover, an upper wall surface 822*a* of the joint pipe 880 is inclined upward to the ink container 901 from the negative pressure control chamber container 810, and an upper wall surface 822*b* of the first valve frame 860*a* is similarly inclined. Since the other respects are similar to those of the first embodiment, the detailed description is omitted.

As shown in FIG. 28A, since the joint pipe 880 engages with the first valve frame 860*a*, an upper wall surface 822 is formed so that the upper wall surface 822*a* of the joint pipe 880 is smoothly connected to the upper wall surface 822*b* of the first valve frame 860*a* and the upper wall surface 822 is inclined upward to the ink container 901 from the negative pressure control chamber container 810. Therefore, during the gas-liquid exchange performed via the joint pipe 880 and first valve frame 860*a*, a partial force of buoyancy directed parallel to the upper wall surfaces 822*a* and 822*b* and toward the ink container 901 from the negative pressure control chamber container 810 is generated in the bubble in contact with the upper wall surfaces 822*a* and 822*b*. Since the partial force in the direction of the ink container 901 propels the bubble toward the ink container 901, and no bubble is retained or accumulated in the upper wall surface 822*a* of the joint pipe 880 or the upper wall surface 822*b* of the first valve frame 860*a*. Moreover, since the surface of the part connected to the upper wall surfaces of the joint pipe 880 and first valve frame 860*a* is also smoothly connected, the bubble is prevented from being caught, retained, or accumulated in the connected part. Additionally, in the present embodiment, both the upper wall surface 822*a* of the joint pipe 880 and the upper wall surface 822*b* of the first valve frame 860*a* are inclined upward to the ink container 901 from the negative pressure control chamber container 810, but this example is not limited, and only the upper wall surface 822*b* of the first valve frame 860*a* may be inclined upward.

As described above, the joint pipe 880 of the negative pressure control chamber container 810 of the present embodiment and the first valve frame 860*a* of the ink container 901 promote the gas introduction into the ink container 901 from the negative pressure control chamber container 810, the bubble can be prevented from being retained or accumulated in the joint pipe 880 and first valve frame 860*a* similarly as the first to third embodiments, and the ink can therefore stably be supplied to the negative pressure control chamber container 810 from the ink container 901.

As described above, according to the constitutions of the first, third and fourth embodiments of the present invention, by disposing the taper on the joint pipe as the communication port or the first valve frame upward in the gravity direction in which the bubble moves, and positively moving the bubble toward the ink container, the retention and accumulation of the bubble in the communication part can effectively be inhibited. Here, for the bubble retained in the communication part, a micro bubble is fed to the communication part from the atmosphere communication port through the air path in the negative pressure generating member, and accumulated in the communication part, that is, the area in which the freedom degree of the bubble movement is restricted.

Moreover, the bubble movement to the ink container from the negative pressure control chamber unit in the gas-liquid exchange operation during the liquid supply will be considered from another viewpoint. Then, the bubble is generated in the communication part provided with the ink flow to the negative pressure control chamber unit from the ink container, and is also generated by the ink movement to the negative pressure control chamber unit from the ink container.

Mainly the effect as seen from the new viewpoint will be described hereinafter in fifth to eighth embodiments.

Fifth Embodiment

Figure 29A:
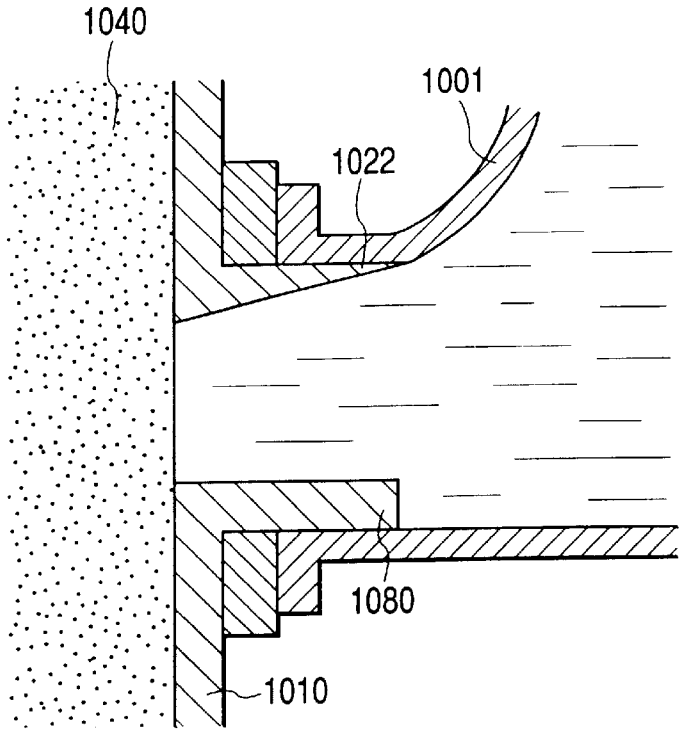
FIGS. 29A and 29B are an enlarged side sectional view in the vicinity of the joint pipe and an explanatory view of a bubble behavior in the vicinity of the joint pipe when the negative pressure control chamber container is bonded to the ink container according to a fifth embodiment of the present invention.
Figure 29B:
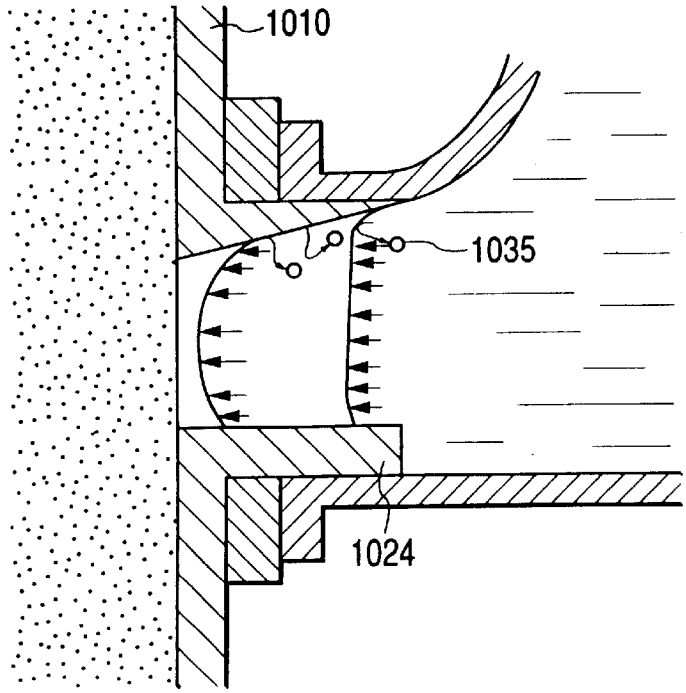

Next, FIG. 29A is an enlarged side sectional view in the vicinity of a joint pipe 1080 when a negative pressure control chamber container 1010 is bonded to an ink container 1001 according to a fifth embodiment, and FIG. 29B is an explanatory view showing the behavior of the bubble in the vicinity of the joint pipe 1080 shown in FIG. 29A.

Additionally, here, the supplementary description on the bubble movement in the first, third and fourth embodiments is included, and the bubble movement of the present embodiment will be described with reference to FIGS. 29A and 29B.

In the present embodiment, the constituting elements of the valve mechanism disposed on the ink tank unit of the ink jet head cartridge according to the first to fourth embodiments are not disposed. Since the other respects are basically similar to the ink jet head cartridge of the first embodiment, the detailed description is omitted.

Also in the present embodiment, similarly as the first, third and fourth embodiments, by disposing the taper on an upper wall surface 1022 of the joint pipe 1080 upward in the gravity direction in which the bubble moves, and positively moving the bubble toward the ink container 1001, the retention and accumulation of the bubble in the joint pipe 1080 are inhibited. Here, when the bubble is positively moved toward the ink container 1001, as a result the ink can more smoothly move in the joint pipe 1080. Particularly, in the container in which the ink containing part is deformed with the ink movement, if the bubble is retained in the joint pipe 1080 during the introducing of the ink to the outside at the high speed, the obstruction of the ink flow is inhibited, as a result a pressure difference is made between the ink container 1001 and the negative pressure control chamber container 1010, and the bubble accumulated on the upper wall surface 1022 of the joint pipe 1080 quickly moves.

Here, for the bubble retained in the joint pipe 1080, the micro bubble is fed to the joint pipe 1080 from the atmosphere communication port through the air path in an absorber 1040, and accumulated in the joint pipe 1080, that is, the area in which the freedom degree of the bubble movement is restricted. Moreover, these micro bubbles are generated in the ink container 1001 provided with the ink flow to the negative pressure control chamber container 1010 from the ink container 1001 during the ink supply operation.

On the other hand, in the constitution of the present embodiment, the sectional area of the joint pipe 1080 in the flow direction increases toward the ink container 1001, and the flow path resistance of the liquid flowing through the joint pipe 1080 decreases toward the ink container 1001. In the constitution, as shown in FIG. 29B, for the flow rate of the ink flow to the negative pressure control chamber container 1010 from the ink container 1001 in the vicinity of the middle of the joint pipe 1080, the flow rate in the area on the side of the ink container 1001 is smaller than that in the area on the side of the negative pressure control chamber container 1010. Specifically, close to the negative pressure control chamber container 1010, a difference in the ink flow rate between the vicinity of the wall surface of the joint pipe 1080 and the vicinity of the middle of the joint pipe 1080 is large. On the other hand, this rate difference is small on the side of the ink container 1001. Specifically, when the sectional area of the joint pipe 1080 increases, the percentage occupied by a rate boundary layer as the area provided with a certain or more flow rate difference in the vicinity of the wall surface decreases in the sectional area in the joint pipe 1080. When the boundary layer is thin and even slightly apart from the wall surface, a micro bubble 1035 rides on the flow with a certain flow rate, and therefore the micro bubble 1035 is not easily attached to the wall surface of the joint pipe 1080. As described above, in the constitution of the present embodiment, the freedom degree of micro bubble movement is secured. As shown in FIGS. 27A, 27B of the third embodiment, the above-described effect can also be obtained when the sectional area increases with respect to the horizontal direction not related with the gravity direction. In practice as a result of an experiment of the form shown in FIGS. 27A, 27B and provided with neither water repellent surface nor hydrophilic surface, it has been confirmed that the effect of inhibiting the bubble from being retained is obtained as compared with a comparative example in which the sectional area of the joint pipe is constant at the sectional area on the side of the negative pressure control chamber container 710.

As described above, the joint pipe 1080 of the negative pressure control chamber container 1010 of the present embodiment promotes the gas introduction into the ink container 1001 from the negative pressure control chamber container 1010, the bubble can be prevented from being retained or accumulated in the joint pipe 1080 similarly as the first to fourth embodiments, and the ink can therefore stably be supplied to the negative pressure control chamber container 1010 from the ink container 1001.

Sixth Embodiment

Figure 30A:
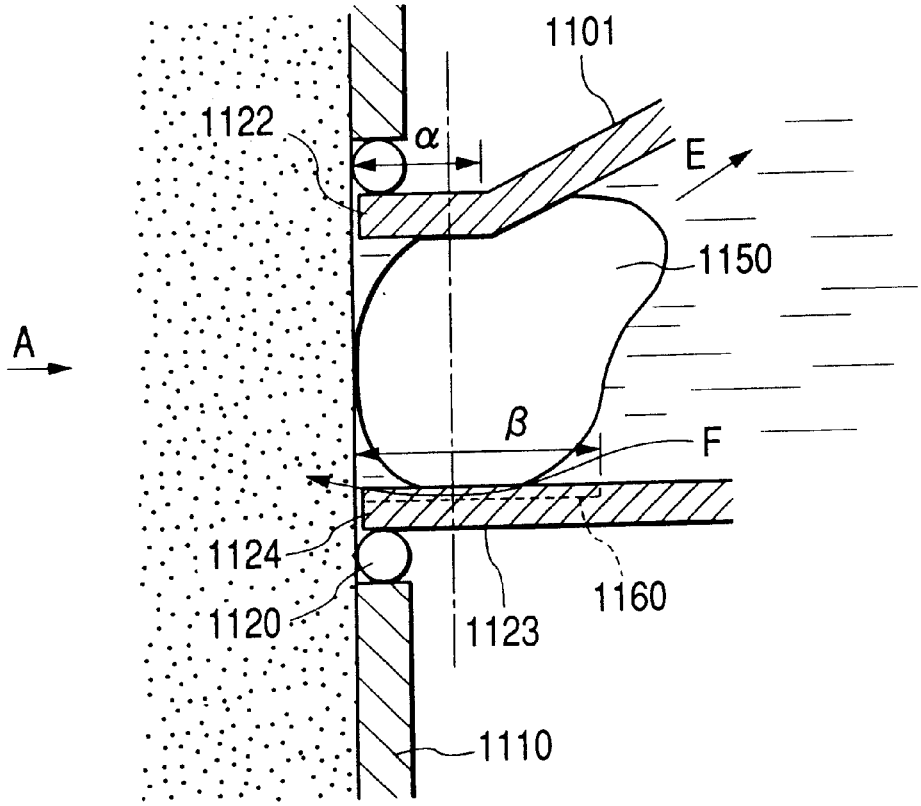
FIGS. 30A and 30B are an enlarged side sectional view in the vicinity of a joint port of the ink container and a plan view of the joint port according to a sixth embodiment of the present invention.
Figure 30B:
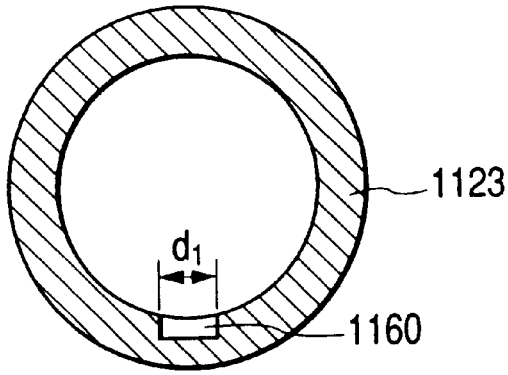

Next, FIG. 30A is an enlarged side sectional view in the vicinity of a joint port 1123 when a negative pressure control chamber container 1110 is bonded to an ink container 1101 according to a sixth embodiment, and FIG. 30B is a plan view of the joint port 1123 shown in FIG. 30A as seen from a direction of arrow A.

A lower wall surface 1124 of the joint port 1123 with a length $\beta$ is provided with a groove 1160 with a width d1 to such an extent no bubble 1150 enters. Moreover, an upper wall surface 1122 of the joint port 1123 has a length $\alpha$, and shorter than the lower wall surface 1124 by $\beta-\alpha$. Moreover, the negative pressure control chamber container 1110 includes no member corresponding to the joint pipe, and the negative pressure control chamber container 1110 and ink container 1101 are sealed by an O ring 1120. Since the other respects are basically similar to the ink jet head cartridge shown in the fifth embodiment, the detailed description is omitted.

As shown in FIG. 30A, even when the bubble 1150 grows to close the joint port 1123, no bubble 1150 enters the groove 1160, the groove 1160 is therefore secured as the ink flow path, and the ink can flow into the negative pressure control chamber container 1110 through the groove 1160 as shown by an arrow F.

Moreover, α of the upper wall surface 1122 of the joint port 1123 as the restraint area for inhibiting the movement of the micro bubble (when the communication part has a tubular shape and is disposed in the substantially horizontal direction as in the present embodiment, the area can be defined as the lowest area in the upper part of the inner wall surface in the section of the tube flow direction) is shorter than β of the lower wall surface 1124 of the joint port 1123 as the restraint area for inhibiting the liquid movement (similarly, the area can be defined as the highest area in the lower part of the inner wall surface in the section of the tube flow direction). In other words, the passage route of the gas in the gas-liquid exchange operation is shorter than the liquid passage route, the bubble 1150 easily moves in a direction of arrow E, and the gas retention can therefore be inhibited.

Additionally, when the distance of the bubble restraint area α of the upper wall surface is further shortened, the tapered upper wall surface is finally obtained as in the first and third to fifth embodiments. Therefore, even in the first and third to fifth embodiments, similarly as the present embodiment, the gas passage route in the gas-liquid exchange operation is constituted to be shorter than the liquid passage route, and this can inhibit the bubble retention.

In the present embodiment, the length of α of the upper wall surface 1122 of the joint port 1123 is set to be shorter than the length of β of the lower wall surface 1124 of the joint port 1123, but this is not limited, and the length a may substantially equal β, or as in the first and third to fifth embodiments, α may be set to substantially zero or zero. Moreover, only one groove 1160 is formed in the example, but this is not limited, and a plurality of grooves 1160 may be formed.

Moreover, similarly as the second embodiment, the upper wall surface 1122 may be subjected to the water repellent treatment, and the lower wall surface 1124 may be subjected to the hydrophilic treatment.

As described above, for the joint port 1123 of the ink container 1101 of the present embodiment, the restraint area α of the bubble 1150 is shorter than the liquid restraint area β, and as described in the fourth embodiment, the sectional area of the joint port 1123 is enlarged toward the ink container 1101 from the negative pressure control chamber container 1110. By the resulting gas-liquid exchange promoting action, the gas introduction to the ink container 1101 from the negative pressure control chamber container 1110 is promoted and the bubble retention and accumulation can therefore be prevented. Moreover, even when the bubble 1150 closes the joint port 1123 in the high-speed gas-liquid exchange operation with a large ink discharge amount, the groove 1160 is secured as the liquid path, and the ink can therefore stably be supplied to the negative pressure control chamber container 1110 from the ink container 1101.

Seventh Embodiment

Figure 31A:
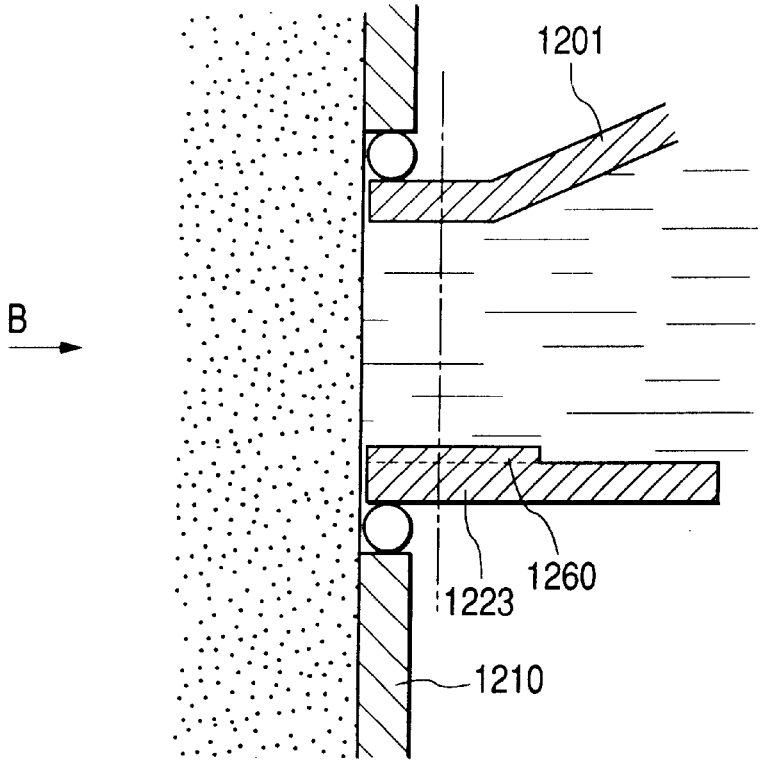
FIGS. 31A and 31B are an enlarged side sectional view in the vicinity of the joint port of the ink container and a plan view of the joint port according to a seventh embodiment of the present invention.
Figure 31B:
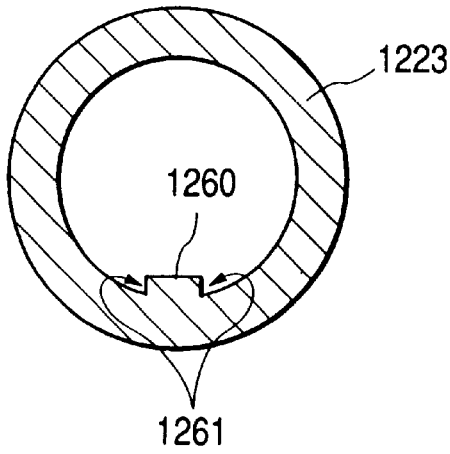

Next, FIG. 31A is an enlarged side sectional view in the vicinity of a joint port 1223 when a negative pressure control chamber container 1210 is bonded to an ink container 1201 according to a seventh embodiment, and FIG. 31B is a plan view of the joint port 1223 shown in FIG. 31A as seen from a direction of arrow B.

Instead of the groove 1160 formed in the joint port 1123 described in the sixth embodiment, the joint port 1223 is provided with a rib 1260 protruded to the middle of the joint port 1223 and using the flow direction as the longitudinal direction. Since the other constitutions are basically similar to the ink jet head cartridge of the sixth embodiment, the detailed description is omitted.

The role of the rib 1260 is similar to that of the groove 1160 described in the sixth embodiment. Specifically, even when the bubble for closing the joint port 1223 exists in the joint port 1223, the bubble fails to close the areas of an ink path 1261 on opposite sides of the rib 1260, and these ink paths 1261 can therefore be secured as the ink path.

Additionally, in the present embodiment, the length of the upper wall surface of the joint port 1223 in the flow direction may substantially equal the length of the lower wall surface, or as in the first and third to fifth embodiments, the restraint area of the upper wall surface may be set to substantially zero or zero. Moreover, only one rib 1260 is formed in the example, but this is not limited, and a plurality of ribs 1260 may be formed.

Furthermore, similarly as the second embodiment, the upper wall surface may be subjected to the water repellent treatment, and the lower wall surface may be subjected to the hydrophilic treatment.

As described above, for the joint port 1223 of the ink container 1201 of the present embodiment, the bubble restraint area is shorter than the liquid restraint area, and as described in the fourth embodiment, the sectional area of the joint port 1223 is enlarged toward the ink container 1201 from the negative pressure control chamber container 1210. By the resulting gas-liquid exchange promoting action, the gas introduction to the ink container 1201 from the negative pressure control chamber container 1210 is promoted and the bubble retention and accumulation can therefore be prevented. Moreover, even when the bubble closes the joint port 1223 in the high-speed gas-liquid exchange operation with the large ink discharge amount, the ink paths 1261 on opposite sides of the rib 1260 are secured as the ink path, and the ink can therefore stably be supplied to the negative pressure control chamber container 1210 from the ink container 1201.

Additionally, the groove and rib described in the sixth and seventh embodiments may also be formed on the joint pipe and first valve frame according to the first to fourth embodiments.

Eighth Embodiment

Figure 32A:
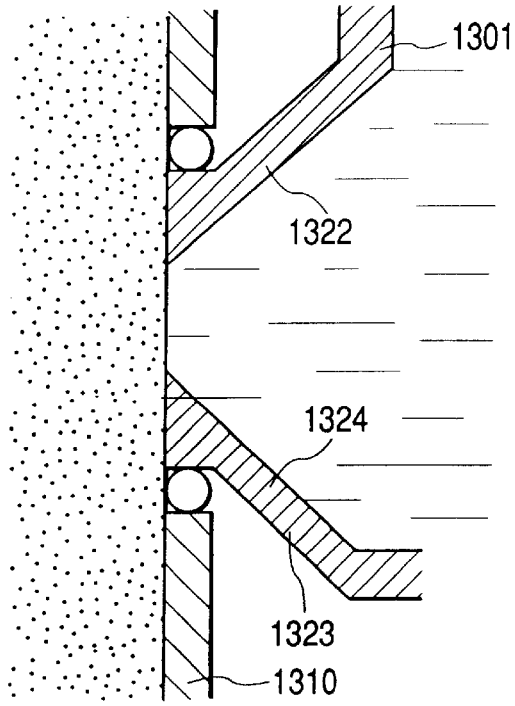
FIGS. 32A and 32B are an enlarged side sectional view in the vicinity of the joint port of the ink container and an explanatory view of the bubble behavior in the vicinity of the joint port according to an eighth embodiment of the present invention.
Figure 32B:
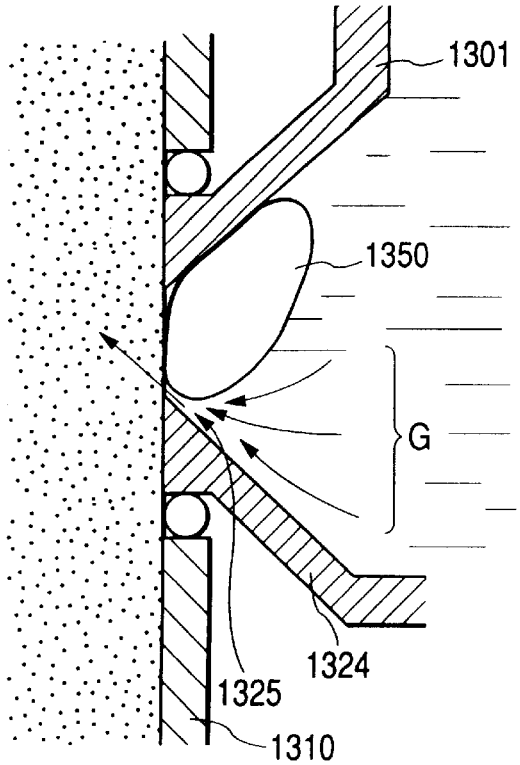

Next, FIG. 32A is an enlarged side sectional view in the vicinity of a joint port 1323 when a negative pressure control chamber container 1310 is bonded to an ink container 1301 according to an eighth embodiment, and FIG. 32B is a plan view showing the bubble and ink behavior during gas-liquid exchange operation in the joint port 1323 shown in FIG. 32A.

For the joint port 1323 of the present embodiment, not only an upper wall surface 1322 but also a lower wall surface 1324 are expanded toward the ink container 1301 from the negative pressure control chamber container 1310, and tapered so that the length of the area corresponding to the bubble and liquid restraint area becomes zero. Since the other respects are basically similar to the ink jet head cartridge described in the sixth and seventh embodiments, the detailed description is omitted.

In the present embodiment, even when a bubble 1350 exists to substantially close the opening of the joint port 1323 on the side of the negative pressure control chamber container 1310, the upper wall surface 1322 is tapered upward so that the bubble 1350 therefore grows and moves upward along the upper wall surface 1322, the lower wall surface 1324 is tapered downward so that a gap 1325 is formed between the bubble 1350 and the lower wall surface 1324, and the ink can flow into the negative pressure control chamber container 1310 from the ink container 1301 through this gap 1325 as shown by an arrow G.

Additionally, in the present embodiment, the length of the upper wall surface 1322 of the joint port 1323 in the flow direction is substantially equal to the length of the lower wall surface 1324, but this is not limited, and the lengths may differ, or the lower wall surface 1324 may be provided with a groove or a rib. Moreover, the upper wall surface 1322 may be subjected to the water repellent treatment, and the lower wall surface 1324 may be subjected to the hydrophilic treatment.

As described above, the upper wall surface 1322 and lower wall surface 1324 of the joint port 1323 of the ink container 1301 of the present embodiment have the tapered shape such that they are expanded to the ink container 1301 from the negative pressure control chamber container 1310. Therefore, as described in the fourth embodiment, by the gas-liquid exchange promoting action obtained by enlarging the sectional area of the joint port 1323 to the ink container 1301 from the negative pressure control chamber container 1310, the gas introduction to the ink container 1301 from the negative pressure control chamber container 1310 is promoted and the bubble retention and accumulation can be prevented. Moreover, even when the bubble closes the joint port 1323 in the high-speed gas-liquid exchange operation with the large ink discharge amount, the gap 1325 formed between the bubble and the lower wall surface 1324 is secured as the ink path, and the ink can therefore stably be supplied to the negative pressure control chamber container 1310 from the ink container 1301.

Additionally, the tapered shape of the downward expanded lower wall surface of the tube part as the communication part between the ink container and the negative pressure control chamber container described in the present embodiment may be formed on the communication part of the first to seventh embodiments.

The first to eighth embodiments have been individually described above as the embodiments of the present invention, but these respective embodiments may be combined in any manner.

<Recording Device>

Finally, one example of an ink jet recording device on which the ink tank unit and ink jet head cartridge can be mounted will be described with reference to FIG. 33.

Figure 33:
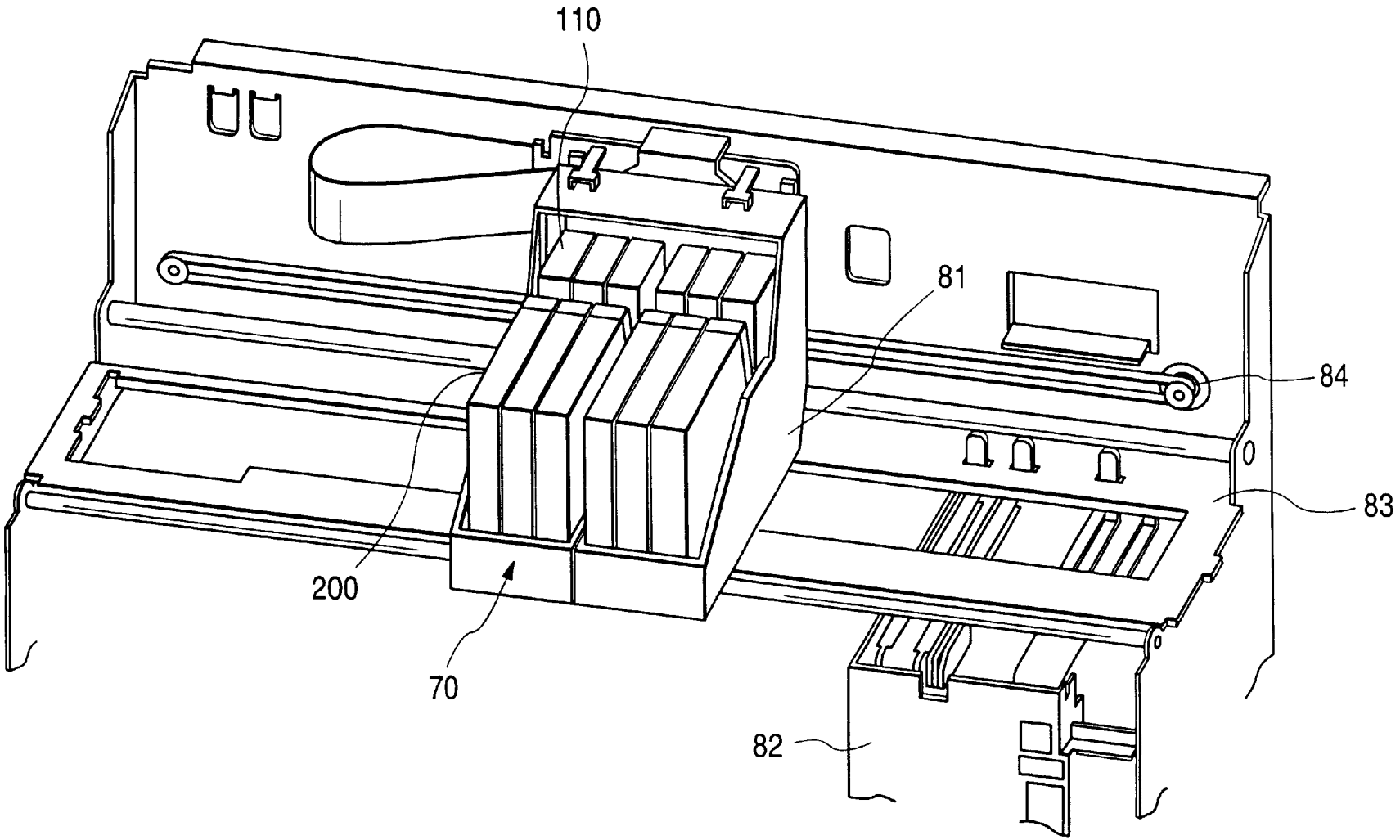
FIG. 33 is a schematic view of a recording device to which the ink jet head cartridge of the present invention can be applied.

The recording device shown in FIG. 33 is provided with a carriage 81 to which the ink tank unit 200 and ink jet head cartridge 70 are detachably attached, a head recovery unit 82 including a head cap for preventing ink dry from a plurality of orifices in a head and a suction pump for sucking ink from the plurality of orifices during head operation defect, and a supply sheet surface 83 for conveying a record sheet as a record medium.

The carriage 81 is in a position on the recovery unit 82 as a home position, and scanned to the left in FIG. 33 by driving a belt 84 by a motor or the like. During the scan, the head discharges the ink to the record sheet conveyed onto the supply sheet surface (platen) 83 and printing is performed.

As described above, according to the present invention, by inclining the upper surface of the communication part upward, and expanding an interval between the opposite side surfaces toward the liquid container, the sectional area of the communication part is increased toward the liquid container and the flow resistance is decreased. Moreover, by subjecting the communication part to the water repellent treatment, the liquid and bubble fluidity can be enhanced by the water repellent effect. Thereby, during the gas-liquid exchange the bubble flows into the liquid supply container without being retained or accumulated in the communication part, and the liquid can stably be supplied to the negative pressure generating member container.

Moreover, the communication part is provided with the recess or the protrusion, or the upper surface of the communication part is inclined upward and the lower surface is inclined downward. Thereby, even when the bubble generated during the supplying of a large amount of liquid to the negative pressure generating member container closes the communication part and exists in the communication part, opposite sides of the recess or the protrusion are secured as the liquid flow path, and the liquid can stably be supplied to the negative pressure generating member container.

What is claimed is:

1. A liquid supply system comprising:

a liquid supply container which includes a liquid containing part for containing a liquid in a sealed space; and a negative pressure generating member container detachably attached to said liquid supply container through a communication portion, said negative pressure generating member container having a negative pressure generating member to hold the liquid, an atmosphere communication vent for communicating with the atmosphere, and a liquid supply part for supplying the liquid to an outside thereof, wherein flow resistance of said communication portion is reduced continuously from said negative pressure generating member container toward said liquid containing part.

2. The liquid supply system according to claim 1, wherein said liquid containing part is deformable to generate a negative pressure.

3. The liquid supply system according to claim 1, wherein a sectional shape of said communication portion includes an area in which the sectional area increases toward said liquid containing part.

4. The liquid supply system according to claim 1, wherein a top surface part of said communication portion includes an inclined area.

5. The liquid supply system according to claim 1, wherein a side surface part of said communication portion includes an area in which an interval from an opposite side surface part is expanded toward said liquid containing part.

6. The liquid supply system according to claim 1, wherein a lower surface part of said communication portion includes an inclined area.

7. The liquid supply system according to claim 1, wherein a lower surface part of said communication portion is provided with a recess part in a direction in which said liquid container communicates with said negative pressure generating member container.

8. The liquid supply system according to claim 1, wherein a lower surface part of said communication portion is provided with a protrusion in a direction in which said liquid container communicates with said negative pressure generating member container.

9. A liquid supply system comprising:

a liquid supply container which includes a liquid containing part for containing a liquid in a sealed space; and a negative pressure generating member container detachably attached to said liquid supply container through a communication portion, said negative pressure generating member container having a negative pressure generating member to hold the liquid, an atmosphere communication vent for communicating with the atmosphere, and a liquid supply part for supplying the liquid to an outside thereof, wherein a gas restraint area on a top surface part side of said communication portion is smaller than a liquid restraint area on a lower surface part side of said communication portion.

10. The liquid supply system according to claim 9, wherein said liquid containing part is deformable to generate a negative pressure.

11. A negative pressure generating member container for detachable attachment to a liquid supply container which includes a liquid containing part for containing a liquid in a sealed space, said negative pressure generating member container comprising:

a negative pressure generating member to hold the liquid;

an atmosphere communication vent for communicating with the atmosphere;

a liquid supply part for supplying the liquid to an outside thereof; and a supply receiving tube to which the liquid is supplied from said liquid supply container, wherein a gas restraint area on a top surface part side of said supply receiving tube is smaller than a liquid restraint area on a lower surface part side of said supply receiving tube.

12. A negative pressure generating member container for detachable attachment to a liquid supply container which includes a liquid containing part for containing a liquid in a sealed space, said negative pressure generating member container comprising:

a negative pressure generating member to hold the liquid;

an atmosphere communication vent for communicating with the atmosphere;

a liquid supply part for supplying the liquid to an outside thereof; and a supply receiving tube to which the liquid is supplied from said liquid supply container, wherein a sectional shape of said supply receiving tube includes an area in which the sectional area of said supply receiving tube increases toward said liquid containing part such that flow resistance of said supply receiving tube is reduced toward said liquid containing part.

* * * * *